US009592692B2

(12) United States Patent
Yamaguchi et al.

(10) Patent No.: US 9,592,692 B2
(45) **Date of Patent: *Mar. 14, 2017**

(54) TAPE CASSETTE

(71) Applicant: Brother Kogyo Kabushiki Kaisha, Nagoya-shi, Aichi-ken (JP)

(72) Inventors: Koshiro Yamaguchi, Kakamigahara (JP); Akira Sago, Seto (JP); Takashi Horiuchi, Kariya (JP); Tsutomu Kato, Nagoya (JP); Teruo Imamaki, Nissin (JP); Yasuhiro Shibata, Okazaki (JP); Susumu Murata, Konan (JP); Kengo Noda, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/130,109

(22) Filed: Apr. 15, 2016

(65) Prior Publication Data

US 2016/0229210 A1 Aug. 11, 2016

Related U.S. Application Data

(63) Continuation of application No. 12/732,257, filed on Mar. 26, 2010.

(30) Foreign Application Priority Data

Mar. 31, 2009 (JP) ..... 2009-088227
Mar. 31, 2009 (JP) ..... 2009-088238
(Continued)

(51) Int. Cl.
*B41J 35/28* (2006.01)
*B41J 15/04* (2006.01)
(Continued)

(52) U.S. Cl.
CPC ..... *B41J 32/00* (2013.01); *B41J 3/4075* (2013.01); *B41J 15/044* (2013.01)

(58) Field of Classification Search
CPC ..... B41J 15/044; B41J 15/042; B41J 15/04
See application file for complete search history.

(56) References Cited

U.S. PATENT DOCUMENTS 3,901,372 A 8/1975 Denley
4,127,883 A 11/1978 Mestdagh
(Continued)

FOREIGN PATENT DOCUMENTS

AU 2003294971 A1 7/2004
CA 2108332 A1 4/1994
(Continued)

OTHER PUBLICATIONS

Jun. 19, 2015—(CN) Notification of First Office Action—App 201310659875.8—Eng Tran.
(Continued)

*Primary Examiner* — David Banh
(74) *Attorney, Agent, or Firm* — Banner & Witcoff, Ltd.

(57) ABSTRACT

A tape cassette that includes a housing, a wound tape, an arm portion, and a first surface. The housing has a top surface, a bottom surface, and a front surface. The front surface extends from the bottom surface toward the top surface in a first direction. The arm portion is defined by a section of the front surface and a first wall. An opening extends through the housing in the first direction. The opening is defined by the first wall, a second wall, and a connection portion. The first surface is provided in the connection portion. The first surface is disposed between the top surface and the bottom surface in the first direction. The housing has a first indentation extending from the bottom surface to the first surface.

20 Claims, 56 Drawing Sheets

(30) Foreign Application Priority Data

| | | |
|---|---|---|
| Mar. 31, 2009 | (JP) | 2009-088241 |
| Jun. 30, 2009 | (JP) | 2009-154695 |
| Nov. 27, 2009 | (JP) | 2009-269693 |
| Nov. 27, 2009 | (JP) | 2009-270056 |
| Nov. 27, 2009 | (JP) | 2009-270067 |
| Nov. 27, 2009 | (JP) | 2009-270163 |
| Nov. 27, 2009 | (JP) | 2009-270221 |
| Nov. 27, 2009 | (JP) | 2009-270325 |

(51) Int. Cl.
*B41J 32/00* (2006.01)
*B41J 3/407* (2006.01)

(56) References Cited

U.S. PATENT DOCUMENTS 4,226,547 A 10/1980 Bradshaw et al.
4,360,278 A 11/1982 Paque
D267,330 S 12/1982 Worrell
4,391,539 A 7/1983 Connoy
4,402,619 A 9/1983 Paque et al.
4,557,617 A 12/1985 Richardson et al.
4,567,488 A 1/1986 Moriguchi et al.
4,678,353 A 7/1987 Richardson et al.
4,725,155 A 2/1988 Kittel et al.
4,773,775 A 9/1988 Bradshaw et al.
4,815,871 A 3/1989 McGourty et al.
4,815,874 A 3/1989 Richardson et al.
4,815,875 A 3/1989 Richardson et al.
4,832,514 A 5/1989 Basile
4,844,636 A 7/1989 Paque
4,880,325 A 11/1989 Ueda et al.
4,892,425 A 1/1990 Shimizu et al.
4,907,902 A * 3/1990 Doi ..... B41J 33/42 116/309
D307,296 S 4/1990 Ivarson et al.
4,915,516 A 4/1990 Shimizu et al.
4,917,514 A 4/1990 Richardson et al.
D307,918 S 5/1990 Goda
4,927,278 A * 5/1990 Kuzuya ..... B41J 3/4075 156/387
4,930,913 A 6/1990 Basile
D311,416 S 10/1990 Richardson et al.
4,966,476 A 10/1990 Kuzuya et al.
4,983,058 A 1/1991 Nagae
5,022,771 A 6/1991 Paque
D319,070 S 8/1991 Lavander
D320,391 S 10/1991 Paque
5,056,940 A 10/1991 Basile
5,078,523 A 1/1992 McGourty et al.
5,098,208 A 3/1992 Martinez
5,104,247 A 4/1992 Ohshima
5,111,216 A 5/1992 Richardson et al.
5,188,469 A 2/1993 Nagao et al.
5,193,919 A 3/1993 Godo et al.
5,195,835 A 3/1993 Collins
5,203,951 A 4/1993 Hattori et al.
5,223,939 A 6/1993 Imaizumi et al.
5,227,477 A 7/1993 Auerbach et al.
5,239,437 A 8/1993 Hoge et al.
D342,275 S 12/1993 Cooper
RE34,521 E 1/1994 Shimizu et al.
5,277,503 A 1/1994 Nagao
5,318,370 A 6/1994 Nehowig
5,348,406 A 9/1994 Yoshiaki et al.
5,350,243 A 9/1994 Ichinomiya et al.
D352,305 S 11/1994 Cooper
5,374,132 A 12/1994 Kimura
D356,333 S 3/1995 Pearce et al.
5,395,173 A 3/1995 Ueno et al.
5,399,033 A 3/1995 Putman
D357,497 S 4/1995 Gray et al.
5,411,339 A 5/1995 Bahrabadi et al.
5,419,648 A 5/1995 Nagao et al.
D359,303 S 6/1995 Gray et al.
5,424,757 A 6/1995 Thom
5,429,443 A 7/1995 Kobayashi et al.
5,431,504 A 7/1995 Beadman et al.
5,435,657 A 7/1995 Pearce et al.
5,466,076 A 11/1995 Kobayashi et al.
5,492,282 A 2/1996 Okuchi et al.
5,492,420 A 2/1996 Nunokawa et al.
5,494,362 A 2/1996 Kobayashi et al.
5,506,736 A 4/1996 Ota
5,511,891 A 4/1996 Nehowig et al.
5,518,328 A 5/1996 Okuchi et al.
D372,044 S 7/1996 Ware et al.
5,533,818 A 7/1996 Bahrabadi
5,536,092 A 7/1996 Yamaguchi
5,538,352 A 7/1996 Sugiura
5,540,510 A 7/1996 Sims et al.
5,541,796 A 7/1996 Sawada
5,553,952 A 9/1996 Umbach
5,564,843 A 10/1996 Kawaguchi
5,593,237 A 1/1997 Nozaki et al.
5,595,447 A 1/1997 Takayama et al.
5,599,119 A 2/1997 Nunokawa et al.
5,605,404 A 2/1997 Nunokawa et al.
5,620,268 A 4/1997 Yamaguchi et al.
5,634,728 A 6/1997 Nunokawa et al.
5,653,542 A 8/1997 Sugimoto et al.
5,658,083 A 8/1997 Day et al.
5,659,441 A 8/1997 Eckberg et al.
5,709,486 A 1/1998 Day
5,727,888 A 3/1998 Sugimoto et al.
5,730,536 A 3/1998 Yamaguchi
5,739,839 A 4/1998 Iwai et al.
5,752,777 A 5/1998 Nunokawa et al.
5,765,954 A 6/1998 Nunokawa et al.
5,771,803 A 6/1998 Takami
5,788,387 A 8/1998 Takayama et al.
5,795,086 A 8/1998 Watanabe et al.
5,813,773 A 9/1998 Kawai
5,813,779 A 9/1998 Palmer et al.
5,823,689 A 10/1998 Nehowig et al.
5,825,724 A 10/1998 Matsumoto et al.
5,826,995 A 10/1998 Day et al.
5,857,788 A 1/1999 Gutsell et al.
5,860,752 A 1/1999 Watanabe et al.
5,887,993 A 3/1999 Nunokawa et al.
5,961,225 A 10/1999 Nunokawa et al.
5,964,539 A 10/1999 Yamaguchi et al.
5,967,678 A 10/1999 Nunokawa et al.
5,997,194 A 12/1999 Nunokawa et al.
6,012,860 A 1/2000 Nunokawa et al.
6,042,280 A 3/2000 Yamaguchi et al.
6,048,118 A 4/2000 Martinez et al.
6,050,672 A 4/2000 Matsuhashi
6,050,734 A 4/2000 Watanabe et al.
6,059,469 A 5/2000 Hirumi
6,106,171 A 8/2000 Nunokawa et al.
6,116,796 A 9/2000 Yamaguchi et al.
6,126,344 A 10/2000 Takayama et al.
6,132,120 A 10/2000 Yamaguchi et al.
6,146,034 A 11/2000 Watanabe et al.
6,149,325 A 11/2000 Nunokawa et al.
6,160,679 A 12/2000 Maekawa et al.
6,167,696 B1 1/2001 Maaseidvaag et al.
6,168,328 B1 1/2001 Ueda et al.
6,190,065 B1 2/2001 Brzuskiewicz
6,190,069 B1 2/2001 Yamaguchi et al.
6,196,740 B1 3/2001 Yamaguchi et al.
6,227,477 B1 5/2001 Komatsuzaki et al.
6,232,993 B1 5/2001 Kobayashi et al.
6,270,269 B1 8/2001 Watanabe et al.
6,317,156 B1 11/2001 Nagasaki et al.
6,334,724 B2 1/2002 Yamaguchi et al.
6,386,774 B1 5/2002 Takayama et al.
6,406,202 B1 6/2002 Unno et al.
6,419,648 B1 7/2002 Vitek et al.
6,429,443 B1 8/2002 Mankos et al.
6,435,744 B1 8/2002 Dunn et al.

(56) References Cited

U.S. PATENT DOCUMENTS

| | | | |
|---|---|---|---|
| 6,476,838 | B1 | 11/2002 | Italiano |
| 6,485,206 | B1 | 11/2002 | Takahashi |
| 6,520,696 | B2 | 2/2003 | Huss et al. |
| 6,644,876 | B2 | 11/2003 | Carriere et al. |
| D486,853 | S | 2/2004 | Wilken et al. |
| 6,709,179 | B2 | 3/2004 | Yamaguchi et al. |
| 6,910,819 | B2 | 6/2005 | Carriere et al. |
| 6,929,415 | B2 | 8/2005 | Wilken |
| 6,955,318 | B2 | 10/2005 | Nonomura |
| D519,522 | S | 4/2006 | Lee |
| 7,070,347 | B2 | 7/2006 | Carriere et al. |
| 7,070,348 | B2 | 7/2006 | Sugimoto et al. |
| 7,097,372 | B1 | 8/2006 | Heyse et al. |
| 7,121,751 | B2 | 10/2006 | Harada et al. |
| 7,128,483 | B2 | 10/2006 | Harada et al. |
| D534,203 | S | 12/2006 | Harada et al. |
| 7,201,522 | B2 | 4/2007 | Bandholz et al. |
| D542,334 | S | 5/2007 | Harada et al. |
| 7,232,268 | B2 | 6/2007 | Sugimoto et al. |
| 7,287,715 | B2 | 10/2007 | Ban |
| 7,296,941 | B2 | 11/2007 | Suzuki et al. |
| 7,357,585 | B2 | 4/2008 | Kurashina |
| 7,404,684 | B2 | 7/2008 | Sugimoto et al. |
| D579,942 | S | 11/2008 | Terry et al. |
| 7,503,714 | B2 | 3/2009 | Yamamoto et al. |
| 7,841,790 | B2 | 11/2010 | Yamaguchi et al. |
| 7,942,594 | B2 | 5/2011 | Kumazaki et al. |
| 7,965,308 | B2 | 6/2011 | Jauert et al. |
| 8,045,288 | B2 | 10/2011 | Ota et al. |
| 8,109,684 | B2 | 2/2012 | Yamaguchi |
| 8,162,553 | B2 | 4/2012 | Vandermeulen |
| 8,164,609 | B2 | 4/2012 | Liu et al. |
| 8,382,389 | B2 | 2/2013 | Yamaguchi et al. |
| D681,727 | S | 5/2013 | Van Den Broecke |
| 8,529,142 | B2 | 9/2013 | Tanaka |
| 8,540,444 | B2 | 9/2013 | Vandermeulen et al. |
| 8,562,228 | B2 | 10/2013 | Yamaguchi et al. |
| 8,641,304 | B2 | 2/2014 | Yamaguchi et al. |
| 8,734,035 | B2 | 5/2014 | Suva et al. |
| 8,740,482 | B2 | 6/2014 | Yamaguchi et al. |
| 8,757,907 | B2 | 6/2014 | Yamaguchi et al. |
| 8,764,326 | B2 | 7/2014 | Yamaguchi et al. |
| 8,770,877 | B2 | 7/2014 | Yamaguchi et al. |
| 2002/0006303 | A1 | 1/2002 | Yamaguchi et al. |
| 2002/0012558 | A1 | 1/2002 | Huss et al. |
| 2002/0047063 | A1 | 4/2002 | Kaneda et al. |
| 2002/0135938 | A1 | 9/2002 | Hiraguchi et al. |
| 2003/0081978 | A1 | 5/2003 | Carriere et al. |
| 2004/0056143 | A1 | 3/2004 | Nonomura |
| 2004/0062586 | A1 | 4/2004 | Harada et al. |
| 2004/0233269 | A1 | 11/2004 | Tsubota |
| 2004/0265027 | A1 | 12/2004 | Hine et al. |
| 2005/0036816 | A1 | 2/2005 | Carriere et al. |
| 2005/0152732 | A1 | 7/2005 | Bandholz et al. |
| 2005/0172981 | A1 | 8/2005 | Byun |
| 2006/0008608 | A1 | 1/2006 | Kurashina |
| 2006/0088802 | A1 | 4/2006 | Akaiwa |
| 2006/0182921 | A1 | 8/2006 | Hioki et al. |
| 2006/0193669 | A1 | 8/2006 | Takada et al. |
| 2006/0204304 | A1 | 9/2006 | Hioki et al. |
| 2006/0216099 | A1 | 9/2006 | Sakano et al. |
| 2006/0216100 | A1 | 9/2006 | Minoya et al. |
| 2006/0233582 | A1 | 10/2006 | Horiuchi |
| 2006/0238600 | A1 | 10/2006 | Vandermeulen et al. |
| 2006/0239743 | A1 | 10/2006 | Naito |
| 2007/0009302 | A1 | 1/2007 | Vandermeulen |
| 2007/0009306 | A1 | 1/2007 | Harada et al. |
| 2007/0031171 | A1 | 2/2007 | Heyse et al. |
| 2007/0041772 | A1 | 2/2007 | Harada et al. |
| 2007/0070168 | A1 | 3/2007 | Mindler et al. |
| 2007/0098473 | A1 | 5/2007 | Heyse et al. |
| 2007/0172293 | A1 | 7/2007 | Vandermeulen |
| 2007/0212149 | A1 | 9/2007 | Ota et al. |
| 2007/0231041 | A1 | 10/2007 | Ueda et al. |
| 2007/0237562 | A1 | 10/2007 | Kato et al. |
| 2007/0264070 | A1 | 11/2007 | Loo et al. |
| 2007/0283249 | A1 | 12/2007 | Nose et al. |
| 2008/0003043 | A1 | 1/2008 | Fukui et al. |
| 2008/0050160 | A1 | 2/2008 | Yamaguchi et al. |
| 2008/0056793 | A1 | 3/2008 | Yokoyama |
| 2008/0080922 | A1 | 4/2008 | Vandermeulen |
| 2008/0181703 | A1 | 7/2008 | Ito et al. |
| 2008/0181708 | A1 | 7/2008 | Yamaguchi et al. |
| 2008/0226373 | A1 | 9/2008 | Yamaguchi et al. |
| 2008/0232886 | A1 | 9/2008 | Kato et al. |
| 2008/0310904 | A1 | 12/2008 | Yamaguchi et al. |
| 2009/0016795 | A1 | 1/2009 | Caveney et al. |
| 2009/0190988 | A1 | 7/2009 | Vereecken et al. |
| 2009/0202283 | A1 | 8/2009 | Kumazaki et al. |
| 2009/0285617 | A1 | 11/2009 | Vandermeulen |
| 2010/0119281 | A1 | 5/2010 | Ford et al. |
| 2010/0166475 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0232862 | A1 | 9/2010 | Vandermeulen |
| 2010/0247208 | A1 | 9/2010 | Yamaguchi et al. |
| 2010/0247209 | A1 | 9/2010 | Yamaguchi et al. |
| 2010/0247210 | A1 | 9/2010 | Yamaguchi et al. |
| 2010/0272492 | A1 | 10/2010 | Van Britsom et al. |
| 2011/0058884 | A1 | 3/2011 | Kato et al. |
| 2012/0008999 | A1 | 1/2012 | Yamaguchi et al. |
| 2012/0027485 | A1 | 2/2012 | Suva et al. |
| 2012/0027486 | A1 | 2/2012 | Suva et al. |
| 2012/0027487 | A1 | 2/2012 | Suva et al. |
| 2012/0057917 | A1 | 3/2012 | Van Britsom et al. |
| 2012/0080550 | A1 | 4/2012 | Yamaguchi et al. |
| 2012/0170959 | A1 | 7/2012 | Vandermeulen et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0205350 | A1 | 7/2014 | Yamaguchi et al. |
| 2014/0218458 | A1 | 8/2014 | Suva et al. |

FOREIGN PATENT DOCUMENTS

| | | | |
|---|---|---|---|
| CA | 2182264 | A1 | 6/1996 |
| CH | 121073 | A | 6/1927 |
| CH | 136498 | A | 11/1929 |
| CN | 1098984 | A | 2/1995 |
| CN | 1119146 | A | 3/1996 |
| CN | 1143928 | A | 2/1997 |
| CN | 1146954 | A | 4/1997 |
| CN | 1148547 | A | 4/1997 |
| CN | 1148548 | A | 4/1997 |
| CN | 1166155 | A | 11/1997 |
| CN | 1289293 | A | 3/2001 |
| CN | 1313197 | A | 9/2001 |
| CN | 1313198 | A | 9/2001 |
| CN | 1085151 | C | 5/2002 |
| CN | 1376115 | A | 10/2002 |
| CN | 1385312 | A | 12/2002 |
| CN | 1385313 | A | 12/2002 |
| CN | 1385314 | A | 12/2002 |
| CN | 1397431 | A | 2/2003 |
| CN | 1415482 | A | 5/2003 |
| CN | 1415484 | A | 5/2003 |
| CN | 1415485 | A | 5/2003 |
| CN | 1469811 | A | 1/2004 |
| CN | 1493462 | A | 5/2004 |
| CN | 1636755 | A | 7/2005 |
| CN | 1642746 | A | 7/2005 |
| CN | 1663807 | A | 9/2005 |
| CN | 1744993 | A | 3/2006 |
| CN | 1744994 | A | 3/2006 |
| CN | 1762720 | A | 4/2006 |
| CN | 1799850 | A | 7/2006 |
| CN | 1799851 | A | 7/2006 |
| CN | 1820940 | A | 8/2006 |
| CN | 1827386 | A | 9/2006 |
| CN | 1835867 | A | 9/2006 |
| CN | 1865012 | A | 11/2006 |
| CN | 1914045 | A | 2/2007 |
| CN | 1990261 | A | 7/2007 |
| CN | 1331684 | C | 8/2007 |

(56) References Cited

FOREIGN PATENT DOCUMENTS

| | | | |
|---|---|---|---|
| CN | 101028771 | A | 9/2007 |
| CN | 101039807 | A | 9/2007 |
| CN | 101060985 | A | 10/2007 |
| CN | 101128324 | A | 2/2008 |
| CN | 101229724 | A | 7/2008 |
| CN | 101264701 | A | 9/2008 |
| CN | 101264702 | A | 9/2008 |
| CN | 101310989 | A | 11/2008 |
| CN | 101327696 | A | 12/2008 |
| CN | 101356061 | A | 1/2009 |
| CN | 101516628 | A | 8/2009 |
| CN | 101758676 | A | 6/2010 |
| CN | 102616025 | A | 8/2012 |
| CN | 202895934 | U | 4/2013 |
| EP | 214466 | A2 | 3/1987 |
| EP | 0329369 | A2 | 8/1989 |
| EP | 0511602 | A1 | 11/1992 |
| EP | 0555954 | A2 | 8/1993 |
| EP | 0593269 | A2 | 4/1994 |
| EP | 0629509 | A2 | 12/1994 |
| EP | 0635375 | A2 | 1/1995 |
| EP | 0644506 | A2 | 3/1995 |
| EP | 0684143 | A2 | 11/1995 |
| EP | 0703089 | A1 | 3/1996 |
| EP | 734878 | A2 | 10/1996 |
| EP | 0742103 | A1 | 11/1996 |
| EP | 0760291 | A2 | 3/1997 |
| EP | 0863021 | B1 | 9/1998 |
| EP | 0644506 | B1 | 4/1999 |
| EP | 0936076 | A2 | 8/1999 |
| EP | 0940263 | A2 | 9/1999 |
| EP | 0958931 | A2 | 11/1999 |
| EP | 0997300 | A2 | 5/2000 |
| EP | 1167049 | A1 | 1/2002 |
| EP | 1170139 | A1 | 1/2002 |
| EP | 1199179 | A1 | 4/2002 |
| EP | 1284196 | A2 | 2/2003 |
| EP | 1502758 | A1 | 2/2005 |
| EP | 1516739 | A1 | 3/2005 |
| EP | 1552949 | A1 | 7/2005 |
| EP | 1575781 | A1 | 9/2005 |
| EP | 1700705 | A1 | 9/2006 |
| EP | 1707395 | A1 | 10/2006 |
| EP | 1829696 | A2 | 9/2007 |
| EP | 2059396 | A1 | 5/2009 |
| EP | 2236303 | A1 | 10/2010 |
| EP | 2236304 | A1 | 10/2010 |
| EP | 2448762 | B1 | 9/2013 |
| JP | S56-20944 | U | 2/1981 |
| JP | S58-139415 | U | 9/1983 |
| JP | S58-220783 | A | 12/1983 |
| JP | S59-78879 | A | 5/1984 |
| JP | S60-99692 | A | 6/1985 |
| JP | S61-179776 | A | 8/1986 |
| JP | S62-173944 | U | 11/1987 |
| JP | S63-81063 | U | 5/1988 |
| JP | S63-166557 | A | 7/1988 |
| JP | S63-203348 | A | 8/1988 |
| JP | S63-254085 | A | 10/1988 |
| JP | H01-195088 | A | 8/1989 |
| JP | H01-146945 | U | 10/1989 |
| JP | H02-56664 | U | 4/1990 |
| JP | H02-56665 | U | 4/1990 |
| JP | H02-56666 | U | 4/1990 |
| JP | H02-147272 | A | 6/1990 |
| JP | H03-14865 | A | 1/1991 |
| JP | H03-63155 | A | 3/1991 |
| JP | H03-93584 | A | 4/1991 |
| JP | H03-151261 | A | 6/1991 |
| JP | H03-118672 | U | 12/1991 |
| JP | H03-120680 | U | 12/1991 |
| JP | H11-263055 | U | 12/1991 |
| JP | H04-16113 | U | 2/1992 |
| JP | H04-37575 | A | 2/1992 |
| JP | H04-133756 | A | 5/1992 |
| JP | H04-168086 | A | 6/1992 |
| JP | H05-16342 | U | 3/1993 |
| JP | H05-18853 | U | 3/1993 |
| JP | H05-63067 | A | 3/1993 |
| JP | H05-104840 | A | 4/1993 |
| JP | H05-155067 | A | 6/1993 |
| JP | H05-54225 | U | 7/1993 |
| JP | H05-78565 | U | 10/1993 |
| JP | H05-80765 | U | 11/1993 |
| JP | H05-294051 | A | 11/1993 |
| JP | H05-301435 | A | 11/1993 |
| JP | H06-12053 | U | 2/1994 |
| JP | H06-52560 | A | 2/1994 |
| JP | H06-21953 | U | 3/1994 |
| JP | H06-122239 | A | 5/1994 |
| JP | H06-122249 | A | 5/1994 |
| JP | H06-124406 | A | 5/1994 |
| JP | H06-127094 | A | 5/1994 |
| JP | H06-152907 | A | 5/1994 |
| JP | H06-53560 | U | 7/1994 |
| JP | H06-183117 | A | 7/1994 |
| JP | H06-191081 | A | 7/1994 |
| JP | H06-210889 | A | 8/1994 |
| JP | H06-255145 | A | 9/1994 |
| JP | H06-74348 | U | 10/1994 |
| JP | H06-328800 | A | 11/1994 |
| JP | H07-1782 | A | 1/1995 |
| JP | H07-1805 | A | 1/1995 |
| JP | H07-9743 | A | 1/1995 |
| JP | H07-20725 | A | 1/1995 |
| JP | H07-25122 | A | 1/1995 |
| JP | H07-25123 | A | 1/1995 |
| JP | H07-47737 | A | 2/1995 |
| JP | H07-61009 | A | 3/1995 |
| JP | H07-68814 | A | 3/1995 |
| JP | H07-68877 | A | 3/1995 |
| JP | H07-069497 | A | 3/1995 |
| JP | H07-89115 | A | 4/1995 |
| JP | H07-89196 | A | 4/1995 |
| JP | H07-101133 | A | 4/1995 |
| JP | H07-108702 | A | 4/1995 |
| JP | H07-108730 | A | 4/1995 |
| JP | H07-137327 | A | 5/1995 |
| JP | H07-40456 | U | 7/1995 |
| JP | H07-214876 | A | 8/1995 |
| JP | H07-237314 | A | 9/1995 |
| JP | H07-251539 | A | 10/1995 |
| JP | H07-276695 | A | 10/1995 |
| JP | H07-290803 | A | 11/1995 |
| JP | H07-314862 | A | 12/1995 |
| JP | H07-314864 | A | 12/1995 |
| JP | H07-314865 | A | 12/1995 |
| JP | H07-314866 | A | 12/1995 |
| JP | H08-25768 | A | 1/1996 |
| JP | H08-39909 | A | 2/1996 |
| JP | H08-058211 | A | 3/1996 |
| JP | H08-90887 | A | 4/1996 |
| JP | H08-118738 | A | 5/1996 |
| JP | H08-165035 | A | 6/1996 |
| JP | H08-216461 | A | 8/1996 |
| JP | H08-252964 | A | 10/1996 |
| JP | H08-267839 | A | 10/1996 |
| JP | H08-290618 | A | 11/1996 |
| JP | H09-39347 | A | 2/1997 |
| JP | 2596263 | B2 | 4/1997 |
| JP | H09-109533 | A | 4/1997 |
| JP | H09-118044 | A | 5/1997 |
| JP | H09-123579 | A | 5/1997 |
| JP | H09-134557 | A | 5/1997 |
| JP | H09-141986 | A | 6/1997 |
| JP | H09-141997 | A | 6/1997 |
| JP | H09-188049 | A | 7/1997 |
| JP | H09-188050 | A | 7/1997 |
| JP | H09-240158 | A | 9/1997 |
| JP | H10-56604 | A | 2/1998 |
| JP | H10-181063 | A | 7/1998 |
| JP | H10-301701 | A | 11/1998 |
| JP | H11-78188 | A | 3/1999 |
| JP | H11-78189 | A | 3/1999 |

(56) References Cited

FOREIGN PATENT DOCUMENTS

| | | | |
|---|---|---|---|
| JP | H11-91144 | A | 4/1999 |
| JP | H11-105351 | A | 4/1999 |
| JP | H11-129563 | A | 5/1999 |
| JP | H11-263056 | A | 9/1999 |
| JP | 2000-006481 | A | 1/2000 |
| JP | 2000-006501 | A | 1/2000 |
| JP | 2998617 | B2 | 1/2000 |
| JP | 2000025251 | A | 1/2000 |
| JP | 2000-043337 | A | 2/2000 |
| JP | 2000043336 | A | 2/2000 |
| JP | 2000-076372 | A | 3/2000 |
| JP | 2000085224 | A | 3/2000 |
| JP | 3031439 | B2 | 4/2000 |
| JP | 2000103129 | A | 4/2000 |
| JP | 20000103131 | A | 4/2000 |
| JP | 2000135843 | A | 5/2000 |
| JP | 2000198258 | A | 7/2000 |
| JP | 2000-211193 | A | 8/2000 |
| JP | 2000-229750 | A | 8/2000 |
| JP | 2001011594 | A | 1/2001 |
| JP | 2001048389 | A | 2/2001 |
| JP | 2001088359 | A | 4/2001 |
| JP | 2001121797 | A | 5/2001 |
| JP | 3207860 | B2 | 9/2001 |
| JP | 2001310540 | A | 11/2001 |
| JP | 2001319447 | A | 11/2001 |
| JP | 2002-053248 | A | 2/2002 |
| JP | 2002042441 | A | 2/2002 |
| JP | 3266736 | B2 | 3/2002 |
| JP | 3266739 | B2 | 3/2002 |
| JP | 2002-103762 | A | 4/2002 |
| JP | 2002104568 | A | 4/2002 |
| JP | 2002-166606 | A | 6/2002 |
| JP | 2002-167084 | A | 6/2002 |
| JP | 2002166605 | A | 6/2002 |
| JP | 2002179300 | A | 6/2002 |
| JP | 2002192769 | A | 7/2002 |
| JP | 2002308481 | A | 10/2002 |
| JP | 2002308518 | A | 10/2002 |
| JP | 3357128 | B2 | 12/2002 |
| JP | 2002367333 | A | 12/2002 |
| JP | 2003-011454 | A | 1/2003 |
| JP | 2003-026164 | A | 1/2003 |
| JP | 2003-506235 | A | 2/2003 |
| JP | 3378622 | B2 | 2/2003 |
| JP | 2003048337 | A | 2/2003 |
| JP | 2003-072127 | A | 3/2003 |
| JP | 2003145902 | A | 5/2003 |
| JP | 3426983 | B2 | 7/2003 |
| JP | 2003-251904 | A | 9/2003 |
| JP | 2003251902 | A | 9/2003 |
| JP | 2003285522 | A | 10/2003 |
| JP | 2004-018077 | A | 1/2004 |
| JP | 2004-155150 | A | 6/2004 |
| JP | 3543659 | B2 | 7/2004 |
| JP | 2004-255656 | A | 9/2004 |
| JP | 3564848 | B2 | 9/2004 |
| JP | 3567469 | B2 | 9/2004 |
| JP | 2004291591 | A | 10/2004 |
| JP | 2004323241 | A | 11/2004 |
| JP | 3106187 | U | 12/2004 |
| JP | 2005-059504 | A | 3/2005 |
| JP | 2005088597 | A | 4/2005 |
| JP | 2005-178206 | A | 7/2005 |
| JP | 2005231203 | A | 9/2005 |
| JP | 2005-298031 | A | 10/2005 |
| JP | 2005280008 | A | 10/2005 |
| JP | 2005297348 | A | 10/2005 |
| JP | 2006021432 | A | 1/2006 |
| JP | 2006-512224 | A | 4/2006 |
| JP | 2006096030 | A | 4/2006 |
| JP | 2006142835 | A | 6/2006 |
| JP | 2006168974 | A | 6/2006 |
| JP | 2006182034 | A | 7/2006 |
| JP | 2006-240310 | A | 9/2006 |
| JP | 2006248059 | A | 9/2006 |
| JP | 2006-264337 | A | 10/2006 |
| JP | 2006272895 | A | 10/2006 |
| JP | 2006272977 | A | 10/2006 |
| JP | 2006289991 | A | 10/2006 |
| JP | 2007111863 | A | 5/2007 |
| JP | 2007196654 | A | 8/2007 |
| JP | 2007-230155 | A | 9/2007 |
| JP | 2007-268815 | A | 10/2007 |
| JP | 4003068 | B2 | 11/2007 |
| JP | 2007296863 | A | 11/2007 |
| JP | 2008044180 | A | 2/2008 |
| JP | 4061507 | B2 | 3/2008 |
| JP | 2008062474 | A | 3/2008 |
| JP | 2008080668 | A | 4/2008 |
| JP | 2008083432 | A | 4/2008 |
| JP | 2008094103 | A | 4/2008 |
| JP | 2008509823 | A | 4/2008 |
| JP | 2008-213462 | A | 9/2008 |
| JP | 2008-229855 | A | 10/2008 |
| JP | 2008254384 | A | 10/2008 |
| JP | 2008-279678 | A | 11/2008 |
| JP | 2008265180 | A | 11/2008 |
| JP | 2008265278 | A | 11/2008 |
| JP | 2008-307703 | A | 12/2008 |
| JP | 2009001020 | A | 1/2009 |
| JP | 2009028976 | A | 2/2009 |
| JP | 2009509812 | A | 3/2009 |
| JP | 2009184832 | A | 8/2009 |
| JP | 2009-214431 | A | 9/2009 |
| JP | 2009-215083 | A | 9/2009 |
| JP | 2010-234697 | A | 10/2010 |
| JP | 4571626 | B2 | 10/2010 |
| JP | 2011-011407 | A | 1/2011 |
| JP | 2011011401 | A | 1/2011 |
| JP | 2011110843 | A | 6/2011 |
| JP | 2011110845 | A | 6/2011 |
| JP | 2011110848 | A | 6/2011 |
| KR | 2007-0091073 | A | 9/2007 |
| RU | 2297333 | C2 | 4/2007 |
| TW | 200827179 | A | 7/2008 |
| WO | 96/16812 | A1 | 6/1996 |
| WO | 0032401 | A1 | 6/2000 |
| WO | 0110649 | A1 | 2/2001 |
| WO | 0232680 | A1 | 4/2002 |
| WO | 03080350 | A1 | 10/2003 |
| WO | 2004/058509 | A1 | 7/2004 |
| WO | 2005101306 | A1 | 10/2005 |
| WO | 2005/120844 | A1 | 12/2005 |
| WO | 20060013466 | A2 | 2/2006 |
| WO | 2006024913 | A2 | 3/2006 |
| WO | 2006033431 | A1 | 3/2006 |
| WO | 2006033432 | A1 | 3/2006 |
| WO | 2006090842 | A1 | 8/2006 |
| WO | 2008/029931 | A1 | 3/2008 |
| WO | 2009107534 | A1 | 9/2009 |
| WO | 2010113445 | A1 | 10/2010 |
| WO | 2010113782 | A1 | 10/2010 |

OTHER PUBLICATIONS

Jun. 25, 2015—(US) Non-Final Office Action—U.S. Appl. No. 13/431,350.

Mar. 2, 2015 (TW) Office Action in Application No. 101110368.

Mar. 4, 2015—(US) Final Office Action—U.S. Appl. No. 14/141,576.

Mar. 4, 2015—(US) Non-Final Office Action—U.S. Appl. No. 14/226,386.

Mar. 6, 2015 (AU) Office Action in Application No. 2010231425.

Mar. 6, 2015—(US) Final Office Action—U.S. Appl. No. 14/226,424.

Mar. 10, 2015—(JP) Office Action in Application No. 2014-095027.

Mar. 12, 2015—(EP) Search Report in Application No. 14156840.2.

Mar. 13, 2015—(US) Notice of Allowance in U.S. Appl. No. 14/226,165.

Mar. 17, 2015—(US) Notice of Allowance—U.S. Appl. No. 13/848,750.

(56) References Cited

OTHER PUBLICATIONS

Mar. 23, 2015 (US) Notice of Allowance in U.S. Appl. No. 13/934,512.
May 1, 2015—(US) Notice of Allowance—U.S. Appl. No. 12/644,572.
May 6, 2015—(US) Final Office Action—U.S. Appl. No. 14/226,259.
May 6, 2015—(US) Final Office Action—U.S. Appl. No. 14/226,373.
May 19, 2015—(US) Notice of Allowance—U.S. Appl. No. 14/226,201.
May 19, 2015—(US) Final Office Action—U.S. Appl. No. 14/226,289.
May 20, 2015—(US) Notice of Allowance—U.S. Appl. No. 13/848,750.
May 22, 2015—(US) Non-Final Office Action—U.S. Appl. No. 12/732,257.
May 26, 2015—(CN) Office Action—App 201310659625.4.
May 29, 2015—(MY) Substantive Examination Adverse Report—App. PI 2013702520—Eng Tran.
May 29, 2015—(US) Notice of Allowance—U.S. Appl. No. 14/226,165.
Nov. 3, 2015—(US) Notice of Allowance—U.S. Appl. No. 14/226,259.
Nov. 9, 2015—(US) Notice of Allowance—U.S. Appl. No. 13/848,750.
Nov. 13, 2015—(US) Non-Final Office Action—U.S. Appl. No. 14/226,289.
Nov. 20, 2015—(KR) Office Action—App 10-2011-7017238.
Nov. 20, 2015—(KR) Office Action—App 10-2015-7006347.
Nov. 25, 2015—(US) Final Office Action—U.S. Appl. No. 14/226,256.
Nov. 27, 2015—(CN) Office Action—App 201410311930.9.
Nov. 27, 2015—(US) Notice of Allowance—U.S. Appl. No. 14/226,367.
Oct. 1, 2015—(US) Notice of Allowance—U.S. Appl. No. 12/732,457.
Oct. 5, 2015—(US) Notice of Allowance—U.S. Appl. No. 12/644,572.
Oct. 5, 2015—(US) Notice of Allowance—U.S. Appl. No. 14/141,673.
Oct. 7, 2015—(US)—Final Office Action—U.S. Appl. No. 13/240,322.
Oct. 13, 2015—(US) Notice of Allowance—U.S. Appl. No. 13/430,033.
Oct. 20, 2015—(US) Notice of Allowance—U.S. Appl. No. 14/226,201.
Oct. 22, 2015—(US) Final Office Action—U.S. Appl. No. 14/641,681.
Oct. 23, 2015—(US) Final Office Action—U.S. Appl. No. 13/431,350.
Oct. 26, 2015—(US)—Non-Final Office Action—U.S. Appl. No. 14/643,865.
Oct. 27, 2015—(CN) Office Action—App 201410195767.4.
Oct. 30, 2015—(US)—Non-Final Office Action—U.S. Appl. No. 14/226,373.
Sep. 1, 2015—(US) Notice of Allowance—U.S. Appl. No. 14/226,259.
Sep. 2, 2016—(CN) Notification of First Office Action—App 201410200475.5.
Sep 8, 2015—(JP) Office Action—App 2014-210427—Eng Tran.
Sep. 8, 2015—(US) Notice of Allowance—U.S. Appl. No. 14/141,673.
Sep. 9, 2015—(US) Final Office Action—U.S. Appl. No. 14/226,386.
Sep. 17, 2015—(US) Non-Final Office Action—U.S. Appl. No. 14/226,424.
Sep. 18, 2015—(US) Non-Final Office Action—U.S. Appl. No. 14/226,428.
Feb. 5, 2016—(US) Non-Final Office Action—U.S. Appl. No. 13/240,322.
Feb. 11, 2016—(US) Notice of Allowance—U.S. Appl. No. 14/226,402.
Nov. 15, 2011 (PCT) International Preliminary Report on Patentability issued in PCT/JP2009/071568.
Nov. 15, 2011 (PCT) International Preliminary Report on Patentability issued in PCT/JP2010/050253.
Nov. 15, 2011 (PCT) International Preliminary Report on Patentability issued in PCT/JP2010/055324.
Nov. 15, 2011 (PCT) International Preliminary Report on Patentability issued in PCT/JP2010/055326.
Mar. 9, 2012 (US) Office Action issued in U.S. Appl. No. 12/732,257.
Mar. 27, 2012 (JP) Office Action issued in Japanese Patent Application No. 2008-331638.
Mar. 27, 2012 (JP) Office Action issued in Japanese Patent Application No. 2009-156405.
Mar. 27, 2012 (JP) Office Action issued in Japanese Patent Application No. 2009-156406.
Mar. 27, 2012 (JP) Office Action issued in Japanese Patent Application No. 2009-156407.
Mar. 27, 2012 (JP) Office Action issued in Japanese Patent Application No. 2009-270221.
Apr. 11, 2012 (PCT) International Preliminary Report on Patentability issued in PCT/JP2010/055310.
May 8, 2012 (JP) Office Action issued in Japanese Patent Application No. 2009-086239.
Jun. 12, 2012 (JP) Office Action issued in Japanese Patent Application No. 2009-086222.
Jun. 12, 2012 (JP) Office Action issued in Japanese Patent Application No. 2010-084499.
Jul. 3, 2012 (JP) Office Action issued in Japanese Patent Application No. 2010-084501.
Jul. 3, 2012 (JP) Office Action issued in Japanese Patent Application No. 2010-084502.
Aug. 14, 2012 (PCT) International Preliminary Report on Patentability issued in PCT/JP20091071812.
Aug. 28, 2012 (US) Office Action in U.S. Appl. No. 12/732,257.
Sep. 11, 2012 (JP) Office Action issued in Japanese Patent Application No. 2009-086172.
Sep. 11, 2012 (JP) Office Action issued in Japanese Patent Application No. 2009-088449.
Nov. 13, 2012 (JP) Office Action issued in Japanese Patent Application No. 2009-297502.
Nov. 22, 2013 (EP) Office Action issued in European Patent Application No. 10711776.4.
Nov. 26, 2013 (JP) Office Action issued in Japanese Patent Application No. 2011-507142.
Jan. 29, 2013 (JP) Office Action issued in Japanese Patent Application No. 2011-506968.
Mar. 8, 2013 (CN) Office Action issued in Chinese Patent Application No. 200980158165.9.
Apr. 2, 2013 (JP) Office Action issued in Japanese Patent Application No. 2009-156399.
Apr. 2, 2013 (JP) Office Action issued in Japanese Patent Application No. 2009-156404.
Apr. 2, 2013 (JP) Office Action issued in Japanese Patent Application No. 2009-156281.
Apr. 2, 2013 (JP) Office Action issued in Japanese Patent Application No. 2009-156350.
Apr. 2, 2013 (JP) Office Action issued in Japanese Patent Application No. 2009-156355.
Apr. 2, 2013 (JP) Office Action issued in Japanese Patent Application No. 2009-156357.
Apr. 2, 2013 (JP) Office Action issued in Japanese Patent Application No. 2009-156371.
Apr. 2, 2013 (JP) Office Action issued in Japanese Patent Application No. 2009-156398.
Apr. 2, 2013 (JP) Office Action issued in Japanese Patent Application No. 2009-156403.
Apr. 2, 2013 (JP) Office Action issued in Japanese Patent Application No. 2009-270325.

(56) References Cited

OTHER PUBLICATIONS

Apr. 8, 2013 (EP) European Search Report issued in European Patent Application No. 098522782.
Apr. 15, 2013 (CN) Office Action issued in Chinese Patent Application No. 201080013099.9.
Apr. 19, 2013 (CN) Office Action issued in Chinese Patent Application No. 200910262678.6.
Apr. 23, 2013 (JP) Office Action issued in Japanese Patent Application No. 2010-73748.
Apr. 23, 2013 (JP) Office Action issued in Japanese Patent Application No. 2010-73750.
May 2, 2013 (CN) Office Action issued in Chinese Patent Application No. 200910262677.1.
May 2, 2013 (CN) Office Action issued in Chinese Patent Application No. 200910262679.0.
May 2, 2013 (CN) Office Action issued in Chinese Patent Application No. 200910262680.3.
May 14, 2013 (JP) Office Action issued in Japanese Patent Application No. 2010-073747.
May 21, 2013 (JP) Office Action issued in Japanese Patent Application No. 2010-073749.
May 21, 2013 (JP) Office Action issued in Japanese Patent Application No. 2010-073755.
May 21, 2013 (US) Office Action in U.S. Appl. No. 12/732,257.
May 28, 2013 (JP) Office Action issued in Japanese Patent Application No. 2010-073751.
Jun. 4, 2013 (CN) Office Action issued in Chinese Patent Application No. 200980161443.6.
Jun. 4, 2013 (JP) Office Action issued in Japanese Patent Application No. 2010-073754.
Jul. 2, 2013 (JP) Office Action issued in Japanese Patent Application No. 2009-156281.
Jul. 2, 2013 (JP) Office Action issued in Japanese Patent Application No. 2009-156350.
Jul. 10, 2013 (NZ) (Office Action issued in New Zealand Patent Application No. 596044.
Aug. 7, 2013 (CN) Office Action issued in Chinese Patent Application No. 200910262675.2.
Aug. 22, 2013 (CN) Office Action issued in Chinese Patent Application No. 201080013339.5.
Sep. 3, 2013 (CN) Office Action issued in Chinese Patent Application No. 201010150928.X.
Sep. 3, 2013 (JP) Office Action issued in Japanese Patent Application No. 2011507143.
Sep. 22, 2013 (CN) Office Action issued in Chinese Patent Application No. 201010150109.5.
Sep. 25, 2013 (NZ) Office Action issued in New Zealand Patent Application No. 596044.
Sep. 26, 2013 (CN) Office Action issued in Chinese Patent Application No. 201010150090.4.
Sep. 30, 2013 (CN) Office Action issued in Chinese Patent Application No. 201010150088.7.
Oct. 1, 2013 (JP) Office Action issued in Japanese Patent Application No. 2011547222.
Oct. 28, 2013 (CN) Office Action issued in Chinese Patent Application No. 200980158165.9.
Nov. 1, 2013 (CN) Office Action Issued in Chinese Patent Application No. 200980161405.0.
Nov. 6, 2013 (EP) European Search Report issued in European Patent Application No. 09842716.4.
Nov. 8, 2013 (NZ) Office Action issued in New Zealand Patent Application No. 596044.
Nov. 12, 2013 (EP) European Search Report issued in European Patent Application No. 10758310.6.
Nov. 13, 2013 (US) Office Action issued in corresponding U.S. Appl. No. 13/240,216.
Dec. 3, 2013 (JP) Office Action issued in Japanese Patent Application No. 2011-507049.
Dec. 16, 2013 (EP) Extended European Search Report in European Patent Application No. 12160324.5.
Dec. 18, 2013 (EP) Extended European Search Report in European Patent Application No. 12160192.6.
Dec. 19, 2013 (CN) Office Action issued in Chinese Patent Application No. 200910262674.8.
Dec. 20, 2013 (EP) Extended European Search Report issued in European Patent Application No. 12161271.7.
Dec. 23, 2013 (US) Final Office Action issued in U.S. Appl. No. 13/431,350.
Dec. 30, 2013 (CN) Office Action issued in Chinese Application No. 201010209208.6.
Dec. 30, 2013 (CN) Office Action issued in Chinese Patent Application No. 201210070147.9.
Aug. 12, 2014—(CN) Notice of Second Office Action—App 201210071810.7—Eng Tran.
Aug. 26, 2014—(CN) Notice of Second Office Action—App 201010274378.2—Eng Tran.
Aug. 28, 2014—(US) Non-Final Office Action—U.S. Appl. No. 13/240,216.
Dec. 1, 2014—(US) Non-Final Office Action—U.S. Appl. No. 14/226,289.
Dec. 5, 2014—(US) Non-Final Office Action—U.S. Appl. No. 14/226,325.
Dec. 16, 2014—(US) Non-Final Office Action—U.S. Appl. No. 14/226,259.
Dec. 16, 2014—(US) Notice of Allowance—U.S. Appl. No. 13/240,216.
Dec. 26, 2014—(CN) Office Action in Application No. 201080013339.5.
Feb. 4, 2014 (US) Notice of Allowance issued in U.S. Appl. No. 12/732,404.
Feb. 19, 2014 (US) Notice of Allowance issued in U.S. Appl. No. 12/732,747.
Feb. 24, 2014 (US) Notice of Allowance issued in U.S. Appl. No. 12/644,451.
Jan. 3, 2014 (AU) Office Action issued in Australian Patent Application No. 2010231426.
Jan. 27, 2014 (US) Notice of Allowance issued in U.S. Appl. No. 12/732,828.
Jul. 7, 2014 (US) Final Office Action issued in U.S. Appl. No. 13/430,080.
Jul. 8, 2014 (CA) Office Action issued in Canadian Patent Application No. 2,755,882.
Jul. 8, 2014 (JP) Office Action issued in Japanese Patent Application No. 2013-153421.
Jul. 8, 2014 (JP) Office Action issued in Japanese Patent Application No. 2013-153495.
Jul. 18, 2014 (US) Office Action in U.S. Appl. No. 13/431,350.
Jul. 22, 2014 (US) Office Action in U.S. Appl. No. 12/732,257.
Jul. 25, 2014—(CN) Notice of Second Office Action—App 201010150090.4—Eng Tran.
Jul. 28, 2014—(CN) Notice of Second Office Action—App 201010150088.7—Eng Tran.
Jun. 26, 2014—(CN) Office Action—App 200980161405.
Jun. 27, 2014 (AU) Office Action issued in Australian Patent Application No. 2010231426.
Nov. 4, 2014—(US) Non-Final Office Action—U.S. Appl. No. 14/226,367.
Nov. 4, 2014—(US) Non-Final Office Action—U.S. Appl. No. 14/226,428.
Nov. 5, 2014—(US) Non-Final Office Action—U.S. Appl. No. 14/226,373.
Nov. 12, 2014 (MX) Office Action in Application No. MX/a/2011/013553.
Nov. 25, 2014—(US) Notice of Allowance—U.S. Appl. No. 13/934,512.
Oct. 2, 2014—(US) Non-Final Office Action—U.S. Appl. No. 13/430,033.
Oct. 10, 2014—(US) Notice of Allowance—U.S. Appl. No. 12/732,457.
Oct. 27, 2014—(US) Non-Final Office Action—U.S. Appl. No. 14/141,576.
Oct. 30, 2014 (US) Final Office Action App—U.S. Appl. No. 14/226,256.

(56) References Cited

OTHER PUBLICATIONS

Sep. 2, 2014—(US) Non-Final Office Action—U.S. Appl. No. 14/226,165.
Sep. 9, 2014—(US) Non-Final Office Action—U.S. Appl. No. 14/226,380.
Sep. 9, 2014—(US) Non-Final Office Action—U.S. Appl. No. 14/226,417.
Sep. 10, 2014—(US) Notice of Allowance—U.S. Appl. No. 13/934,512.
Sep. 11, 2014—(US) Non-Final Office Action—U.S. Appl. No. 13/848,750.
Sep. 12, 2014—(US) Final Office Action—U.S. Appl. No. 13/431,371.
Sep. 12, 2014—(US) Non-Final Office Action—U.S. Appl. No. 14/226,386.
Sep. 22, 2014—(US) Non-Final Office Action—U.S. Appl. No. 14/141,673.
Sep. 24, 2014—(JP) Notification of Rejection—App 2013-142488—Eng Tran.
Sep. 24, 2014—(US) Notice of Allowance—U.S. Appl. No. 13/431,277.
Sep. 25, 2014—(US) Non-Final Office Action—U.S. Appl. No. 14/226,424.
Jan. 17, 2014 (CN) Office Action issued in Chinese Patent Application No. 201210071810.7.
Jan. 22, 2014 (CN) Office Action issued in Chinese Patent Application No. 201010274378.2.
Feb. 5, 2014 (EP) Extended European Search Report issued in European Patent Application No. 09852818.5.
Mar. 10, 2014 (US) Non-Final Office Action issued in U.S. Appl. No. 13/430,080.
Mar. 13, 2014 (CN) Office Action issued in Chinese Application No. 201010150928.
Mar. 25, 2014 (US) Non-Final Office Action issued in U.S. Appl. No. 13/431,371.
Mar. 26, 2014 (US) Final Office Action issued in U.S. Appl. No. 12/732,457.
Mar. 27, 2014 (US) Notice of Allowance issued in U.S. Appl. No. 13/240,266.
Apr. 1, 2014 (JP) Office Action issued in Japanese Patent Application No. 2013-035990.
Apr. 2, 2014 (CN) Office Action issued in Chinese Patent Application No. 201210070968.
Apr. 10, 2014 (CN) Office Action issued in Chinese Application No. 201010150109.
Apr. 11, 2014 (US) Notice of Allowance issued in U.S. Appl. No. 12/644,572.
Apr. 15, 2014 (AU) Office Action issued in Australian Patent Application No. 2009332345.
Apr. 17, 2014 (RU) Office Action issued in Russian Patent Application No. 2011143817.
Apr. 25, 2014 (MX) Mexican Office Action issued in Mexican Application No. MX/a/20111013553.
May 6, 2014 (CN) Chinese Office Action issued in Chinese Application No. 201010150087.2.
May 6, 2014 (CN) Chinese Office Action issued in Chinese Application No. 201010150878.5.
May 6, 2014 (US) Notice of Allowance issued in U.S. Appl. No. 13/934,512.
May 7, 2014 (US) Final Office Action issued in U.S. Appl. No. 13/240,216.
May 9, 2014 (VN) Office Action issued in Vietnamese Patent Application No. 1-2011-02491.
May 13, 2014 (CN) Chinese Office Action issued in Chinese Application No. 201080013339.5.
May 21, 2014 (EP) Extended European Search Report issued in European Application No. 107585523.
May 22, 2014 (US) Non-Final Office Action issued in U.S. Appl. No. 14/226,256.
Jun. 2, 2014 (AU) Office action issued in Australian Patent Application No. 2010231425.
Jun. 10, 2014 (JP) Japanese Office Action issued Japanese Application No. 2013-142488.
Jun. 20, 2014 (CN) Office action issued in Chinese Patent Application No. 201210070147.
Jun. 24, 2014 (JP) Japanese Office Action issued Japanese Application No. 2013-153250.
Jun. 24, 2014 (JP) Japanese Office Action issued Japanese Application No. 2013-153340.
Apr. 1, 2015—(US) Notice of Allowance—U.S. Appl. No. 12/732,457.
Apr. 1, 2015—(US) Notice of Allowance—U.S. Appl. No. 13/430,033.
Apr. 2, 2015 (EP) Office Action in Application No. 10711776.4.
Apr. 7, 2015 (TW) Office Action in Application No. 99132600.
Apr. 9, 2015—(TW) Office Action—App 099132598—Eng. Tran.
Apr. 9, 2015—(US) Non-Final Office Action—U.S. Appl. No. 14/641,681.
Apr. 9, 2015—(US) Notice of Allowance—U.S. Appl. No. 13/431,277.
Apr. 10, 2015—(US) Non-Final Office Action—U.S. Appl. No. 13/430,080.
Apr. 13, 2015—(CN) Notification of Third Office Action—App 201210071810.7—Eng. Tran.
Apr. 14, 2015—(US) Notice of Allowance—U.S. Appl. No. 13/240,266.
Apr. 17, 2015—(US) Final Office Action—U.S. Appl. No. 14/226,367.
Apr. 20, 2015 (AU) Office Action in Application No. 2010231426.
Apr. 21, 2015—(US) Final Office Action—U.S. Appl. No. 14/226,428.
Aug. 4, 2015—(US) Notice of Allowance—U.S. Appl. No. 14/141,576.
Aug. 6, 2015—(CN) Office Action—App 201410046812.X—Eng Tran.
Aug. 11, 2015—(AU) Patent Examination Report 1—App 2014221250.
Aug. 13, 2015—(US) Final Office Action—U.S. Appl. No. 13/431,371.
Aug. 24, 2015—(US) Final Office Action—U.S. Appl. No. 14/226,402.
Dec. 3, 2015—(CN) Office Action—App 201510088644.5.
Dec. 4, 2015—(US) Notice of Allowance—U.S. Appl. No. 14/226,325.
Dec. 10, 2015—(US) Non-Final Office Action—U.S. Appl. No. 14/755,141.
Dec. 11, 2015—(US) Notice of Allowance—U.S. Appl. No. 14/226,165.
Dec. 17, 2015—(US) Non-Final Office Action—U.S. Appl. No. 14/920,398.
Dec. 21, 2015—(US) Notice of Allowance—U.S. Appl. No. 13/934,512.
Dec. 23, 2015—(US) Final Office Action—U.S. Appl. No. 14/226,417.
Dec. 24, 2015—(TW) Decision of Rejection—App 101110368—Eng Tran.
Dec. 24, 2015—(US) Non-Final Office Action—U.S. Appl. No. 14/226,380.
Feb. 6, 2015—(EP) Extended Search Report—App. 14189221.6.
Feb. 10, 2015—(US) Notice of Allowance—U.S. Appl. No. 14/226,380.
Feb. 12, 2015—(US) Final Office Action—U.S. Appl. No. 12/732,257.
Feb. 12, 2015—(US) Final Office Action—U.S. Appl. No. 13/431,350.
Feb. 12, 2015—(US) Final Office Action—U.S. Appl. No. 14/226,417.
Feb. 13, 2015—(US) Non-Final Office Action—U.S. Appl. No. 13/240,322.
Feb. 17, 2016—(US) Final Office Action—U.S. Appl. No. 14/141,673.
Feb. 19, 2015 (CA) Office Action in Application No. 2755885.

(56) References Cited

OTHER PUBLICATIONS

Jan. 2, 2015—(US) Non-Final Office Action—U.S. Appl. No. 14/226,262.
Jan. 5, 2015—(US) Non-final Office Action—U.S. Appl. No. 14/226,201.
Jan. 16, 2015—(US) Non-Final Office Action—U.S. Appl. No. 14/226,402.
Jan. 20, 2015—(US) Non-Final Office Action—U.S. Appl. No. 13/431,371.
Jan. 22, 2015—(US) Non-Final Office Action—U.S. Appl. No. 14/226,411.
Jan. 22, 2015—(US) Notice of Allowance—U.S. Appl. No. 12/732,457.
Jan. 23, 2015 (AU) Office Action in Application No. 2010231426.
Jan. 28, 2015—(US) Notice of Allowance—U.S. Appl. No. 13/431,277.
Jan. 29, 2015—(TW) Office Action—App 099132599.
Jul. 7, 2015—(US) Notice of Allowance—U.S. Appl. No. 14/141,673.
Jul. 16, 2015—(US) Non-Final Office Action—U.S. Appl. No. 14/226,417.
Jul. 31, 2015—(US) Final Office Action—U.S. Appl. No. 14/226,411.
Jun. 1, 2015—(CN) Notification of First Office Action—App 201310717842.4—Eng Tran.
Jun. 1, 2015 (CN) Notification of First Office Action—App 201310717871.0—Eng Tran.
Jun. 2, 2015—(US) Final Office Action—U.S. Appl. No. 14/226,262.
Jun. 2, 2015—(US) Non-Final Office Action—U.S. Appl. No. 14/226,256.
Jun. 5, 2015—(US) Notice of Allowance—U.S. Appl. No. 14/226,380.
Jun. 17, 2015—(US) Final Office Action—U.S. Appl. No. 14/226,325.
Feb. 12, 2016—(US) Notice of Allowance—U.S. Appl. No. 13/431,277.
Feb. 16, 2016—(US) Non-Final Office Action—U.S. Appl. No. 14/867,877.
Jan. 12, 2016—(US) Notice of Allowance—U.S. Appl. No. 13/431,371.
Jan. 15, 2016—(US) Notice of Allowance—U.S. Appl. No. 12/732,257.
Jan. 29, 2016—(US) Notice of Allowance—U.S. Appl. No. 14/226,411.
Mar. 23, 2015—(US) Notice of Allowance in U.S. Appl. No. 13/934,512.
Feb. 24, 2016—(US) Non-Final Office Action—U.S. Appl. No. 14/226,262.
Feb. 25, 2016—(US) Non-Final Office Action—U.S. Appl. No. 14/141,568.
Feb. 22, 2016—(US) Non-Final Office Action—U.S. Appl. No. 14/226,386.
Feb. 23, 2016—(US) Final Office Action—U.S. Appl. No. 14/226,424.
Mar. 4, 2016—(US) Notice of Allowance—U.S. Appl. No. 14/643,865.
Mar. 15, 2016—(US) Notice of Allowance—U.S. Appl. No. 14/226,367.
Mar. 29, 2016—(US) Notice of Allowance—U.S. Appl. No. 13/431,350.
Mar. 29, 2016—(US) Notice of Allowance—U.S. Appl. No. 14/641,681.
Mar. 31, 2016—(US) Notice of Allowance—U.S. Appl. No. 14/226,411.
Apr. 4, 2016—(US) Notice of Allowance—U.S. Appl. No. 14/226,402.
Apr. 6, 2016—(US) Notice of Allowance—U.S. Appl. No. 12/732,457.
Apr. 6, 2016—(US) Notice of Allowance—U.S. Appl. No. 14/141,673.
Mar. 5, 2010 (PCT) International Search Report in International Application No. PCT/JP2009/007088.
Mar. 16, 2010 (PCT) International Search Report and Written Opinion issued in International Application No. PCT/JP2009/071812.
Mar. 16, 2010 (PCT) International Search Report in International Application No. PCT/JP2010/050253.
Mar. 23, 2010 (PCT) International Search Report in International Application No. PCT/JP2009/070971.
Mar. 23, 2010 (PCT) International Search Report in International Application No. PCT/JP2009/071568.
May 20, 2010 (PCT) International Search Report in International Application No. PCT/JP2009/007085.
May 20, 2010 (PCT) International Search Report in International Application No. PCT/JP2009/007086.
May 20, 2010 (PCT) International Search Report in International Application No. PCT/JP2009/007087.
May 21, 2010 (PCT) International Search Report in International Application No. PCT/JP2009/007089.
May 21, 2010 Extended European Search Report in European Patent Application No. 09180351.
May 21, 2010 Extended European Search Report in European Patent Application No. 09180354.
Jun. 22, 2010 (PCT) International Search Report in International Application No. PCT/JP2010/055305.
Jun. 22, 2010 (PCT) International Search Report in International Application No. PCT/JP2010/055310.
Jun. 22, 2010 (PCT) International Search Report in International Application No. PCT/JP2010/055311.
Jun. 22, 2010 (PCT) International Search Report in International Application No. PCT/JP2010/055324.
Jun. 22, 2010 (PCT) International Search Report in International Application No. PCT/JP2010/055326.
Jun. 28, 2010 (PCT) International Search Report in International Application No. PCT/JP2010/002170.
Jul. 2, 2010 Extended European Search Report in European Patent Application No. 10157994.
Jul. 12, 2010 Extended European Search Report in European Patent Application No. 10158024.
Jul. 30, 2010 (PCT) International Search Report in International Application No. PCT/JP2010/002165.
Jul. 30, 2010 (PCT) International Search Report in International Application No. PCT/JP2010/002169.
Aug. 3, 2010 (PCT) International Search Report in International Application No. PCT/JP2010/002154.
Aug. 3, 2010 (PCT) International Search Report in International Application No. PCT/JP2010/002161.
Aug. 24, 2010 (PCT) International Search Report in International Application No. PCT/JP2010/004076.
Oct. 12, 2010 Extended European Search Report in European Patent Application No. 10155348.
Dec. 3, 2010 Extended European Search Report in European Patent Application No. 10175769.
Oct. 11, 2011 (JP) Office Action issued in Japanese Patent Application No. 2008-331634.
Oct. 11, 2011 (JP) Office Action issued in Japanese Patent Application No. 2009-088227.
Oct. 11, 2011 (JP) Office Action issued in Japanese Patent Application No. 2009-088238.
Oct. 11, 2011 (JP) Office Action issued in Japanese Patent Application No. 2009-088441.
Oct. 11, 2011 (JP) Office Action issued in Japanese Patent Application No. 2009-088460.
Oct. 11, 2011 (JP) Office Action issued in Japanese Patent Application No. 2009-088440.
Nov. 15, 2011 (JP) Office Action issued in Japanese Patent Application No. 2009-088241.
Jan. 12, 2012 (JP) Office Action issued in Japanese Patent Application No. 2009-088456.
Feb. 14, 2012 (PCT) International Preliminary Report on Patentability in International Application No. PCT/JP2010/055305.

(56) References Cited

OTHER PUBLICATIONS

Feb. 14, 2012 (PCT) International Preliminary Report on Patentability in International Application No. PCT/JP2010/055311.
Mar. 7, 2012 (US) Office Action issued in U.S. Appl. No. 12/732,404.
Mar. 8, 2012 (US) Office Action issued in U.S. Appl. No. 12/732,247.
Mar. 26, 2012 (US) Office Action issued in U.S. Appl. No. 12/732,457.
Mar. 27, 2012 (JP) Office Action issued in Japanese Patent Application No. 2008-331639.
Mar. 30, 2012 (US) Office Action issued in U.S. Appl. No. 12/644,451.
Apr. 11, 2012 (US) Office Action in U.S. Appl. No. 12/644,572.
May 10, 2012 (US) Office Action in U.S. Appl. No. 13/431,371.
May 5, 2012 (JP) Japanese Office Action issued in Japanese Patent Application No. 2010-041323.
Jun. 4, 2012 (US) Office Action in U.S. Appl. No. 13/431,350.
Jun. 6, 2012 (US) Office Action in U.S. Appl. No. 12/732,747.
Jun. 8, 2012 (US) Office Action in U.S. Appl. No. 13/431,277.
Jun. 12, 2012 (US) Office Action in U.S. Appl. No. 12/732,828.
Jun. 15, 2012 (US) Office Action in U.S. Appl. No. 12/732,404.
Jul. 3, 2012 (JP) Office Action issued in Japanese Patent Application No. 2010-084500.
Apr. 20, 2016—(US) Non-Final Office Action—U.S. Appl. No. 14/226,325.
Jun. 1, 2016—(US) Non-Final Office Action—U.S. Appl. No. 14/226,259.
Jun. 2, 2016—(US) Non-Final Office Action—U.S. Appl. No. 14/226,165.
Jun. 3, 2016—(US) Final Office Action—U.S. Appl. No. 14/920,398.
Jun. 24, 2016—(US) Notice of Allowance—U.S. Appl. No. 14/226,256.
Jun. 16, 2016—(US) Final Office Action—U.S. Appl. No. 14/226,380.
May 2, 2016—(US) Notice of Allowance—U.S. Appl. No. 12/644,572.
May 3, 2016—(US) Final Office Action—U.S. Appl. No. 14/226,289.
May 17, 2016—(US) Notice of Allowance—U.S. Appl. No. 13/848,750.
May 25, 2016—(US) Notice of Allowance—U.S. Appl. No. 14/755,141.
Jul. 10, 2012 (PCT) International Preliminary Report on Patentability issued in PCT/JP2009/070971.
Jul. 13, 2012 (US) Office Action in U.S. Appl. No. 12/644,413.
Jul. 20, 2012 (US) Office Action in U.S. Appl. No. 12/817,556.
Jul. 30, 2012 (US) Final Office Action in U.S. Appl. No. 12/732,247.
Aug. 3, 2012 (US) Office Action in U.S. Appl. No. 12/644,373.
Aug. 27, 2012 (US) Office Action in U.S. Appl. No. 12/644,572.
Aug. 28, 2012 (US) Office Action in U.S. Appl. No. 12/644,451.
Aug. 28, 2012 (US) Office Action in U.S. Appl. No. 12/732,457.
Aug. 30, 2012 (US) Office Action in U.S. Appl. No. 12/732,647.
Sep. 6, 2012 (EP) European Communication issued in European Patent Application No. 10711477.9.
Sep. 28, 2012 (NZ) Examination Report issued in New Zealand Patent Application No. 596044.
Oct. 16, 2012 (US) Office Action in U.S. Appl. No. 12/873,633.
Oct. 23, 2012 (US) Office Action in U.S. Appl. No. 12/732,404.
Nov. 13, 2012 (JP) Office Action issued in Japanese Patent Application No. 2009-270056.
Dec. 18, 2012 (JP) Office Action issued in Japanese Patent Application No. 2009-156369.
Jan. 17, 2013 (US) Office Action in U.S. Appl. No. 12/732,747.
Jan. 22, 2013 (US) Office Action in U.S. Appl. No. 12/732,247.
Jan. 30, 2013 (US) Office Action in U.S. Appl. No. 13/431,277.
Feb. 28, 2013 (US) Office Action in U.S. Appl. No. 12/817,556.
Mar. 1, 2013 (US) Office Action in U.S. Appl. No. 12/732,647.
Apr. 23, 2013 (US) Office Action in U.S. Appl. No. 13/430,080.
Apr. 26, 2013 (CN)Office Action issued in Chinese Patent Application No. 200910262676.7.
Apr. 26, 2013 (US) Office Action in U.S. Appl. No. 13/755,174.
May 7, 2013 (US) Office Action in U.S. Appl. No. 12/732,404.
May 14, 2013 (US) Office Action in U.S. Appl. No. 13/431,350.
May 14, 2013 (US) Office Action in U.S. Appl. No. 13/431,371.
May 21, 2013 (JP) Office Action issued in Japanese Patent Application No. 2009-154698.
May 21, 2013 (JP) Office Action issued in Japanese Patent Application No. 2009-154699.
May 21, 2013 (US) Office Action in U.S. Appl. No. 12/732,828.
May 22, 2013 (US) Office Action in U.S. Appl. No. 12/644,413.
May 22, 2013 (US) Office Action in U.S. Appl. No. 12/873,633.
May 30, 2013 (US) Office Action in U.S. Appl. No. 12/732,247.
Jun. 19, 2013 (US) Office Action in U.S. Appl. No. 12/644,373.
Jul. 16, 2013 (US) Office Action in U.S. Appl. No. 12/817,556.
Jul. 16, 2013 (US) Office Action issued in U.S. Appl. No. 12/817,556.
Aug. 1, 2013 (US) Office Action in U.S. Appl. No. 12/732,747.
Aug. 9, 2013 (US) Office Action in U.S. Appl. No. 13/431,350.
Aug. 27, 2013 (US) Office Action in U.S. Appl. No. 12/644,451.
Aug. 27, 2013 (US) Office Action in U.S. Appl. No. 12/644,572.
Sep. 9, 2013 (US) Office Action issued in U.S. Appl. 12/732,404.
Sep. 11, 2013 (US) Office Action in U.S. Appl. No. 13/430,080.
Sep. 12, 2013 (US) Office Action in U.S. Appl. No. 12/732,457.
Sep. 12, 2013 (US) Office Action in U.S. Appl. No. 12/732,828.
Sep. 17, 2013 (US) Office Action in U.S. Appl. No. 12/732,647.
Oct. 16, 2013 (US) Non-Final Office Action issued in corresponding U.S. Appl. No. 13/240,266.
Nov. 19, 2013 (US) Office Action issued in corresponding U.S. Appl. No. 13/934,512.
Apr. 19, 2016—(US) Notice of Allowance—U.S. Appl. No. 14/226,417.
Dec. 1, 2016—(US) Notice of Allowance—U.S. Appl. No. 14/226,262.

* cited by examiner

TAPE CASSETTE

CROSS-REFERENCE TO RELATED APPLICATIONS

This application is a Continuation Application of U.S. Ser. No. 12/732,257, filed on Mar. 26, 2010, which claims priority to Japanese Patent Application Nos. 2009-088227, 2009-088238, and 2009-088241, respectively filed on Mar. 31, 2009, 2009-154695 filed on Jun. 30, 2009, and also claims priority to Japanese Patent Application Nos. 2009-269693, 2009-270056, 2009-270163, 2009-270067, 2009-270221, and 2009-270325, respectively filed on Nov. 27, 2009. The disclosure of the foregoing applications is herein incorporated by reference in its entirety.

BACKGROUND

The present disclosure relates to a tape cassette that is detachably installed in a tape printer.

A tape cassette has been known that is structured to be detachably installed in a cassette housing portion of a tape printer. The tape cassette has a box-like shape, and houses a tape that is a print medium and an ink ribbon. In the tape printer, a printhead prints characters such as letters on the tape pulled out from the tape cassette installed in the cassette housing portion.

The tape cassette is inserted into the cassette housing portion that has an opening in the upward direction such that a bottom wall of the tape cassette is opposed to the cassette housing portion. With a known tape cassette and a known tape printer, when the tape cassette is installed, a position of the tape cassette in the vertical direction may be determined by inserting positioning pins provided in the cassette housing portion into pin holes provided in the bottom wall of the tape cassette.

SUMMARY

In the known tape cassette described above, the pin holes are provided in two locations in the vicinity of the periphery of the bottom wall. The positioning pins are provided in two locations in the cassette housing portion of the tape printer, corresponding to the positions of the pin holes. Thus, in the known tape cassette, the locations used for positioning the tape cassette in the vertical direction are separated from a position where the printhead for printing on the tape is to be disposed. Therefore, even when the tape cassette is positioned by inserting the positioning pins into the pin holes, a center position of printing by the printhead and a center position of the tape in a tape width direction may be misaligned. Consequently, a good printing result may not be obtained.

Various embodiments of the broad principles derived herein provide a tape cassette that enables an accurate positioning of the tape cassette when the tape cassette is installed in the tape printer.

The embodiments herein provide a tape cassette that includes a housing, a wound tape, an arm portion, and a first surface. The housing has a top surface, a bottom surface, and a front surface. The front surface extends from the bottom surface toward the top surface in a first direction. The wound tape is mounted within the housing. The arm portion is defined by a section of the front surface and a first wall. The first wall extends from the bottom surface toward the top surface and is spaced from the section of the front surface in a second direction. The second direction is perpendicular to the front surface. The section of the front surface and the first wall form an exit. An opening extends through the housing in the first direction. The opening is defined by the first wall, a second wall, and a connection portion. The first wall and the second wall face each other. The first wall is disposed between the second wall and the front surface in the second direction. The second wall extends from the bottom surface toward the top surface. The connection portion connects upstream ends of the first wall and the second wall in a feed direction of the tape. The feed direction is generally perpendicular to the first direction and the second direction. The first surface is provided in the connection portion. The first surface is disposed between the top surface and the bottom surface in the first direction. The housing has a first indentation extending from the bottom surface to the first surface.

The embodiments herein also provide a tape cassette that includes a housing, a wound tape, an arm portion, and a surface. The housing has a top surface, a bottom surface, and a front surface. The front surface extends from the bottom surface toward the top surface in a first direction. The wound tape is mounted within the housing. The arm portion is defined by a section of the front surface and a first wall. The first wall extends from the bottom surface toward the top surface and is spaced from the section of the front surface in a second direction. The second direction is perpendicular to the front surface. The section of the front surface and the first wall form an exit. An opening extends through the housing in the first direction. The opening is defined by the first wall, a second wall, and a connection portion. The first wall and the second wall face each other. The first wall is disposed between the second wall and the front surface in the second direction. The second wall extends from the bottom surface toward the top surface. The connection portion connects upstream ends of the first wall and the second wall in a feed direction of the tape. The feed direction is generally perpendicular to the first direction and the second direction. The surface is connected to the second wall. The surface is disposed closer to a downstream end of the second wall than to the upstream end of the second wall in the feed direction. The surface is disposed between the top surface and the bottom surface in the first direction. The housing has an indentation extending from the bottom surface to the surface.

BRIEF DESCRIPTION OF THE DRAWINGS

Embodiments of the present disclosure will be described below in detail with reference to the accompanying drawings in which.

DETAILED DESCRIPTION

Figure 1:
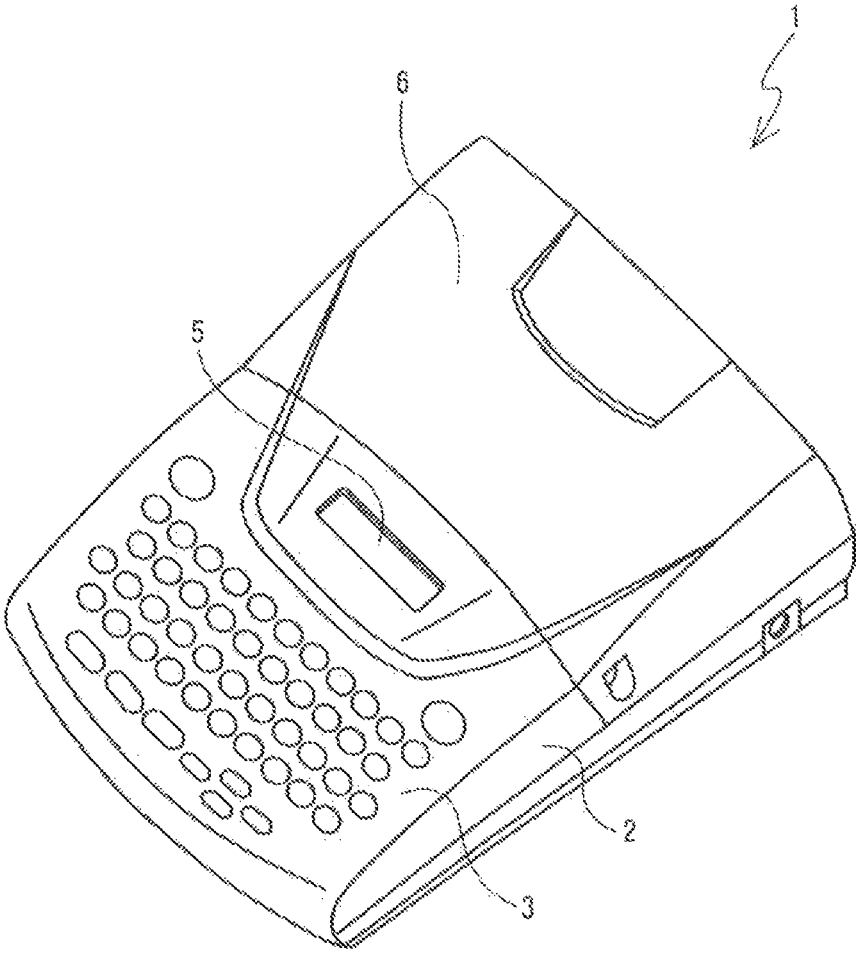
FIG. 1 is a perspective view of a tape printer 1 when a cassette cover 6 is closed, as seen from above.

Embodiments of the present disclosure will be explained below with reference to the figures. The configurations of the apparatus, the flowcharts of various processing and the like shown in the drawings are merely exemplary and do not intend to limit the present disclosure.

First Embodiment

Figure 2:
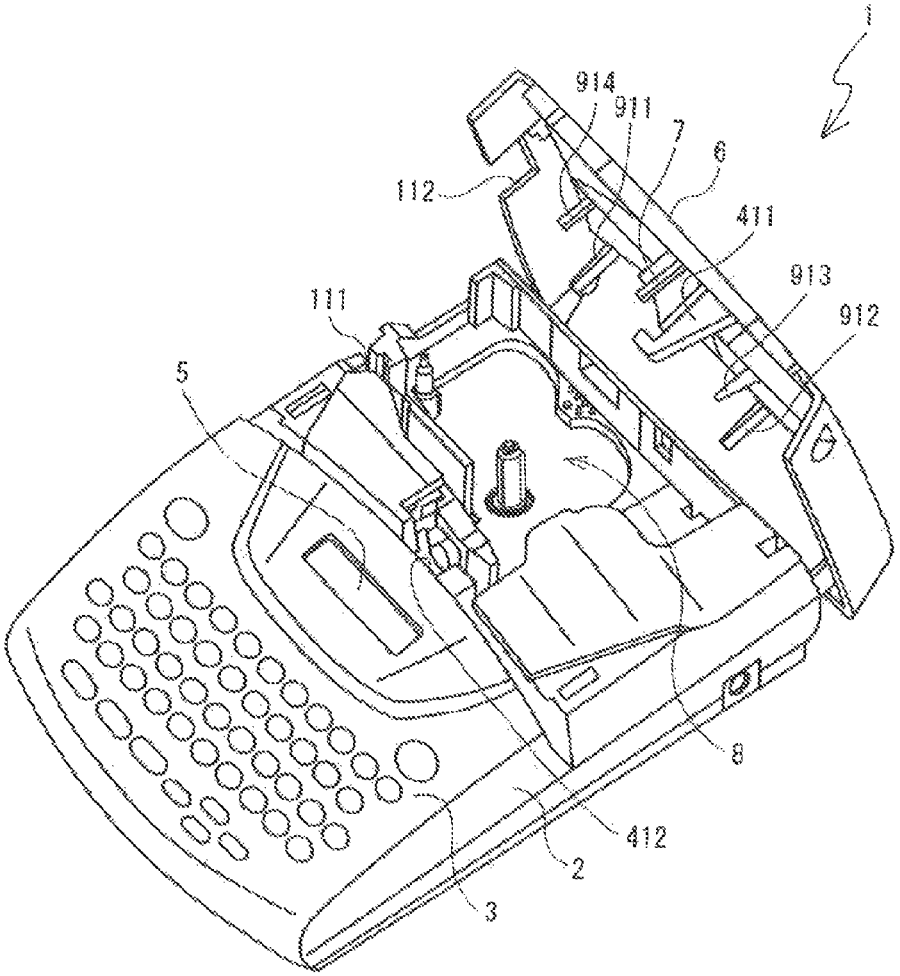
FIG. 2 is a perspective view of the tape printer 1 when the cassette cover 6 is open, as seen from above.
Figure 3:
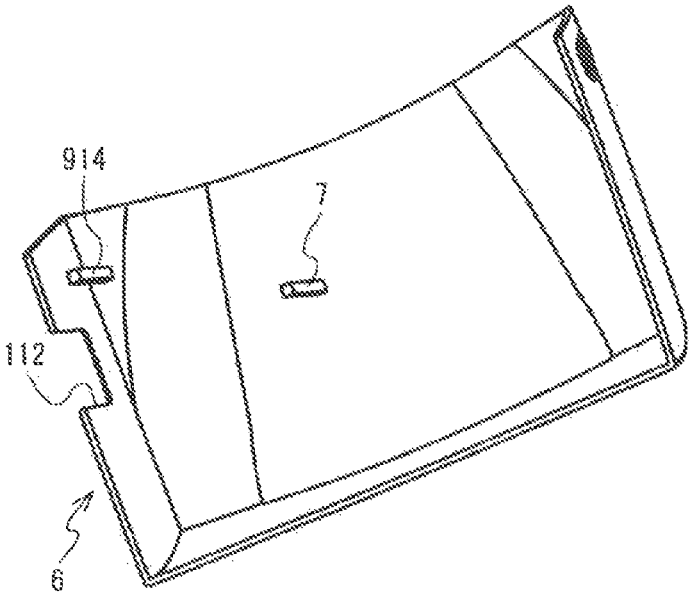
FIG. 3 is a perspective view of the cassette cover 6 with some structural elements omitted, as seen from below.
Figure 4:
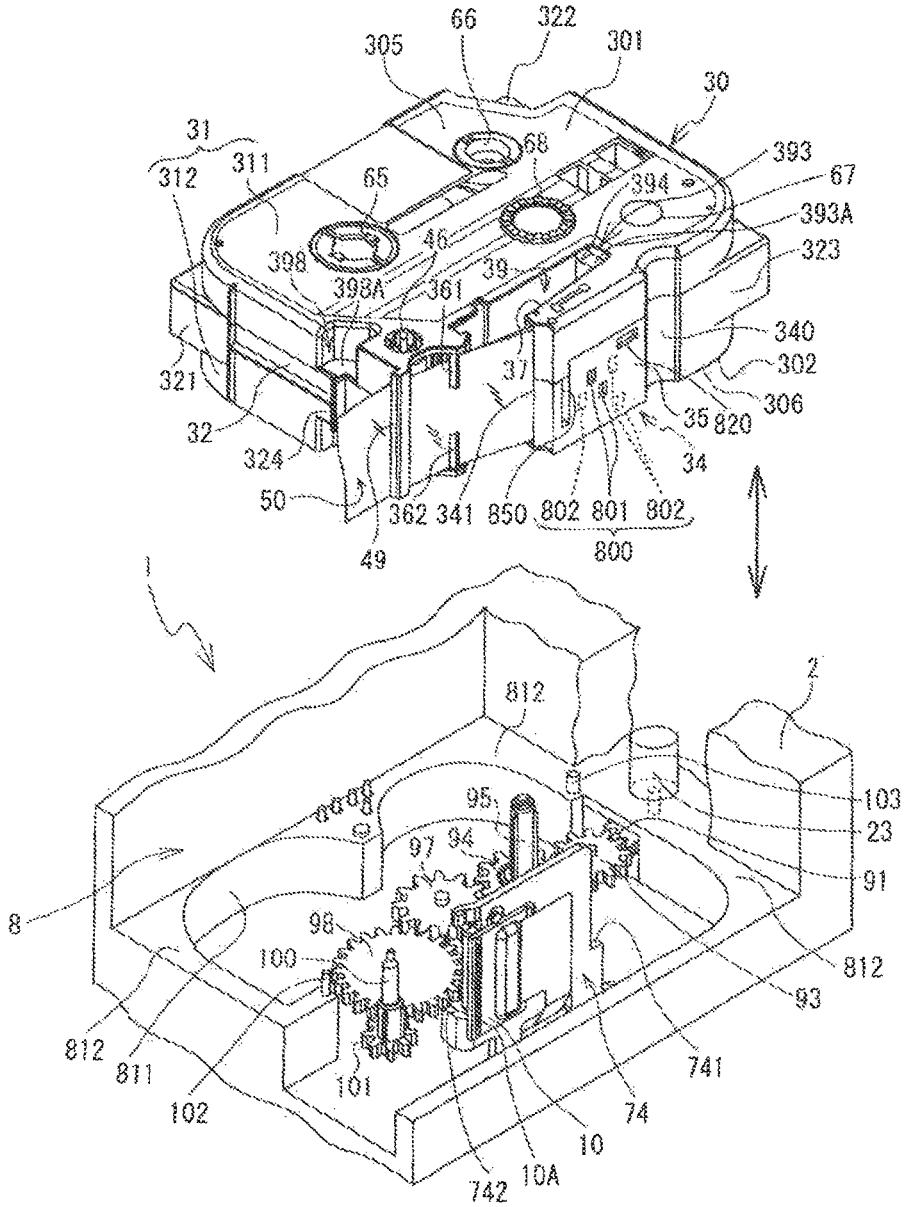
FIG. 4 is a perspective view illustrating a tape cassette 30 and a cassette housing portion 8 according to a first embodiment.

A tape printer 1 and a tape cassette 30 according to a first embodiment will be explained hereinafter with reference to FIG. 1 to FIG. 34. In the explanation of the first embodiment, the lower left side in FIG. 1 and FIG. 2 is the front side of the tape printer 1, and the upper right side in FIG. 1 and FIG. 2 is the rear side of the tape printer 1. The lower right side in FIG. 1 and FIG. 2 is the right side of the tape printer 1, and the upper left side in FIG. 1 and FIG. 2 is the left side of the tape printer 1. In addition, the lower right side in FIG. 4 is the front side of the tape cassette 30 and the upper left side in FIG. 4 is the rear side of the tape cassette 30. The upper right side in FIG. 4 is the right side of the tape cassette 30 and the lower left side in FIG. 4 is the left side of the tape cassette 30.

Note that, in the figures such as FIG. 4 etc. that are used in the following explanation, side walls that form a periphery around a cassette housing portion 8 are shown schematically, but this is simply a schematic diagram, and the side walls shown in FIG. 4, for example, are depicted as thicker than they are in actuality. Note also that, in figures depicting a perspective view of the tape cassette 30 and the cassette housing portion 8, such as FIG. 4, a group of gears, including gears 91, 93, 94, 97, 98 and 101, is in actuality covered and hidden by the bottom surface of a cavity 811. However, for explanatory purposes, the bottom surface of the cavity 811 is not shown in these figures. In FIG. 5 to FIG. 8 etc., the states in which the tape cassette 30 is installed in the cassette housing portion 8 are shown with a top case 311 removed. Moreover, in figures in which the tape cassette 30 is seen from a bottom surface 302 side, such as FIG. 17 etc., a tape drive roller 46 and so on are omitted for explanatory purposes. These comments also apply to figures used in the explanation in other embodiments.

First, an outline configuration of the tape printer 1 will be explained. The tape printer 1 is a general purpose device that commonly uses a variety of types of tape cassette. The types of the tape cassettes may include a thermal type tape cassette, a receptor type tape cassette, a laminated type tape cassette, and a heat-sensitive laminated type cassette. The thermal type cassette is a tape cassette that houses only a heat-sensitive paper tape. The receptor type cassette is a tape cassette that houses a print tape and an ink ribbon. The laminated type cassette is a tape cassette that houses a double-sided adhesive tape, a film tape and an ink ribbon. The heat-sensitive laminated type cassette is a tape cassette that houses a double-sided adhesive tape and a heat-sensitive paper tape.

As shown in FIG. 1, the tape printer 1 is provided with a main unit cover 2 that has a generally parallelepiped shape. A keyboard 3 is provided on the front side of the main unit cover 2. The keyboard 3 includes character keys for characters (letters, symbols, numerals, and so on), a variety of function keys, and so on. A display 5 is provided on the rear side of the keyboard 3. The display 5 displays input characters. A cassette cover 6 is provided on the rear side of the display 5. The cassette cover 6 may be opened and closed when the tape cassette 30 (refer to FIG. 4) is replaced.

The cassette cover 6 is a cover portion that has a generally rectangular shape in a plan view. With respect to both left and right edge portions of the upper rear side of the main unit cover 2, the cassette cover 6 is rotatably supported between an open position shown in FIG. 2 and a closed position shown in FIG. 1. When the cassette cover 6 is in the open position, the cassette housing portion 8 formed inside the main unit cover 2 is exposed. When the cassette cover 6 is in the closed position, the cassette cover 6 covers the cassette housing portion 8. The cassette housing portion 8 is an area in which the tape cassette 30 can be installed or removed. The cassette housing portion 8 is equipped with a feed mechanism, a print mechanism, and the like. The feed mechanism pulls out the tape from the tape cassette 30 and feeds the tape. The print mechanism prints characters on a surface of the tape. These mechanisms will be explained in more detail later.

As shown in FIG. 2, a hook-shaped latching lock 411 that protrudes downward from a lower surface of the cassette cover 6 is provided in a general center of the front edge of the cassette cover 6. The main unit cover 2 is provided with a lock hole 412 in a position corresponding to the latching lock 411, and when the cassette cover 6 is closed as shown in FIG. 1, the latching lock 411 engages with the lock hole 412, thus preventing spontaneous opening of the cassette cover 6. In addition, the lower surface of the cassette cover 6 is further provided with a prismatic head pressing member 7 and periphery pressing members 911 to 914 that protrude from the lower surface in the downward direction.

The head pressing member 7 and the periphery pressing member 914 will be explained with reference to FIG. 3. In FIG. 3, member other than the head pressing member 7 and the periphery pressing members 914, such as the latching lock 411 and the periphery pressing members 911 to 913, are omitted for explanatory purposes. The head pressing member 7 protrudes downward from the lower surface of the cassette cover 6 in a general center in the left-and-right direction. When the tape cassette 30 is installed in the cassette housing portion 8 and the cassette cover 6 is closed, the head pressing member 7 contacts from above a first press receiving portion 393 (refer to FIG. 4) that is provided on a top case 311 of the tape cassette 30 and presses the first press receiving portion 393. The periphery pressing member 914 protrudes downward from the lower surface of the cassette cover 6 in the vicinity of its left edge. When the tape cassette 30 is installed in the cassette housing portion 8 and the cassette cover 6 is closed, the periphery pressing member 914 contacts from above with second press receiving portion 398 (refer to FIG. 4) provided on the top case 311 of the tape cassette 30. The first and second press receiving portions 393 and 398 will be explained in more detail later.

When the tape cassette 30 is installed in the cassette housing portion 8 and the cassette cover 6 is closed. The periphery pressing members 911 to 913 contact from above with a peripheral portion of the tape cassette 30, more specifically, with three locations on the upper surface of first to third corner portions 321 to 343 (refer to FIG. 4). The periphery pressing members 911 to 913 press the first to third corner portions.

Further, a discharge slit 111 is provided to the rear of the left side of the main unit cover 2, from which the printed tape is discharged to the outside. Also, a discharge window 112 is formed on the left side of the cassette cover 6, such that, when the cassette cover 6 is in a closed state, the discharge slit 111 is exposed to the outside.

Next, an internal configuration within the main unit cover 2 below the cassette cover 6 will be explained with reference to FIG. 4 to FIG. 14. As shown in FIG. 4, the cassette housing portion 8 includes the cavity 811 and a corner support portion 812. The cavity 811 is formed as a depression that has a flat bottom surface, and the shape of the cavity 811 generally corresponds to the shape of the bottom surface 302 of a cassette case 31 (to be described later) when the tape cassette 30 is installed. The corner support portion 812 is a flat portion extending horizontally from the outer edge of the cavity 811. When the tape cassette 30 is installed in the cassette housing portion 8, the corner support portion 812 faces and supports the lower surface of the peripheral portion of the tape cassette 30, more specifically, the lower surfaces of the first to fourth corner portions 321 to 324 (refer to FIG. 4).

Two positioning pins 102 and 103 are provided at two positions on the corner support portion 812. More specifically, the positioning pin 102 is provided on the left side of the cavity 811 and the positioning pin 103 is provided on the right side of the cavity 811. The positioning pins 102 and 103 are provided at the positions that respectively face pin holes 62 and 63 (refer to FIG. 21), when the tape cassette 30 is installed in the cassette housing portion 8. The pin holes 62 and 63 are two indentations formed in the bottom case 312. When the tape cassette 30 is installed in the cassette housing portion 8, the positioning pins 102 and 103 are respectively inserted into the pin holes 62 and 63 to position the tape cassette 30 in the back-and-forth direction and the left-and-right direction at the left and right positions of the peripheral portion of the tape cassette 30.

As shown in FIG. 4, a head holder 74 is fixed in the front part of the cassette housing portion 8, and a thermal head 10, which is a printhead, is mounted on the head holder 74. The thermal head 10 includes a row of heating elements 10A (hereinafter referred to as a heating element row). The heating element row 10A includes a plurality of heating elements arranged in a row in the vertical direction. A tape feed motor 23, which is a stepping motor, is provided outside of the cassette housing portion 8 (the upper right side in FIG. 4). The drive gear 91 is anchored to the lower end of a drive shaft of the tape feed motor 23. The drive gear 91 is meshed with the gear 93 through an opening, and the gear 93 is meshed with the gear 94.

A ribbon take-up shaft 95 is provided standing upward on the upper surface of the gear 94. The ribbon take-up shaft 95 drives the rotation of a ribbon take-up spool 44, which will be described later (refer to FIG. 5). In addition, the gear 94 is meshed with the gear 97, the gear 97 is meshed with the gear 98, and the gear 98 is meshed with the gear 101. A tape drive shaft 100 is standing upward on the upper surface of the gear 101. The tape drive shaft 100 drives the rotation of the tape drive roller 46, which will be described later.

If the tape feed motor 23 is driven to rotate in the counterclockwise direction in a state where the tape cassette 30 is installed in the cassette housing portion 8, the ribbon take-up shaft 95 is driven to rotate in the counterclockwise direction via the drive gear 91, the gear 93 and the gear 94. The ribbon take-up shaft 95 causes the ribbon take-up spool 44, which is fitted with the ribbon take-up shaft 95 by insertion, to rotate. Furthermore, the rotation of the gear 94 is transmitted to the tape drive shaft 100 via the gear 97, the gear 98 and the gear 101, thereby driving the tape drive shaft 100 to rotate in the clockwise direction. The tape drive shaft 100 causes the tape drive roller 46, which is fitted with the tape drive shaft 100 by insertion, to rotate.

As shown in FIG. 5 to FIG. 8, on the front side of the head holder 74, an arm shaped platen holder 12 is pivotably supported around a support shaft 121. A platen roller 15 and a movable feed roller 14 are both rotatably supported on the leading end of the platen holder 12. The platen roller 15 faces the thermal head 10, and may be moved close to and apart from the thermal head 10. The movable feed roller 14 faces the tape drive roller 46 that may be fitted by insertion with the tape drive shaft 100, and may be moved close to and apart from the tape drive roller 46.

A release lever (not shown in the figures), which moves in the left-and-right direction in response to the opening and closing of the cassette cover 6, is coupled to the platen holder 12. When the cassette cover 6 is opened, the release lever moves in the right direction, and the platen holder 12 moves toward the stand-by position shown in FIG. 5. At the stand-by position shown in FIG. 5, the platen holder 12 has moved away from the cassette housing portion 8. Therefore, the tape cassette 30 can be installed into or detached from the cassette housing portion 8 when the platen holder 12 is at the stand-by position. The platen holder 12 is constantly elastically urged to remain in the stand-by position by a spiral spring that is not shown in the figures.

Figure 6:
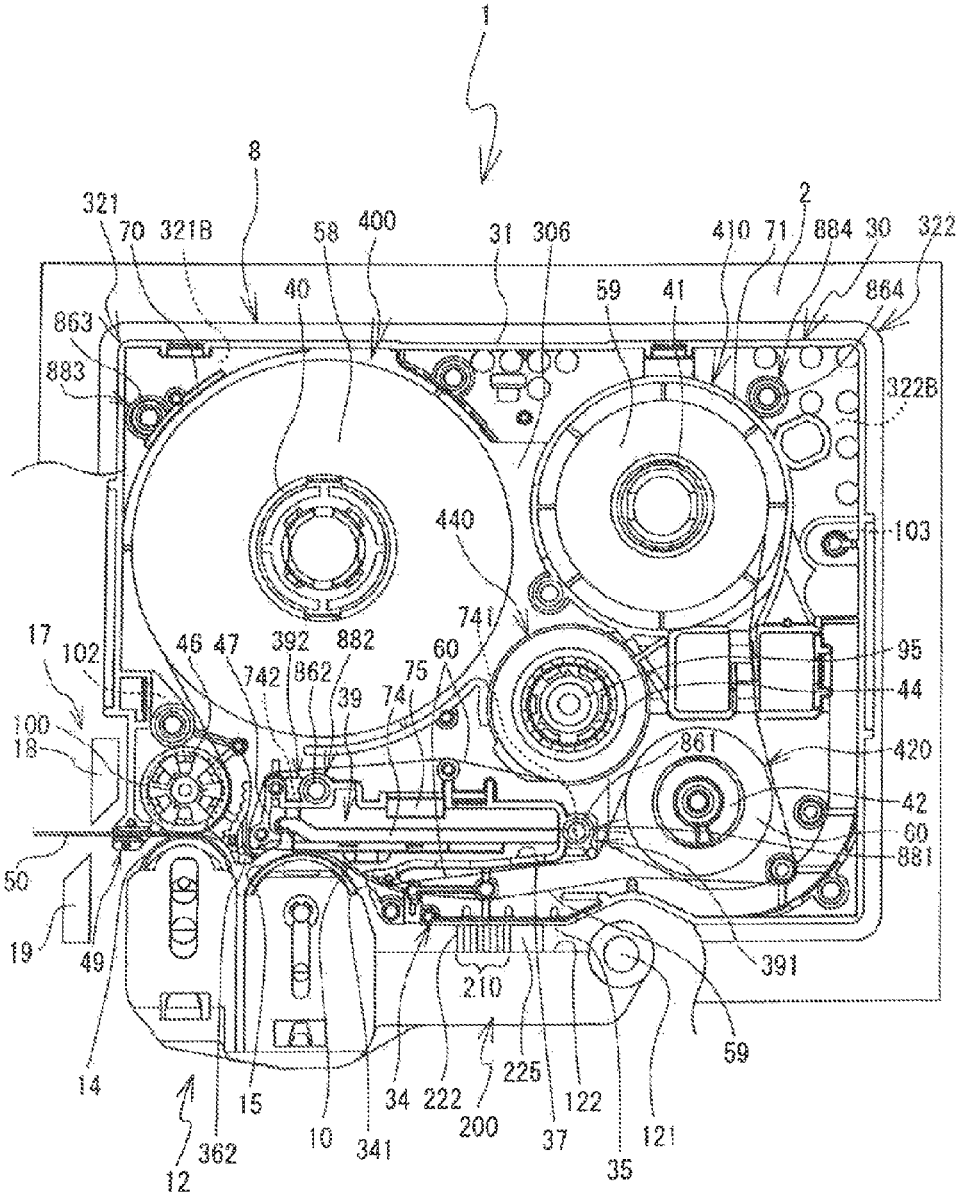
FIG. 6 is a plan view of the cassette housing portion 8 in which is installed the laminate type tape cassette 30, when the platen holder 12 is in a print position.
Figure 7:
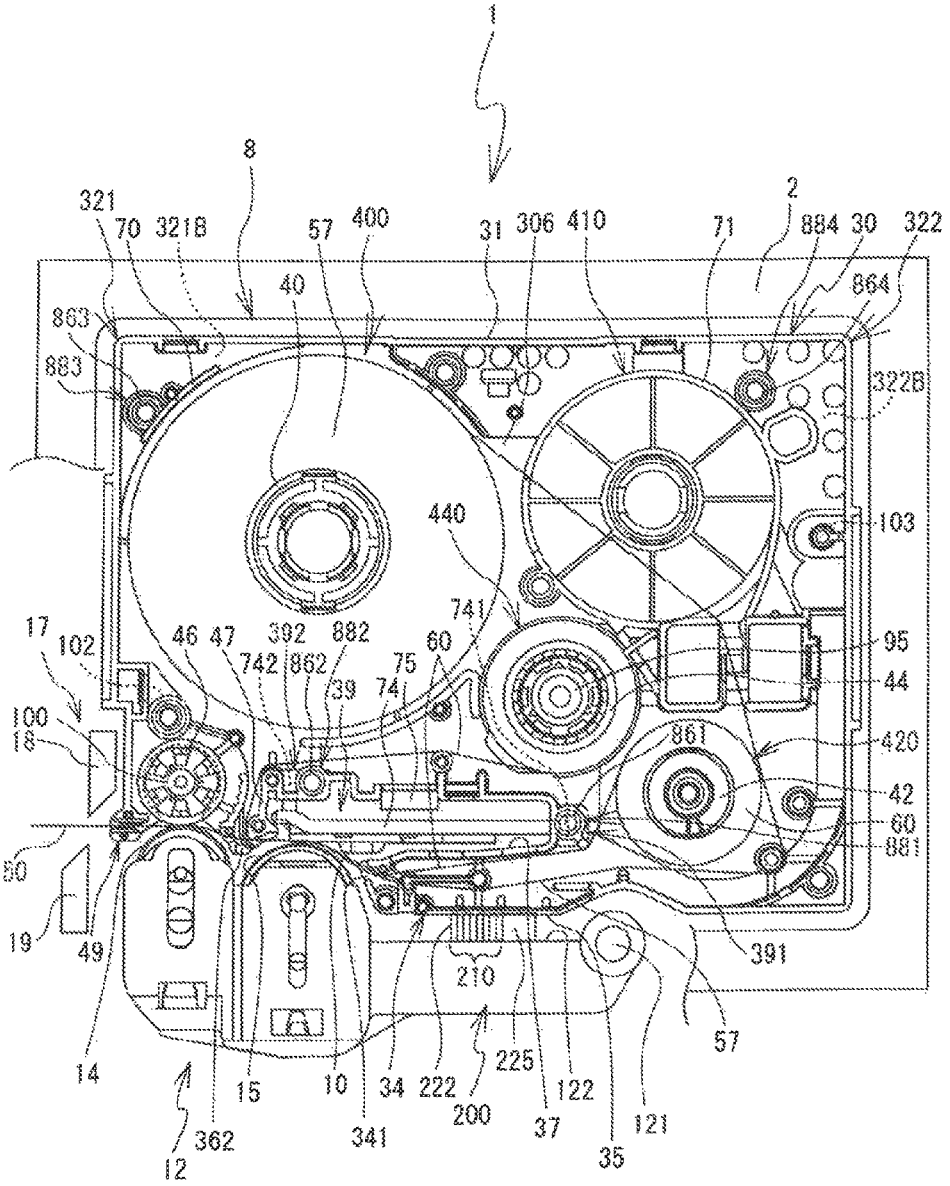
FIG. 7 is a plan view of the cassette housing portion 8 in which is installed a receptor type tape cassette 30, when the platen holder 12 is in the print position.
Figure 8:
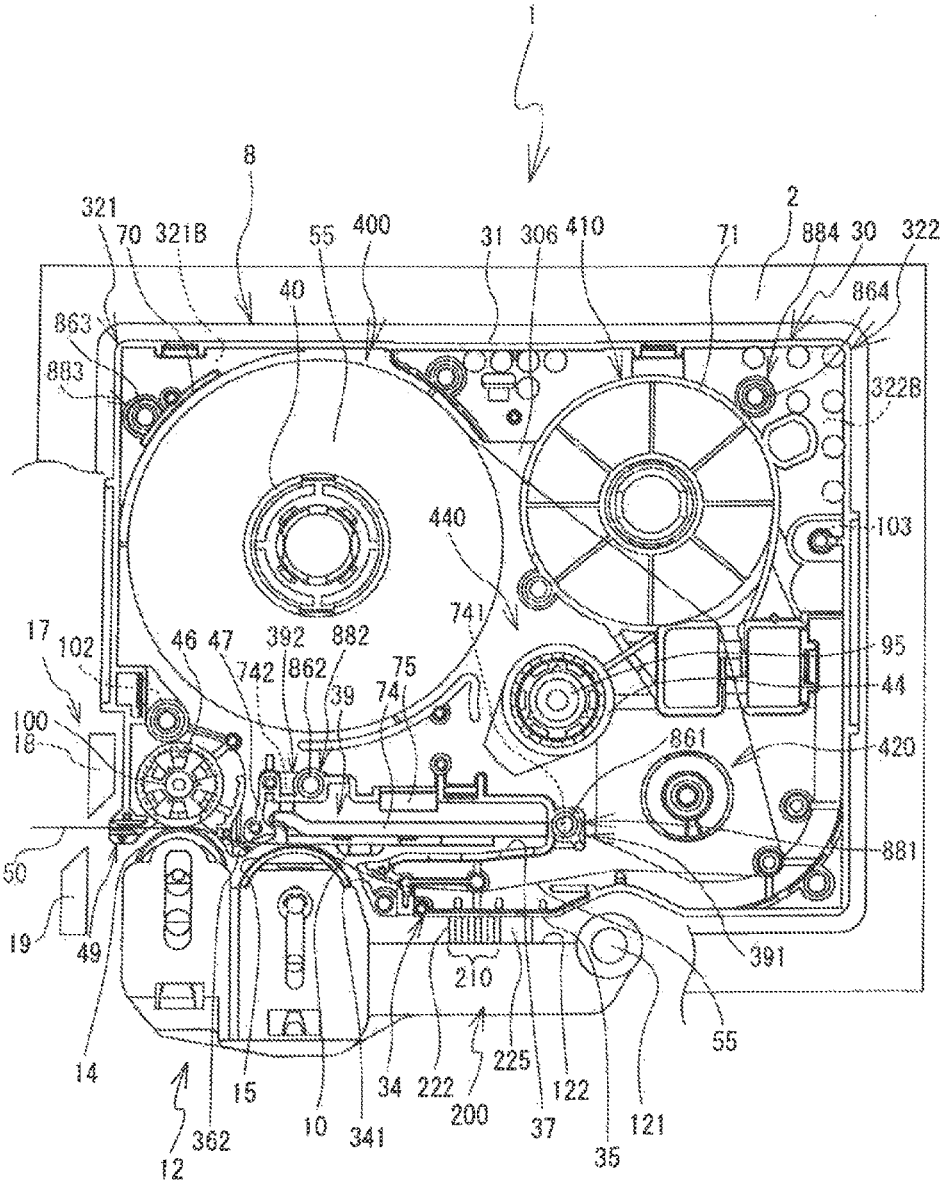
FIG. 8 is a plan view of the cassette housing portion 8 in which is installed a thermal type tape cassette 30, when the platen holder 12 is in the print position.

On the other hand, when the cassette cover 6 is closed, the release lever moves in the left direction and the platen holder 12 moves toward the print position shown in FIG. 6 to FIG. 8. At the print position shown in FIG. 6 to FIG. 8, the platen holder 12 has moved close to the cassette housing portion 8. At the print position, as shown in FIG. 6, when the laminated type tape cassette 30 is installed in the cassette housing portion 8, the platen roller 15 presses the thermal head 10 via a film tape 59 and an ink ribbon 60. At the same time, the movable feed roller 14 presses the tape drive roller 46 via a double-sided adhesive tape 58 and the film tape 59.

In a similar way, as shown in FIG. 7, when the receptor type tape cassette 30 is installed in the cassette housing portion 8, the platen roller 15 presses the thermal head 10 via a print tape 57 and the ink ribbon 60, while the movable feed roller 14 presses the tape drive roller 46 via the print tape 57. Further, as shown in FIG. 8, when the thermal type tape cassette 30 is installed in the cassette housing portion 8, the platen roller 15 presses the thermal head 10 via a heat-sensitive paper tape 55, while the movable feed roller 14 presses the tape drive roller 46 via the heat-sensitive paper tape 55.

As described above, at the print position shown in FIG. 6 to FIG. 8, printing can be performed using a variety of types of the tape cassette 30 installed in the cassette housing portion 8. The heat-sensitive paper tape 55, the print tape 57, the double-sided adhesive tape 58, the film tape 59 and the ink ribbon 60 will be explained in more detail later.

Figure 5:
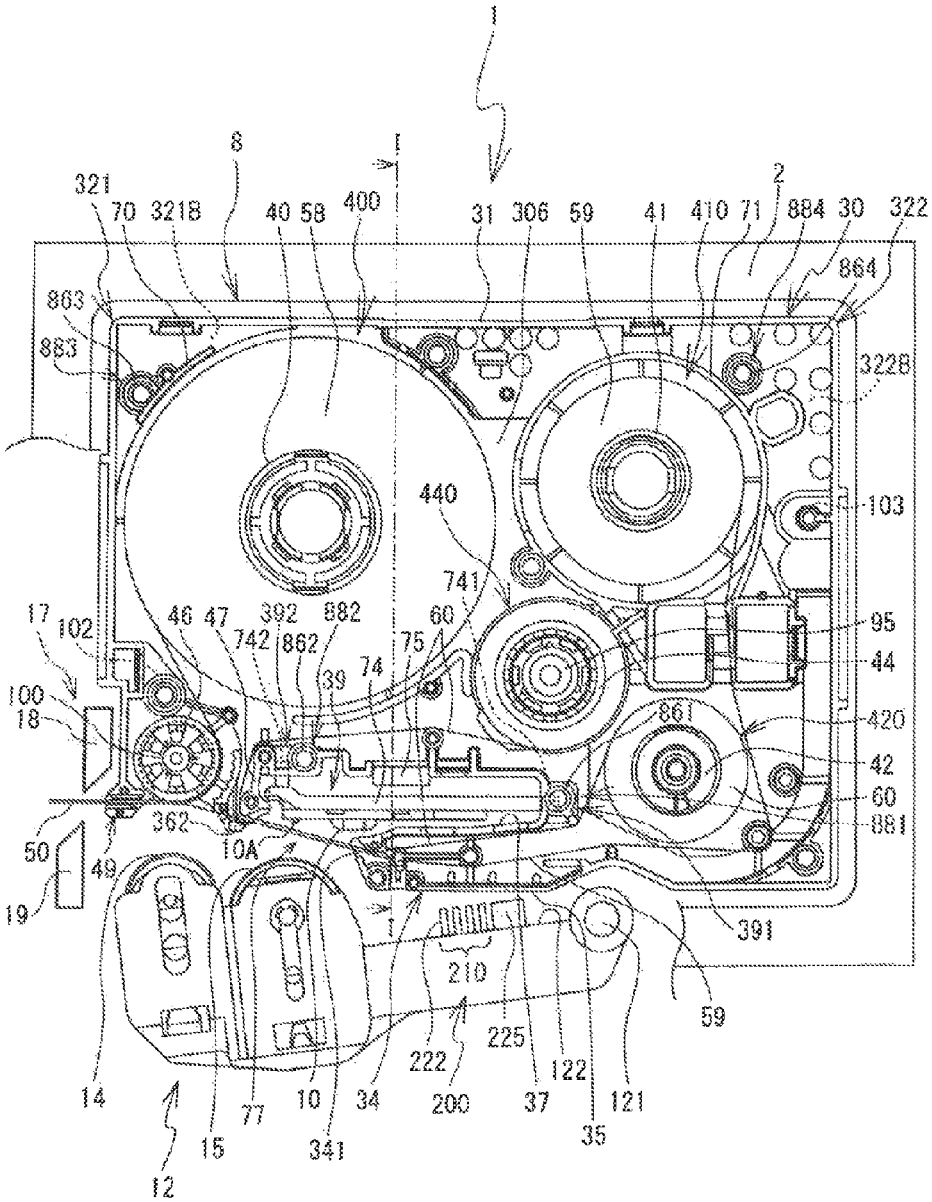
FIG. 5 is a plan view of the cassette housing portion 8 in which is installed a laminate type tape cassette 30, when a platen holder 12 is in a stand-by position.

As shown in FIG. 5, a feed path along which a printed tape 50 is fed extends from a tape discharge portion 49 of the tape cassette 30 to the discharge slit 111 (refer to FIG. 2) of the tape printer 1. A cutting mechanism 17 that cuts the printed tape 50 at a predetermined position is provided on the feed path. The cutting mechanism 17 includes a fixed blade 18 and a movable blade 19. The movable blade 19 faces the fixed blade 18 and is supported such that it can move in the back-and-forth direction (in the up-and-down direction in FIG. 5 to FIG. 8). The movable blade 19 is moved in the back-and-forth direction by a cutter motor 24 (refer to FIG. 15).

Figure 9:
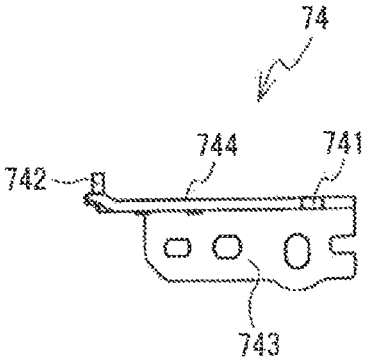
FIG. 9 is a plan view of a head holder 74.
Figure 10:
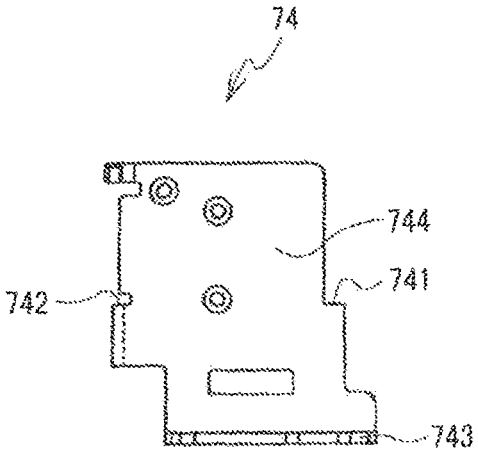
FIG. 10 is a front view of the head holder 74.
Figure 11:
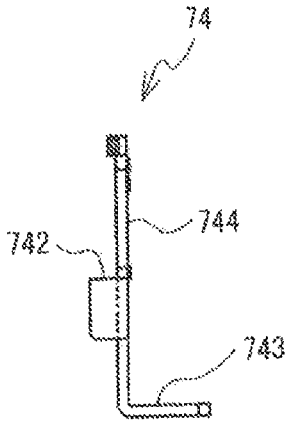
FIG. 11 is a left side view of the head holder 74.

The structure of the head holder 74 will be explained in more detail below with reference to FIG. 5 and FIG. 9 to FIG. 11. As shown in FIG. 9 to FIG. 11, the head holder 74 is formed of a plate-like member, and includes a seat portion 743 and a head fixing portion 744. The seat portion 743 is fixed to the underneath of the bottom surface (not shown in the figures) of the cavity 811. The head fixing portion 744 is a portion that is bent generally perpendicularly from the seat portion 743 and extends in the upward direction. The head fixing portion 744 is positioned along the left-and-right direction of the tape printer 1, as shown in FIG. 5. The head holder 74 is arranged in the cassette housing portion 8 to oppose a head insertion portion 39 when the tape cassette 30 is installed in the cassette housing portion 8. The head insertion portion 39 will be described later. A right end portion of the head holder 74 extends further to the right than a right end of the head insertion portion 39. The thermal head 10 is fixed to a front surface of the head fixing portion 744.

A first supporting portion 741 and a second supporting portion 742 (hereinafter sometimes collectively referred to as cassette supporting portions 741 and 742) are provided on the head fixing portion 744. When the tape cassette 30 is installed in the cassette housing portion 8, the cassette supporting portions 741 and 742 support the tape cassette 30 from underneath. The first supporting portion 741 is a stepped portion that is formed at a predetermined height position by cutting out an L shape in a front view on the right edge portion of the head fixing portion 744. The second supporting portion 742 is an extending piece that has a rectangular shape in a side view. The second supporting portion 742 extends from the left end of the head fixing portion 744 generally perpendicularly with respect to the head fixing portion 744. The second supporting portion 742 is positioned at the same position in the vertical direction, that is, at the same height position, as the first supporting portion 741.

In other words, the first supporting portion 741 and the second supporting portion 742 respectively extend in directions that are generally perpendicular to each other in a plan view. The first supporting portion 741 and the second supporting portion 742 respectively support the tape cassette 30 at the same height position on an upstream side and a downstream side of the thermal head 10 in the tape feed direction. The height positions of the first supporting portion 741 and the second supporting portion 742 are set at positions spaced at a predetermined distance in the vertical direction from a center position of the thermal head 10 (the heating element row 10A) in the vertical direction. Accordingly, the first supporting portion 741 and the second supporting portion 742 serve as reference points to position the tape cassette 30 in the vertical direction with respect to the center position of the thermal head 10 (the heating element row 10A) in the vertical direction. The support of the tape cassette 30 by the cassette supporting portions 741 and 742 will be explained in more detail later.

As shown in FIG. 5 to FIG. 8, an arm detection portion 200 is provided on a rear side surface 122 of the platen holder 12, namely, a surface on the side that faces the thermal head 10. The arm detection portion 200 is provided slightly to the right of a center position in the longitudinal direction of the rear side surface 122. Hereinafter, the rear side surface 122 of the platen holder 12 is referred to as a cassette-facing surface 122. The arm detection portion 200 includes a plurality of detecting switches 210. Switch terminals 222 of the detecting switches 210 respectively protrude from the cassette-facing surface 122 toward the cassette housing portion 8 in a generally horizontal manner.

In other words, the detecting switches 210 protrude in a direction that is generally perpendicular to a direction of insertion and removal (the up-and-down direction in FIG. 4) of the tape cassette 30 with respect to the cassette housing portion 8, such that the detecting switches 210 face the front wall (more specifically, an arm front wall 35 which will be described later) of the tape cassette 30 installed in the cassette housing portion 8. When the tape cassette 30 is installed in the cassette housing portion 8 at a proper position, the detecting switches 210 are respectively positioned at a height facing an arm indicator portion 800, which will be described later (refer to FIG. 4).

Figure 12:
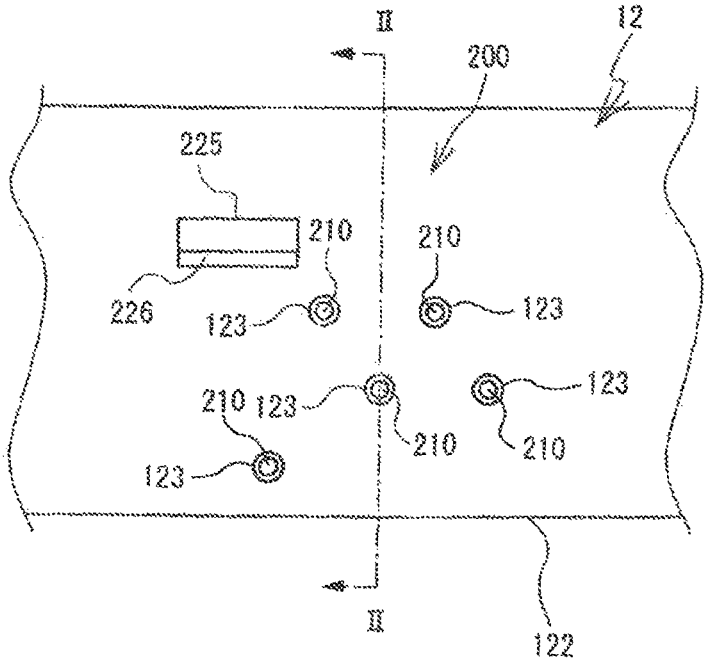
FIG. 12 is a rear view of a cassette-facing surface 122 on which is provided an arm detection portion 200.

The arrangement and structure of the arm detecting switches 210 in the platen holder 12 will be explained in more detail with reference to FIG. 12 and FIG. 13. As shown in FIG. 12, five through-holes 123 are formed in three rows in the vertical direction in the cassette-facing surface 122 of the platen holder 12. More specifically, the through-holes 123 are arranged such that two holes are arranged in an upper row, two holes are arranged in a middle row and one hole is arranged in a lower row. Positions of the through-holes 123 are different from each other in the left-and-right direction. Specifically, the five through-holes 123 are arranged in a zigzag pattern from the right side of the cassette-facing surface 122 (the left side in FIG. 12), in the following order: the lower row, the right side of the upper row, the right side of the middle row, the left side of the upper row and then the left side of the middle row. The five arm detecting switches 210 are provided at positions corresponding to the five through-holes 123.

Figure 13:
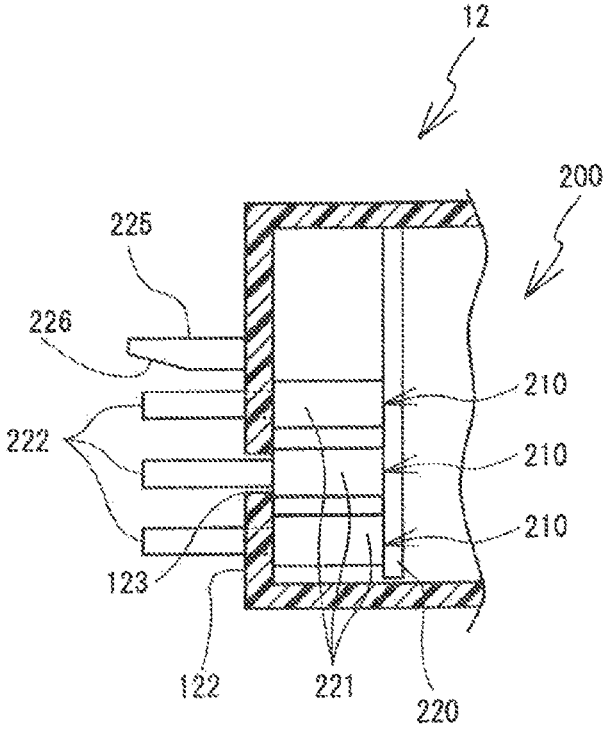
FIG. 13 is a cross-sectional view along a II-II line shown in FIG. 12 as seen in the direction of the arrows.

As shown in FIG. 13, each of the arm detecting switches 210 includes a generally cylindrically shaped main unit 221 and the bar-shaped switch terminal 222. The main unit 221 is positioned inside the platen holder 12. The switch terminal 222 can extend and retract in the direction of an axis line from one end of the main unit 221. The other end of the main unit 221 of the arm detecting switch 210 is attached to a switch support plate 220 and positioned inside the platen holder 12. In addition, on the one end of the main units 221, the switch terminals 222 can respectively extend and retract through the through-holes 123 formed in the cassette-facing surface 122 of the platen holder 12.

Each of the switch terminals 222 is constantly maintained in a state in which the switch terminal 222 extends from the main unit 221 due to a spring member provided inside the main unit 221 (not shown in the figures). When the switch terminal 222 is not pressed, the switch terminal 222 remains extended from the main unit 221 to be in an off state. On the other hand, when the switch terminal 222 is pressed, the switch terminal 222 is pushed back into the main unit 221 to be in an on state.

If the platen holder 12 moves toward the stand-by position (refer to FIG. 5) in a state where the tape cassette 30 is installed in the cassette housing portion 8, the arm detecting switches 210 are separated from the tape cassette 30. Consequently, all the arm detecting switches 210 are in the off state. On the other hand, if the platen holder 12 moves toward the print position (refer to FIG. 6 to FIG. 8), the arm detecting switches 210 face the front wall (more specifically, the arm front wall 35 that will be described later) of the tape cassette 30. Consequently, the arm detecting switches 210 are selectively pressed by the arm indicator portion 800, which will be described later. A tape type is detected based on a combination of the on and off states of the arm detecting switches 210. The detection of the tape type of the tape cassette 30 by the arm detection portion 200 will be explained in more detail later.

As shown in FIG. 5 to FIG. 8, a latching piece 225 is provided on the cassette-facing surface 122 of the platen holder 12. The latching piece 225 is a plate-like protrusion that extends in the left-and-right direction. In a similar way to the switch terminals 222 of the arm detecting switches 210, the latching piece 225 protrudes from the cassette-facing surface 122 in a generally horizontal manner toward the cassette housing portion 8. In other words, the latching piece 225 protrudes such that the latching piece 225 faces the front wall (more specifically, the arm front wall 35) of the tape cassette 30 installed in the cassette housing portion 8. When the tape cassette 30 is installed in the cassette housing portion 8 at the proper position, the latching piece 225 is positioned at a height facing a latching hole 820 (refer to FIG. 4) formed in the arm front wall 35 of the tape cassette 30.

Next, the arrangement and structure of the latching piece 225 on the platen holder 12 will be explained with reference to FIG. 12 and FIG. 13. As shown in FIG. 12, the latching piece 225 is provided on the cassette-facing surface 122 of the platen holder 12, and is positioned above the arm detecting switches 210 in the upper row in the vertical direction. It overlaps with the arm detecting switches 210 in the lower row in the left-and-right direction.

As shown in FIG. 13, the latching piece 225 is integrally formed with the platen holder 12 such that the latching piece 225 protrudes from the cassette-facing surface 122 of the platen holder 12 in the rearward direction (the left side in FIG. 13). A length of protrusion of the latching piece 225 from the cassette-facing surface 122 is generally the same as, or slightly greater than, a length of protrusion of the switch terminals 222 of the arm detecting switches 210 from the cassette-facing surface 122. Furthermore, an inclined portion 226, which is a horizontally inclined part of a lower surface of the latching piece 225, is formed on the latching piece 225 such that the thickness of the latching piece 225 becomes smaller toward the leading end (the left side in FIG. 13).

Figure 14:
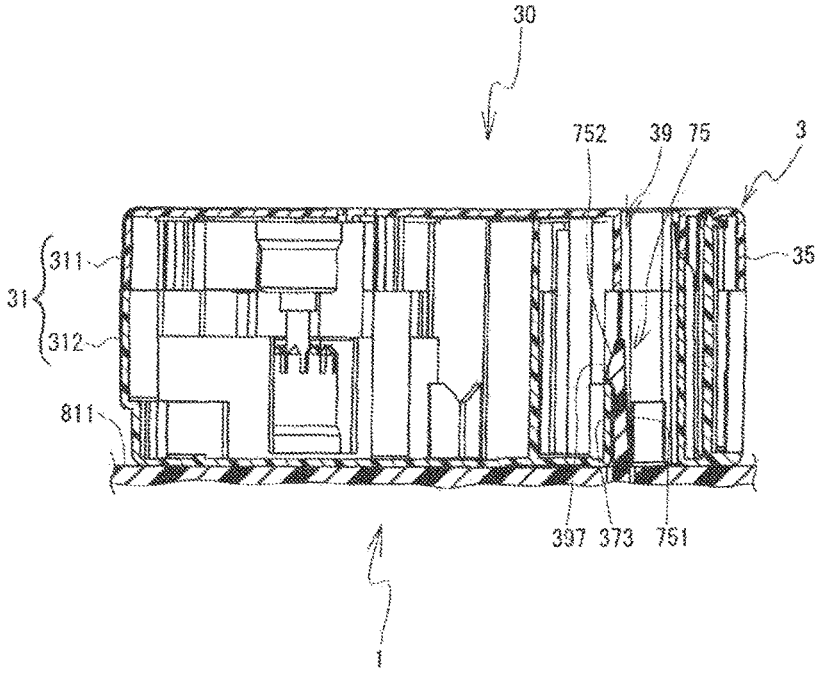
FIG. 14 is a view in which a cross-sectional view along a I-I line shown in FIG. 5 as seen in the direction of the arrows is rotated ninety degrees in a counterclockwise direction.

As shown in FIG. 5 to FIG. 8, a cassette hook 75 is provided on the rear side of the head holder 74. The cassette hook 75 will be explained with reference to FIG. 14. Note that, for ease of explanation, FIG. 14 is a view in which a cross-sectional view along a I-I line shown in FIG. 5 as seen in the direction of the arrows is rotated ninety degrees in a counterclockwise direction.

The cassette hook 75 is provided with a plate-like protruding portion 751 that protrudes generally perpendicularly upward from the bottom surface (not shown in the figures) of the cavity 811. An upper end of the protruding portion 751 is a claw portion 752 that protrudes in the rearward direction (the leftward direction in FIG. 14) and has a generally triangular shape in a cross-sectional view. The protruding portion 751 is flexible in the back-and-forward direction (in the left-and-right direction in FIG. 14) of the tape printer 1. The claw portion 752 is provided corresponding to a height position of a latching portion 397 (to be described later) of the tape cassette 30 from the bottom surface of the cavity 811. When the tape cassette 30 is installed in the cassette housing portion 8, the tape cassette 30 engages with the cassette hook 75. This feature will be explained in more detail later.

Figure 15:
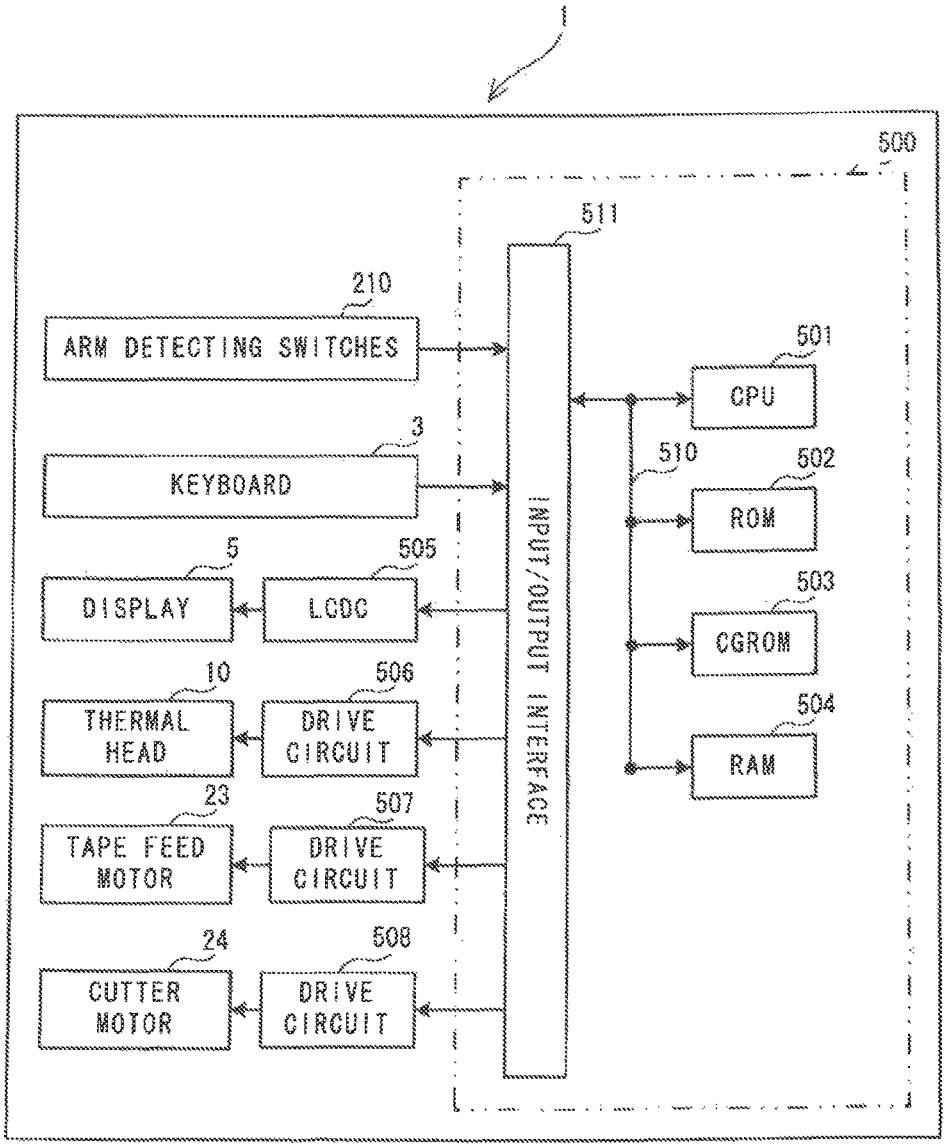
FIG. 15 is a block diagram showing an electrical configuration of the tape printer 1.

Next, the electrical configuration of the tape printer 1 will be explained with reference to FIG. 15. As shown in FIG. 15, the tape printer 1 includes a control circuit 500 formed on a control board. The control circuit 500 includes a CPU 501 that controls each instrument, a ROM 502, a CGROM 503, a RAM 504, and an input/output interface 511, all of which are connected to the CPU 501 via a data bus 510.

The ROM 502 stores various programs to control the tape printer 1, including a display drive control program, a print drive control program, a pulse number determination program, a cutting drive control program, and so on. The display drive control program controls a liquid crystal drive circuit (LCDC) 505 in association with code data of characters, such as letters, symbols, numerals and so on input from the keyboard 3. The print drive control program drives the thermal head 10 and the tape feed motor 23. The pulse number determination program determines the number of pulses to be applied corresponding to the amount of formation energy for each print dot. The cutting drive control program drives a cutter motor 24 to cut the printed tape 50 at a predetermined cutting position. The CPU 501 performs a variety of computations in accordance with each type of program.

The CGROM 503 stores print dot pattern data to be used to print various characters. The print dot pattern data is associated with corresponding code data for the characters. The print dot pattern data is categorized by font (Gothic, Mincho, and so on), and the stored data for each font includes six print character sizes (dot sizes of 16, 24, 32, 48, 64 and 96, for example).

The RAM 504 includes a plurality of storage areas, including a text memory, a print buffer and so on. The text memory stores text data input from the keyboard 3. The print buffer stores dot pattern data, including the printing dot patterns for characters and so on. The thermal head 10 performs dot printing in accordance with the dot pattern data stored in the print buffer. Other storage areas store data obtained in various computations and so on.

The input/output interface 511 is connected, respectively, to the arm detecting switches 210, the keyboard 3, the liquid crystal drive circuit (LCDC) 505 that has a video RAM (not shown in the figures) to output display data to the liquid crystal display (LCD) 5, a drive circuit 506 that drives the thermal head 10, a drive circuit 507 that drives the tape feed motor 23, a drive circuit 508 that drives the cutter motor 24, and so on.

The configuration of the tape cassette 30 according to the first embodiment will next be explained with reference to FIG. 4 to FIG. 8, FIG. 14 and FIG. 16 to FIG. 26. Hereinafter, the tape cassette 30 configured as a general purpose cassette will be explained as an example. As the general purpose cassette, the tape cassette 30 may be assembled as the thermal type, the receptor type and the laminated type that have been explained above, by changing, as appropriate, the type of the tape to be mounted in the tape cassette 30 and by changing the presence or absence of the ink ribbon, and so on.

First, a general outline of the structure of the tape cassette 30 as a whole will be explained. As shown in FIG. 4, the tape cassette 30 includes the cassette case 31 that is a housing having a generally rectangular parallelepiped shape (box-like shape), with rounded corner portions in a plan view. The cassette case 31 includes the top case 311 and the bottom case 312. The bottom case 312 includes a bottom wall 306 that forms the bottom surface 302 of the cassette case 31. The top case 311 includes a top wall 305 that forms a top surface 301 of the cassette case 31. The top case 311 is fixed to an upper portion of the bottom case 312. A distance from the bottom surface 302 to the top surface 301 is referred to as the height of the tape cassette 30 or the height of the cassette case 31.

In the cassette case 31 according to the first embodiment, the peripheries of the top wall 305 and the bottom wall 306 are surrounded by a peripheral wall that forms a side surface. However, the peripheries need not necessarily be completely surrounded, and a part of the peripheral wall (a rear wall portion, for example) may include an aperture that exposes the interior of the cassette case 31 to the outside. Further, a boss that connects the top wall 305 and the bottom wall 306 may be provided in a position facing the aperture.

The cassette case 31 has four corner portions that have the same width (the same length in the vertical direction), regardless of the type of the tape cassette 30. Hereinafter, a rear left corner portion is referred to as the first corner portion 321, a rear right corner portion is referred to as the second corner portion 322, a front right corner portion is referred to as the third corner portion 323, and a front left corner portion is referred to as the fourth corner portion 324. The first to third corner portions 321 to 323 each protrude in an outward direction from the side surface of the cassette case 31 to form a right angle when seen in a plan view. However, the fourth corner portion 324 positioned at the front left does not form a right angle in the plan view, as the tape discharge portion 49 is provided in the corner. When the tape cassette 30 is installed in the cassette housing portion 8, the lower surfaces of the first to fourth corner portions 321 to 324 respectively face and are supported by the above-described corner support portion 812.

Figure 21:
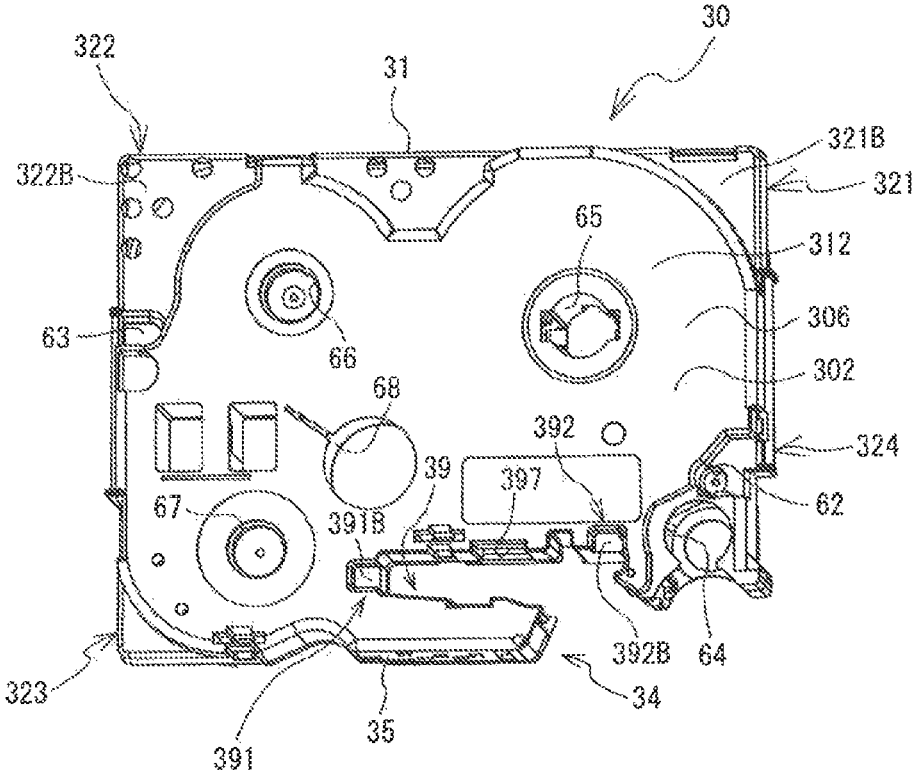
FIG. 21 is a perspective view of the tape cassette 30 when seen from the a bottom surface 302 side.

As shown in FIG. 21, the pin holes 62 and 63 are respectively formed in two locations in the lower surface of the second corner portion 322 and in the lower surface the fourth corner portion 324. The pin holes 62 and 63 respectively correspond to the above-described positioning pins 102 and 103. More specifically, an indentation formed in the lower surface of the fourth corner portion 324 is the pin hole 62, into which the positioning pin 102 is inserted. An indentation formed in the lower surface of the second corner portion 322 is the pin hole 63, into which the positioning pin 103 is inserted.

As shown in FIG. 4, the cassette case 31 includes a portion that is called a common portion 32. The common portion 32 includes the first to fourth corner portions 321 to 324, and encircles the complete periphery of the cassette case 31 along the side surface at the same position as the first to fourth corner portions 321 to 324 in the vertical (height) direction of the cassette case 31 and also has the same width as the first to fourth corner portions 321 to 324. More specifically, the common portion 32 is a portion that has a symmetrical shape in the vertical direction with respect to a center line N in the vertical (height) direction of the cassette case 31 (refer to FIG. 16 and FIG. 18). The height of the tape cassette 30 differs depending on the tape width of the print medium (the heat-sensitive paper tape 55, the print tape 57 and the film tape 59) and the double-sided adhesive tape 58 (hereinafter each referred to generically as a tape) mounted in the cassette case 31. However, a width (a length in the vertical direction) T of the common portion 32 is set to be the same, regardless of the width of the tape.

For example, when the width T of the common portion 32 is 12 mm, when the width of the tape is larger (18 mm, 24 mm, 36 mm, for example), the height of the cassette case 31 becomes accordingly larger, but the width T (refer to FIG. 16 and FIG. 18) of the common portion 32 remains constant at 12 mm. If the width of the tape is equal to or less than the width T of the common portion 32 (6 mm, 12 mm, for example), the height (width) of the cassette case 31 is the width T of the common portion 32 (12 mm) plus a predetermined width. The height of the cassette case 31 is at its smallest in this case.

As shown in FIG. 4, the cassette case 31 has support holes 65, 66, 67 and 68. The support holes 65, 66, 67 and 68 rotatably support a first tape spool 40, a second tape spool 41, a ribbon spool 42 and a ribbon take-up spool 44, respectively (refer to FIG. 5 to FIG. 8). The respective spools will be explained later. Note that, only the support holes 65, 66, 67 and 68 in the top case 311 are shown in FIG. 4, but the corresponding support holes 65, 66, 67 and 68 are also provided in the bottom case 312.

As shown in FIG. 5 to FIG. 8, a first tape area 400, a second tape area 410, a first ribbon area 420, and a second ribbon area 440 are provided inside the cassette case 31. The first and second tape areas 400 and 410 are each an area that can house a tape as a print medium. The first ribbon area 420 houses the ink ribbon 60 that has not been used, and the second ribbon area 440 houses the ink ribbon 60 that has been used for printing characters.

The first tape area 400 is adjacent to the first corner portion 321 and occupies approximately a left half of the cassette case 31. The first tape area 400 has a generally circular shape in a plan view. The second tape area 410 is adjacent to the second corner portion 322 and is positioned to the rear right inside the cassette case 31. The second tape area 410 has a generally circular shape in a plan view. The first ribbon area 420 is adjacent to the third corner portion 323 and the head insertion portion 39 that will be explained later, and is positioned to the front right inside the cassette case 31. The first ribbon area 420 has a generally circular shape in a plan view. The second ribbon area 440 is an area that has a generally circular shape in a plan view, and is positioned inside the cassette case 31 between the first tape area 400 and the first ribbon area 420.

In the case of the laminated type tape cassette 30 shown in FIG. 5 and FIG. 6, the double-sided adhesive tape 58, the transparent film tape 59, and the ink ribbon 60 are mounted in the cassette case 31. The double-sided adhesive tape 58 is a double-sided tape to one surface of which is affixed a release paper. The film tape 59 is the print medium. The double-sided adhesive tape 58, which is wound on the first tape spool 40 with its release paper facing outwards, is housed in the first tape area 400. The film tape 59, which is wound on the second tape spool 41, is housed in the second tape area 410.

The unused ink ribbon 60, which is wound on the ribbon spool 42, is housed in the first ribbon area 420. The used ink ribbon 60, which is wound on the ribbon take-up spool 44, is housed in the second ribbon area 440. A clutch spring (not shown in the figures) is attached to a lower portion of the ribbon take-up spool 44 to prevent loosening of the taken up ink ribbon 60 due to a reverse rotation of the ribbon take-up spool 44.

In the case of the receptor type tape cassette 30 shown in FIG. 7, the print tape 57 as the print medium and the ink ribbon 60 are mounted in the cassette case 31. The print tape 57, which is wound on the first tape spool 40, is housed in the first tape area 400. The unused ink ribbon 60, which is wound on the ribbon spool 42, is housed in the first ribbon area 420. The used ink ribbon 60, which is wound on the ribbon take-up spool 44, is housed in the second ribbon area 440. The receptor type tape cassette 30 does not include the second tape spool 41. In other words, nothing may be housed in the second tape area 410.

In the case of the thermal type tape cassette 30 shown in FIG. 8, the heat-sensitive paper tape 55 is mounted in the cassette case 31. The heat sensitive paper tape 55, which is wound on the first tape spool 40, is housed in the first tape area 400. The thermal type tape cassette 30 does not include the second tape spool 41 and the ribbon spool 42. In other words, nothing may be housed in the second tape area 410, the first ribbon area 420 and the second ribbon area 440. Hereinafter, whenever the print medium, namely, the heat sensitive paper tape 55, the print tape 57 or the film tape 59, is referred to, it is simply referred to as the tape.

As shown in FIG. 4, a semi-circular groove 340 that has a generally semi-circular shape in a plan view is provided in the front wall of the cassette case 31, and extends over the height of the cassette case 31 (in other words, extends from the top surface 301 to the bottom surface 302). The semi-circular groove 340 is a recess that serves to prevent interference between the shaft support 121 and the cassette case 31 when the tape cassette 30 is installed in the cassette housing portion 8. The shaft support 121 is the center of rotation of the platen holder 12.

Of the front wall of the cassette case 31, a section that stretches leftwards from the semi-circular groove 340 is referred to as the arm front wall 35. A part that is defined by the arm front wall 35 and an arm rear wall 37 and that extends leftward from the right side of the tape cassette 30 is referred to as an arm portion 34. The arm rear wall 37 is separately provided at the rear of the arm front wall 35 and extends over the height of the cassette case 31. A left end of the arm front wall 35 is bent in the rearward direction, and a gap that is formed extending in the vertical direction between the arm front wall 35 and the left end of the arm rear wall 37 is an exit 341 through which the tape (and the ink ribbon 60) is discharged from the arm portion 34. In addition, the arm indicator portion 800 and the latching hole 820 are provided in the arm front wall 35. The arm indicator portion 800 and the latching hole 820 will be described in more detail later.

As shown in FIG. 5 to FIG. 8, in the arm portion 34, the tape that is pulled out from the first tape spool 40 or the second tape spool 41 is directed along a feed path that extends generally in parallel with the arm front wall 35, and is discharged through the exit 341. In addition, in the arm portion 34, the ink ribbon 60 that is pulled out from the ribbon spool 42 is directed along another feed path that is different from the feed path for the tape. At the exit 341, the ink ribbon 60 is overlaid with the tape and then discharged through the exit 341.

A space that is surrounded by the arm rear wall 37 and a peripheral wall that extends continuously from the arm rear wall 37 is the head insertion portion 39. The head insertion portion 39 is also connected to the outside at the front side of the tape cassette 30, through an opening 77 provided in the front side of the tape cassette 30. The head holder 74 that supports the thermal head 10 of the tape printer 1 may be inserted into the head insertion portion 39. The thermal head 10 performs printing on the tape that is discharged through the exit 341 of the arm portion 34 at the opening 77 (refer to FIG. 5 to FIG. 8), using the ink ribbon 60.

As shown in FIG. 4, a pair of regulating members 361 and 362 that match in the vertical direction are provided on the downstream side of the head insertion portion 39 in the tape feed direction. The regulating members 361 and 362 direct the tape that has been discharged through the exit 341 and on which printing has been performed toward the tape discharge portion 49 in the vicinity of a downstream end of the head insertion portion 39. Although details will be described later, the ink ribbon 60 that has been used for printing is separated from the tape on the upstream side of the regulating members 361 and 362, and is fed along a separate feed path, and then is taken up by the ribbon take-up spool 44.

A support hole 64 (refer to FIG. 21) is provided on the downstream side of the regulating members 361 and 362 in the tape feed direction, and the tape drive roller 46 is rotatably supported inside the support hole 64. In a case where the laminated type tape cassette 30 shown in FIG. 5 and FIG. 6 is installed in the cassette housing portion 8, the tape drive roller 46, by moving in concert with the facing movable feed roller 14, pulls out the film tape 59 from the second tape spool 41. At the same time, the tape drive roller 46 pulls out the double-sided adhesive tape 58 from the first tape spool 40, guides the double-sided adhesive tape 58 to the print surface of the film tape 59 to bond them together, and then feeds them toward the tape discharge portion 49 as the printed tape 50.

In a case where the receptor type tape cassette 30 shown in FIG. 7 is installed in the cassette housing portion 8, the print tape 57 is pulled out from the first tape spool 40 by the tape drive roller 46 moving in concert with the movable feed roller 14. On the downstream side of the thermal head 10, the printed print tape 57, namely, the printed tape 50, is directed by the regulating members 361 and 362 toward the tape discharge portion 49. In addition, the used ink ribbon 60 that has been fed via the head insertion portion 39 is separated from the print tape 57 on the upstream side of the regulating members 361 and 362 and is directed toward the ribbon take-up spool 44.

In a case where the thermal type tape cassette 30 shown in FIG. 8 is installed, the heat-sensitive paper tape 55 is pulled out from the first tape spool 40 by the tape drive roller 46 moving in concert with the movable feed roller 14. On the downstream side of the thermal head 10, the printed heat-sensitive paper tape 55, namely, the printed tape 50, is directed by the regulating members 361 and 362 toward the tape discharge portion 49.

The tape discharge portion 49 is located at the most downstream position on the feed path of the tape fed in the cassette case 31. The tape discharge portion 49 is a plate-shaped member that extends between the top surface 301 and the bottom surface 302 and is slightly separated from a front end of the left side wall of the cassette case 31. The tape discharge portion 49 directs the printed tape 50, which has been fed via the regulating members 361 and 362 and the tape drive roller 46, into a passage formed between the tape discharge portion 49 and the front end of the left side wall of the cassette case 31. The printed tape 50 is then discharged from a tape discharge aperture located at a downstream end of the passage.

Next, the arm indicator portion 800 and the latching hole 820, which are provided on the arm front wall 35 of the arm portion 34, will be described below in detail with reference to FIG. 16 to FIG. 18. When the tape cassette 30 is installed in the cassette housing portion 8 and the platen holder 12 moves toward the print position (refer to FIG. 6 to FIG. 8), the arm detection portion 200 and the latching piece 225 provided in the cassette-facing surface 122 respectively face the arm indicator portion 800 and the latching hole 820.

The arm indicator portion 800 is a portion that allows a person to identify the type of the tape mounted in the tape cassette 30. In addition, by selectively pressing the arm detecting switches 210 of the arm detection portion 200, the arm indicator portion 800 causes the tape printer 1 to detect the tape type of the tape cassette 30. The latching piece 225 is inserted into the latching hole 820.

The arm indicator portion 800 includes a plurality of indicators. Each of the indicators is either a non-pressing portion 801 or a pressing portion 802 that is provided at a position that corresponds to each of the arm detecting switches 210. The non-pressing portion 801 is a switch hole that has a vertically long rectangular shape in a front view. The switch terminal 222 can be inserted and removed through the non-pressing portion 801. The pressing portion 802 is a surface portion of the arm front wall 35. Therefore, the switch terminal 222 cannot be inserted in the pressing portion 802. Thus, the arm indicator portion 800 according to the first embodiment includes one of the non-pressing portion 801 and the pressing portion 802 at each of the five positions corresponding to the five arm detecting switches 210.

The non-pressing portion 801 and the pressing portion 802 are arranged in a specific pattern corresponding to the type of the tape cassette 30. Hereinafter, the "indicator(s)" refer to the non-pressing portion 801 and the pressing portion 802 collectively, or an unspecified one of the non-pressing portion 801 and the pressing portion 802.

The structure of the arm indicator portion 800 and the latching hole 820 will be explained in more detail with reference to FIG. 4 and FIG. 16 to FIG. 18. In FIG. 4 and FIG. 16, an example is depicted of the arm indicator portion 800 and the latching hole 820 when a tape width of the printed tape 50 (the film tape 59 and the double-sided adhesive tape 58 in the example of the laminated type tape cassette 30) housed in the tape cassette 30 is equal to or greater than a predetermined width (18 mm, for example) (hereinafter referred to as the wide-width tape cassette 30). On the other hand, in FIG. 17 and FIG. 18, an example is depicted of the arm indicator portion 800 and the latching hole 820 when the tape width of the printed tape 50 for the film tape 59 housed in the tape cassette 30 is less than the predetermined width (hereinafter referred to as the narrow-width tape cassette 30).

First, the arm indicator portion 800 will be explained. As shown in FIG. 16, at least a part of the indicators (the non-pressing portion(s) 801 and the pressing portion(s) 802) of the arm indicator portion 800 is provided within a predetermined height range T1 (hereinafter referred to as the predetermined height T1) of the arm front wall 35. The predetermined height T1 is the height of the cassette case 31 for the tape cassette 30 having the smallest height, among the plurality of tape cassettes 30 with different heights.

An area within the range of the predetermined height T1 of the arm front wall 35 is referred to as a common indicator portion 831. Preferably, the common indicator portion 831 is a symmetrical area in the vertical direction with respect to a central line N that indicates the center of the arm front wall 35 in the vertical (height) direction of the cassette case 31. At least a part of the indicators (the non-pressing portion(s) 801 and the pressing portion(s) 802) is provided within the common indicator portion 831. In addition, in the case of the wide-width tape cassette 30 shown in FIG. 16, an additional indicator(s) may be provided at least either above or below the common indicator portion 831 within a predetermined height T2 of the arm front wall 35. Areas that are outside the common indicator portion 831 and that are within the predetermined height T2 of the arm front wall 35 are referred to as extension portions 832.

In the first embodiment, positions of each of the indicators are different from each other in the left-and-right direction. In other words, none of the indicators line up with each other in the vertical direction, and the five indicators are arranged in a zigzag pattern. Therefore, a line connecting each of the indicators intersects with the vertical direction of the tape cassette 30, which is the direction of insertion and removal of the tape cassette 30.

In the first embodiment, in the wide-width tape cassette 30 shown in FIG. 16, four of the five indicators are provided in two rows within the height T1 of the common indicator portion 831 and the remaining one indicator is provided extending into the extension portion 832 below the common indicator portion 831. More specifically, in the upper row in the common indicator portion 831, the non-pressing portion 801 is provided on the left side of the tape cassette 30 and the pressing portion 802 is provided on the right side of the tape cassette 30. In the lower row in the common indicator portion 831, the pressing portion 802 is provided on the left side of the tape cassette 30 and the non-pressing portion 801 is provided on the right side of the tape cassette 30. Further, the pressing portion 802 is provided extending into the extension portion 832 below the common indicator portion 831. In this way, in the wide-width tape cassette 30, by having the arm indicator portion 800 with a larger area that corresponds to the wider arm front wall 35, the number of tape types that can be detected by the tape printer 1 can be increased.

Figure 16:
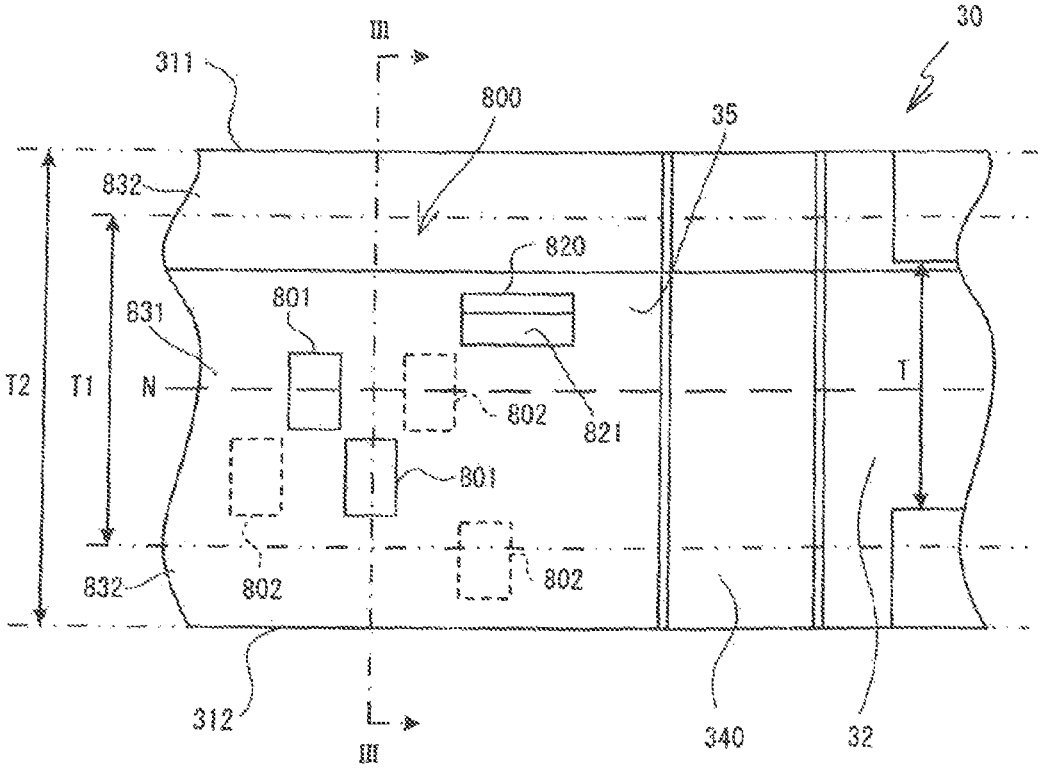
FIG. 16 is a front view of an arm front wall 35 of a wide-width tape cassette 30.
Figure 17:
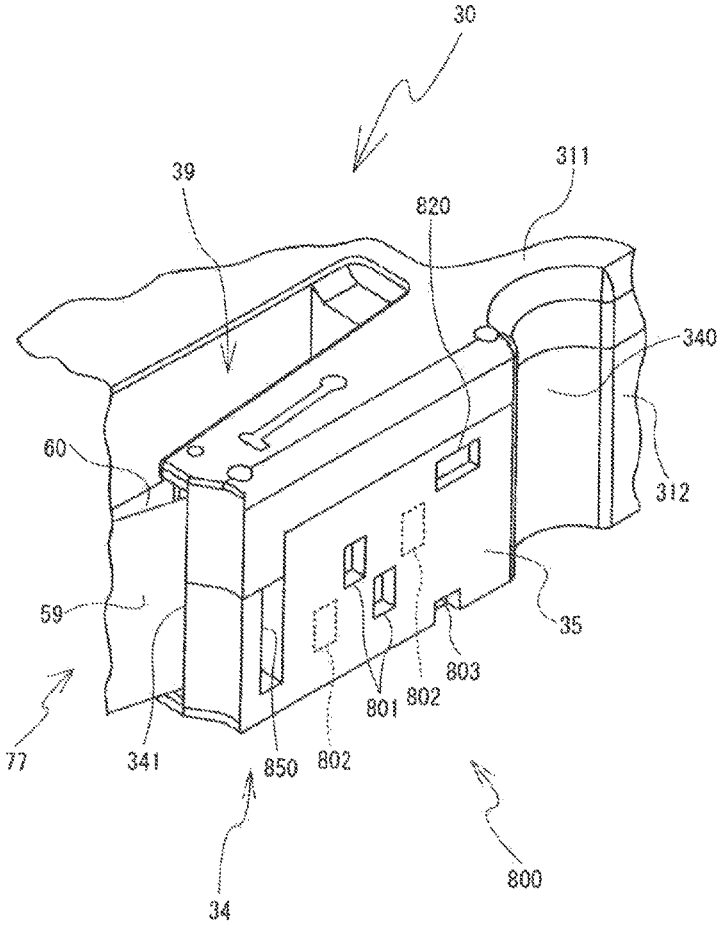
FIG. 17 is a perspective view of an arm portion 34 of a narrow-width tape cassette 30.
Figure 18:
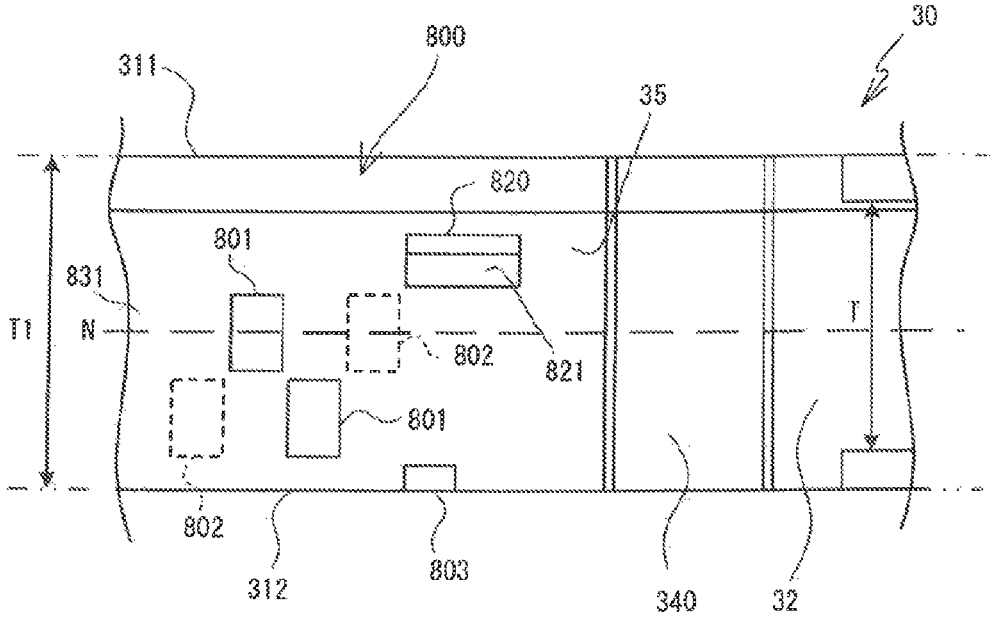
FIG. 18 is a front view of the arm front wall 35 of the narrow-width tape cassette 30.

With the tape cassette 30 that has a width equal to or greater than the predetermined width, when, as shown in FIG. 16, the indicator (the pressing portion 802 in the lowermost row in FIG. 16) is provided extending from the common indicator portion 831 into at least one of the extension portions 832 above and below the common indicator portion 831, an escape hole 803 is provided at a corresponding position in the narrow-width tape cassette 30, as shown in FIG. 17 and FIG. 18. The escape hole 803 may be a through-hole that is formed so as not to press the facing arm detecting switch 210. Alternatively, in place of the escape hole 803, escape steps may be formed by being bent stepwise toward the inside. Detection of the type of the tape cassette 30 using the arm indicator portion 800 with this type of structure will be explained in more detail later.

The latching hole 820 is a through-hole that has a horizontally long rectangular shape in a plan view. When the tape cassette 30 is installed in the cassette housing portion 8, the latching hole 820 is positioned to face the latching piece 225 (refer to FIG. 5) such that the latching piece 225 can be freely inserted or removed. More specifically, the latching hole 820 is formed above all of the indicators of the arm indicator portion 800 in the vertical direction of the tape cassette 30, and below a joint portion between the top case 311 and the bottom case 312. The latching hole 820 overlaps with the indicator positioned to the rightmost in the left-and-right direction (the pressing portion 802 in the lowermost row in the example shown in FIG. 16). Part of a lower wall of the latching hole 820 is an inclined portion 821 that inclines in the upward direction from the arm front wall 35 toward the inside (refer to FIG. 34). In other words, an opening width of the latching hole 820 in the vertical direction is largest at the arm front wall 35, and gradually decreases toward the inside.

The structure of the bottom case 312 and the top case 311 of the cassette case 31 will be explained below in more detail, with reference to FIG. 19 to FIG. 26. Note that, in FIG. 20, for ease of explanation, the arrangement positions and feed paths of the film tape 59, the double-sided adhesive tape 58 and the ink ribbon 60 when the laminated type tape cassette 30 is used are shown as two-dotted lines.

Figure 19:
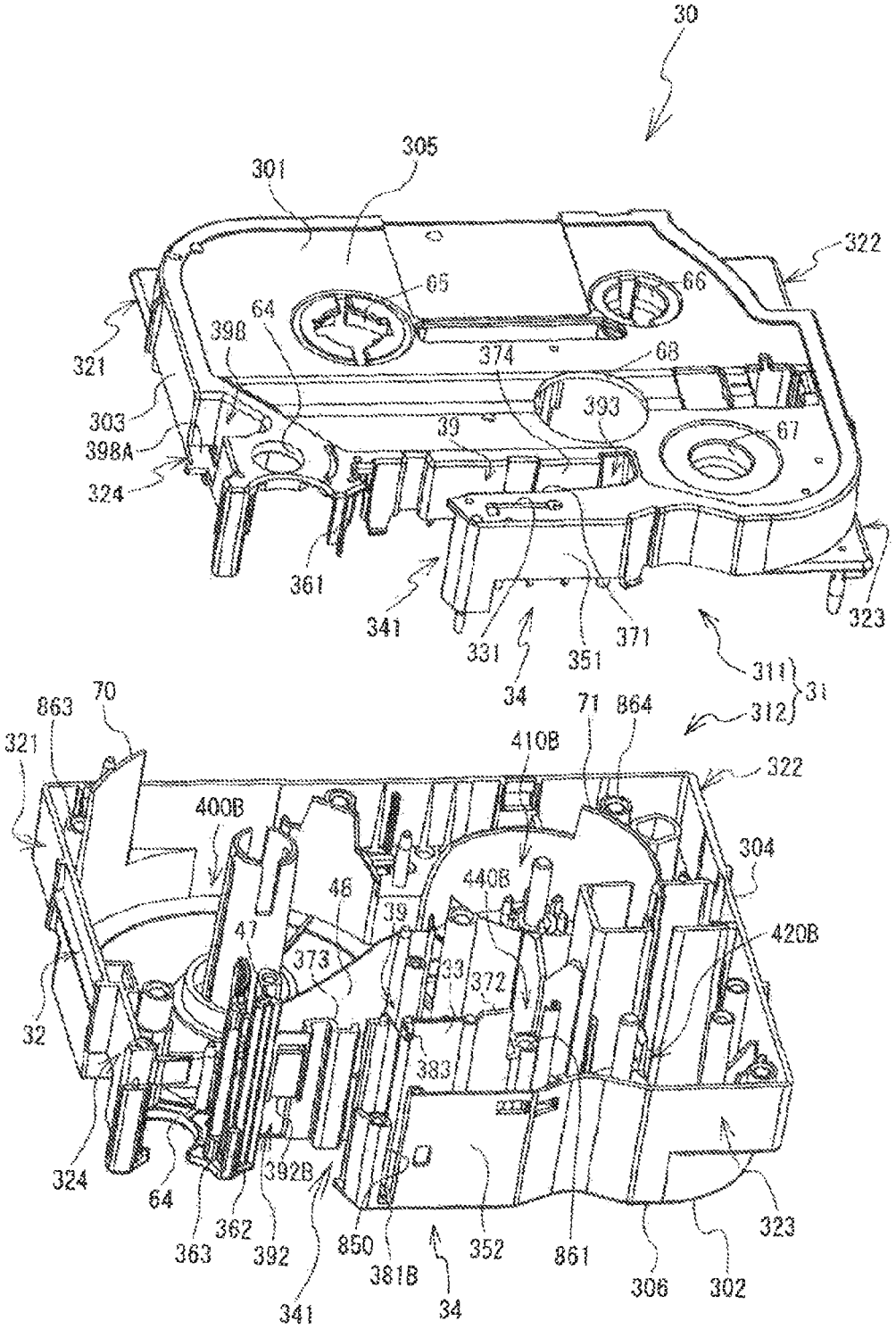
FIG. 19 is an exploded perspective view of a cassette case 31.

First, the structure of the bottom case 312 will be explained with reference to FIG. 19 to FIG. 23. As shown in FIG. 19, the periphery of the bottom case 312 is formed of the bottom surface 302 and of a lower peripheral wall 304. The lower peripheral wall 304 extends in the upward direction at a predetermined height from the bottom wall 306 that forms the bottom surface 302. Of the lower peripheral wall 304, a section that forms a lower portion of the arm front wall 35 is referred to as a lower arm front wall 352. Further, a wall that forms a lower portion of the arm rear wall 37 is referred to as a lower arm rear wall 372. The lower arm rear wall 372 is standing from the bottom wall 306, and is separated in the rearward direction from the lower arm front wall 352. A peripheral wall that continuously extends from the lower arm rear wall 372 and that defines a lower portion of the head insertion portion 39 is referred to as a lower head peripheral wall 373.

Figure 20:
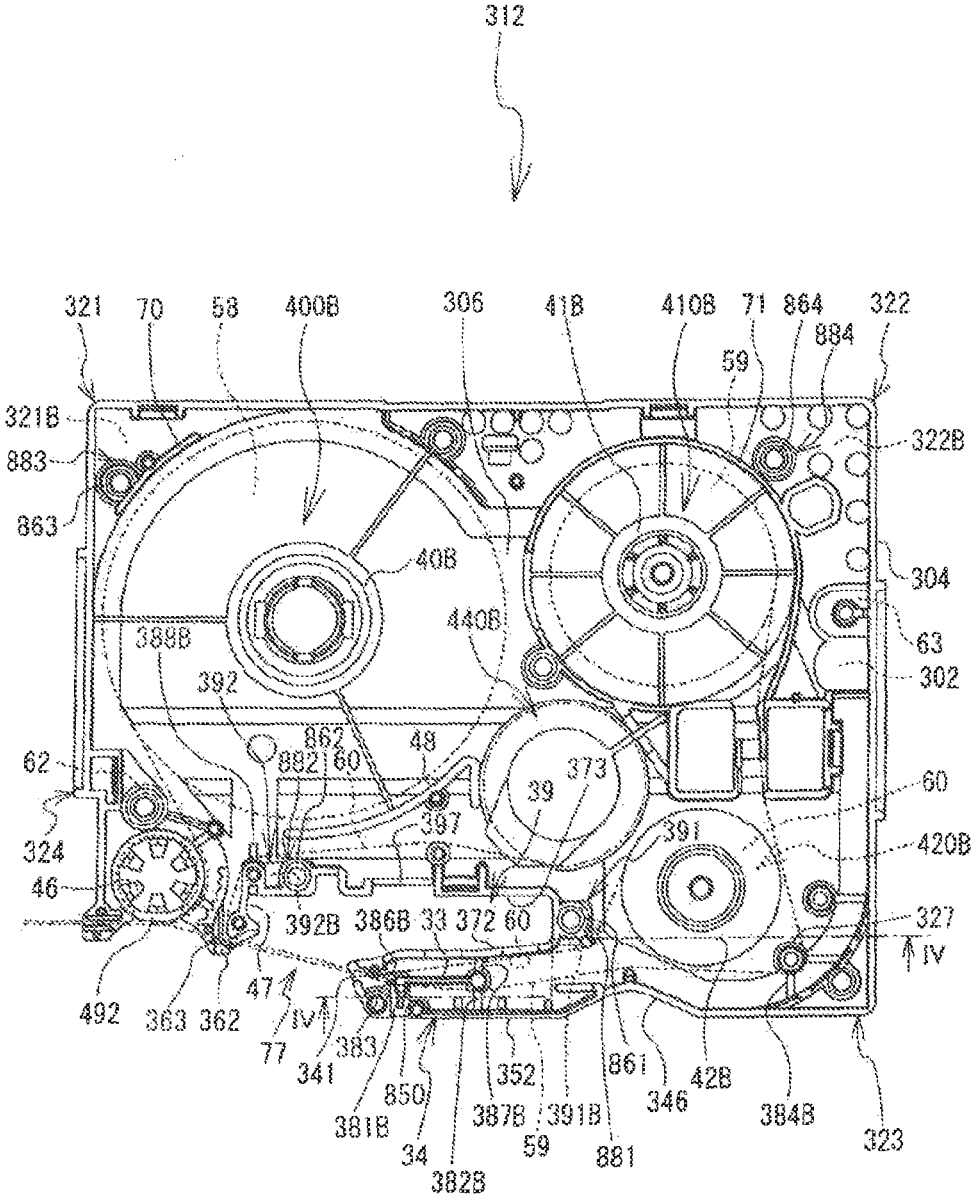
FIG. 20 is a plan view of a bottom case 312.

The structure around the head insertion portion 39 in the bottom case 312 will be explained in more detail. As shown in FIG. 20 and FIG. 21, two support receiving portions are provided on the outer periphery of the head insertion portion 39 of the bottom case 312 and at positions facing the head insertion portion 39. More specifically, a first support receiving portion 391 and a second support receiving portion 392 are respectively provided on the upstream side and the downstream side of an insertion position of the thermal head 10 (more specifically, a printing position, that is, the position of the heating element row 10A) (refer to FIG. 5 to FIG. 8) in the feed direction of the tape. Hereinafter, the first support receiving portion 391 and the second support receiving portion 392 are sometimes collectively referred to as the support receiving portions 391 and 392. The support receiving portions 391 and 392 may be used to determine the position of the tape cassette 30 in the vertical direction when the tape cassette 30 is installed in the tape printer 1.

The first support receiving portion 391 is connected to an upstream side end of the arm portion 34 and is also connected to an upstream side end of the head insertion portion 39 in the tape feed direction. The second support receiving portion 392 is connected to a downstream side end of the head insertion portion 39.

Each of the first support receiving portion 391 and the second support receiving portion 392 is an indentation that extends from the bottom surface 302 toward the top surface 301. More specifically, each of the first support receiving portion 391 and the second support receiving portion 392 is an indentation formed by indenting upwardly a section of the bottom wall 306 connecting to a wall (the lower head peripheral wall 373) that defines the space of the head insertion portion 39. Further, the first support receiving portion 391 faces the head insertion portion 39 in a direction that is parallel to the arm front wall 35. The second support receiving portion 392 faces the head insertion portion 39 in a direction that is perpendicular to the arm front wall 35. In other words, the first support receiving portion 391 and the second support receiving portion 392 face the head insertion portion 39 in directions that are perpendicular to each other.

The above-described arrangement can be alternatively expressed as follows, in relation to the position of the heating element row 10A of the thermal head 10 of the head holder 74, that is, the printing position, when the tape cassette 30 is installed in the cassette housing portion 8. The first support receiving portion 391 to be supported by the first supporting portion 741 of the head holder 74 is located at a position to face the head insertion portion 39 and in a direction (first direction) toward the most upstream side of the head insertion portion 39 in the tape feed direction with respect to the heating element row 10A. The second support receiving portion 392 to be supported by the second supporting portion 742 of the head holder 74 is located at a position to face the head insertion portion 39 and in a second direction perpendicular to the first direction.

The first support receiving portion 391 and the second support receiving portion 392 have a first lower flat surface 391B and a second lower flat surface 392B, respectively. The first and second lower flat surfaces 391B and 392B are both positioned above the bottom surface 302. Each of the first and second lower flat surfaces 391B and 392B is a lower surface of a flat portion (a ceiling wall portion of the indentation) that has a generally rectangular shape in a bottom view. Distances between positions of the first and second lower flat surfaces 391B and 392B in the vertical direction (in the height direction) of the bottom case 312 and center positions in the width direction of the tape and the ink ribbon 60 housed in the cassette case 31 are constant, regardless of the type of the tape cassette 30. In other words, the distances are constant even when the height in the vertical direction of the tape cassette 30 is different. Accordingly, the greater the width of the tape and the ink ribbon 60 housed in the tape cassette 30, the greater the depth of the indentation of the support receiving portions 391 and 392 provided in the bottom wall 306.

In the first embodiment, the first and second lower flat surfaces 391B and 392B are separated in the vertical direction from the center positions of the tape and the ink ribbon 60 in the width direction at a same distance. In other words, the first and second lower flat surfaces 391B and 392B are at a same height position in the bottom case 312. Note that, in the first embodiment, the center positions of the tape and the ink ribbon 60 in the width direction match a center position of the cassette case 31 in the vertical direction.

The first and second lower flat surfaces 391B and 392B are reference surfaces in the bottom case 312. The reference surface is a surface to be used as a reference point when setting dimensions or measuring dimensions of a certain part or member. In the first embodiment, the first and second lower flat surfaces 391B and 392B are provided as reference surfaces for various regulating portions (to be described later) that restrict movements of the tape and the ink ribbon 60 in the width direction. Furthermore, when the tape cassette 30 is installed in the cassette housing portion 8, the first and second lower flat surfaces 391B and 392B function as portions that are respectively supported from underneath by the cassette supporting portions 741 and 742 that are provided in the head holder 74.

As shown in FIG. 20, a first cylindrical member 861 that has a cylindrical shape is standing on an upper side of the first support receiving portion 391. More specifically, the first cylindrical member 861 is provided above the first lower flat surface 391B in a direction perpendicular to the first lower flat surface 391B. A second cylindrical member 862 that has a cylindrical shape is standing on an upper side of the second support receiving portion 392. More specifically, the second cylindrical member 862 is provided above the second lower flat surface 392B in a direction perpendicular to the second lower flat surface 392B. The first cylindrical member 861 and the second cylindrical member 862 are each in contact with the lower head peripheral wall 373. The first and second cylindrical members 861 and 862 have the same structure. Therefore, the structure of the first cylindrical member 861 as a representative will be explained below with reference to FIG. 22.

Figure 22:
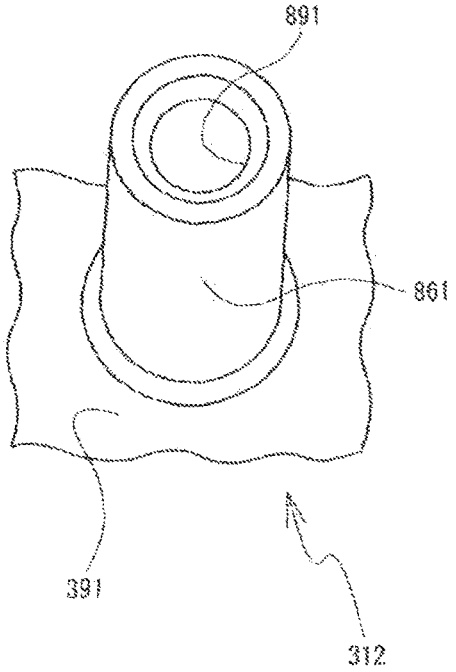
FIG. 22 is a perspective view of a first cylindrical member 861.

As shown in FIG. 22, the first cylindrical member 861 has a cylindrical hole 891. The cylindrical hole 891 is an indentation that does not penetrate through the bottom surface 302 of the tape cassette 30, and is formed to have a circular shape in a plan view. The cylindrical hole 891 may be formed as a through-hole that penetrates through the bottom surface 302 of the tape cassette 30, instead. The opening diameter of the cylindrical hole 891 becomes gradually wider toward its upper end, such that the diameter is at its largest at the upper end. As a consequence, a first insertion pin 871 (refer to FIG. 25 and FIG. 26) of the top case 311 (to be described later) can easily be inserted into the cylindrical hole 891 of the first cylindrical member 861.

A first fitting portion 881 (refer to FIG. 20 and FIG. 29) is formed by inserting the first insertion pin 871 into the cylindrical hole 891 of the first cylindrical member 861. In a similar manner, a second fitting portion 882 (refer to FIG. 20) is formed by inserting a second insertion pin 872 (refer to FIG. 25) of the top case 311 (to be described later) into the cylindrical hole 891 of the second cylindrical member 862. The first and second fitting portions 881 and 882 will be described in more detail later.

As shown in FIG. 21, the latching portion 397 is provided at a position facing the head insertion portion 39 on the periphery of the head insertion portion 39 of the bottom case 312, and between the first support receiving portion 391 and the second support receiving portion 392 in a longitudinal direction of the head insertion portion 39. The latching portion 397 is provided on a section of the lower head peripheral wall 373 facing the arm rear wall 37 in a generally center position in the longitudinal direction of the head insertion portion 39. The latching portion 397 is formed as a partial cut-out formed in the lower head peripheral wall 373 above a predetermined height from the bottom surface 302. When the tape cassette 30 is installed in the cassette housing portion 8, the latching portion 397 (an upper end of the cut-out lower head peripheral wall 373) is positioned to face the claw portion 752 of the cassette hook 75. Accordingly, when the tape cassette 30 is installed in the cassette housing portion 8, the cassette hook 75 engages with the latching portion 397.

As shown in FIG. 20, of the lower head peripheral wall 373, a left side wall portion that defines the downstream end of the head insertion portion 39 in the tape feed direction is referred to as a ribbon guide wall 47. The ribbon guide wall 47 is provided adjacent to the regulating member 362 on its upstream side. The feed path of the ink ribbon 60 extends from the first ribbon area 420, in which the ribbon spool 42 is positioned, to the second ribbon area 440, in which the ribbon take-up spool 44 is positioned, via the arm portion 34 and the opening 77. The ribbon guide wall 47 causes the ink ribbon 60 that has been discharged through the exit 341 and used for printing at the opening 77 to bend along the feed path and directs it toward the second ribbon area 440. The second support receiving portion 392, which is connected to the downstream end of the head insertion portion 39, is positioned to the front of the feed path of the ink ribbon 60 that extends from the ribbon guide wall 47 to the second ribbon area 440.

Next, the structure of a section of the bottom case 312 that forms a part of the arm portion 34 will be explained in more detail. As shown in FIG. 19 and FIG. 20, the section of the arm portion 34 in the bottom case 312 includes the lower arm front wall 352, the lower arm rear wall 372 and a separating wall 33 that is provided between the lower arm front wall 352 and the lower arm rear wall 372. A mold exit hole 850 is provided on a right side of a bent portion on the left end of the lower arm front wall 352. The mold exit hole 850 is formed in a vertically long rectangular shape in a front view, by cutting out an upper portion of the arm lower front wall 352. When the top case 311 is joined to the bottom case 312, a through-hole is formed in the arm front wall 35 (refer to FIG. 4).

The separating wall 33 is formed to be highest among the three walls of the arm portion 34, and the height of the separating wall 33 is slightly larger than the width of the tape housed in the cassette case 31. Of the lower arm front wall 352, a section on the left side of the mold exit hole 850 has a height that is approximately half the height of the separating wall 33, and a section on the right side of the mold exit hole 850 has a height that is approximately two thirds the height of the separating wall 33. The lower arm rear wall 372 is slightly lower than the separating wall 33, and its height is approximately the same as the width of the ink ribbon 60. In addition, a right end of the separating wall 33 that has a cylindrical shape in a plan view is positioned approximately in the center of the arm portion 34. A left end of the separating wall 33 is positioned such that it faces the mold exit hole 850 provided on the lower arm front wall 352 in the back-and-forth direction of the bottom case 312. The mold exit hole 850 is an exit hole of the mold that is used to form the bottom case 312.

As shown in FIG. 20, the feed path of the tape (the film tape 59 in the example shown in FIG. 20) is formed between the lower arm front wall 352 and the separating wall 33. The feed path of the ink ribbon 60 is formed between the separating wall 33 and the lower arm rear wall 372. Regulating portions are provided on these feed paths that restrict the movements of the tape and the ink ribbon 60 in the width direction (the vertical direction of the cassette case 31).

First, on the tape feed path, first lower tape regulating portions 381B and 382B that restrict the movement of the tape in the downward direction are provided, respectively, on a lower end portion of the left end of the separating wall 33 and on a lower end portion of the right end of the separating wall 33. The first lower tape regulating portions 381B and 382B each protrude slightly in the upward direction from the upper surface of the bottom wall 306. The first lower tape regulating portions 381B and 382B each extend toward the forward direction to reach the lower arm front wall 352. In addition, a separating wall regulating portion 383 that restricts the movement of the tape in the upward direction is provided on an upper end of the left end of the separating wall 33. The separating wall regulating portion 383 is a protruding piece that protrudes from the upper end of the separating wall 33 in the forward direction. A distance in the vertical direction between the first lower tape regulating portions 381B and 382B and the separating wall regulating portion 383 is the same as the width of the tape.

On the feed path of the ink ribbon 60, first lower ribbon regulating portions 386B and 387B that restrict the movement of the ink ribbon 60 in the downward direction are provided, respectively, on a lower end portion of the left end of the separating wall 33 and a lower end portion of the right end of the separating wall 33. The first lower ribbon regulating portions 386B and 387B each protrude slightly in the upward direction from the upper surface of the bottom wall 306. The first lower ribbon regulating portion 386B extends diagonally backward left from the left end of the separating wall 33 to reach a left end of the lower arm rear wall 372. The first lower ribbon regulating portion 387B extends backward from the right end of the separating wall 33 to reach the lower arm rear wall 372.

The height positions of the first lower tape regulating portions 381B and 382B, the separating wall regulating portion 383 and the first lower ribbon regulating portions 386B and 387B in the vertical direction of the bottom case 312 are respectively set with respect to the above-described first and second lower flat surfaces 391B and 392B of the support receiving portions 391 and 392 as reference surfaces.

More specifically, a distance in the vertical direction between protruding ends (top ends) of the first lower tape regulating portions 381B and 382B and the first and second lower flat surfaces 391B and 392B is set in accordance with the tape width. A distance in the vertical direction between a bottom end of the separating wall regulating portion 383 and the first and second lower flat surfaces 391B and 392B is also set in accordance with the tape width. A distance in the vertical direction between protruding ends of the first lower ribbon regulating portions 386B and 387B and the first and second lower flat surfaces 391B and 392B is set in accordance with the width of the ink ribbon 60. All of the above-described regulating portions are provided inside the arm portion 34, and the first and second lower flat surfaces 391B and 392B are in the vicinity of the upstream end and the downstream end of the head insertion portion 39, respectively. In other words, each of the regulating portions is in the vicinity of the first and second lower flat surfaces 391B and 392B used as the reference surfaces.

When a dimension setting of the regulating portions and a dimension measurement after manufacture is performed, a reference point position used in known art (for example, ceiling wall portions of the pin holes 62 and 63) is far from the regulating portions, and thus the reference point position and the regulating portion are sometimes formed using different mold blocks. In such a case, the further away the block of the reference position is from the regulating portion, the greater a dimensional error of the regulating portion of the manufactured tape cassette. Furthermore, even when the reference point position and the regulating portion are formed using the same block, when the reference position and the regulating portion are in separated positions, a measurement error may also occur and a dimensional accuracy may deteriorate. On the other hand, as in the first embodiment, when the distance between the regulating portion and the reference surface is shorter, the measurement error may be less likely to occur. In addition, it may also be more likely that both the regulating portion and the reference surface can be formed with the same block.

Figure 23:
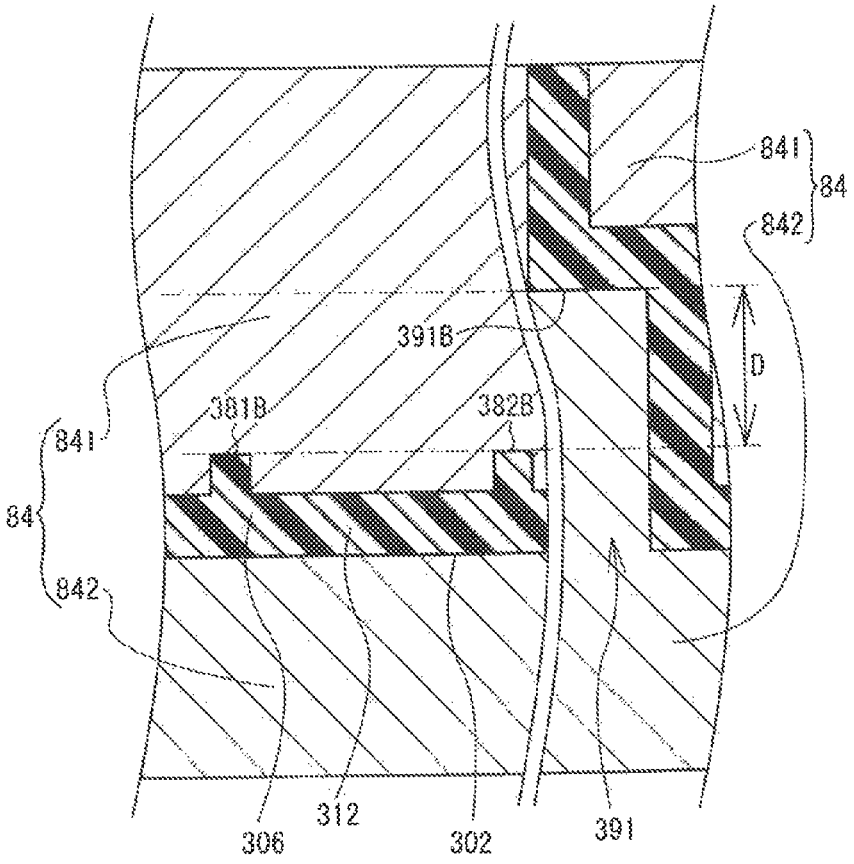
FIG. 23 is a diagram showing a cross section along a IV-IV line shown in FIG. 20 as seen in the direction of the arrows, when the bottom case 312 is manufactured, and also showing a cross section of a mold block 84.

Forming of the regulating portion and the reference surface using a same mold block 84 will be explained below with reference to FIG. 23. Note that, in FIG. 23, some parts that are not needed for explanation are omitted. For example, the first cylindrical member 861 etc. is not shown. As shown in FIG. 23, when manufacturing the bottom case 312, the first lower flat surface 391B and the first lower tape regulating portions 381B and 382B can be manufactured using the same mold block 84. Note that the first lower ribbon regulating portions 386B and 387B and the second lower flat surface 392B can also be manufactured using the same mold block 84, but illustration is omitted.

The mold block 84 includes an upper insert 841 and a lower insert 842. The bottom surface 302 of the bottom case 312, and the first and second lower flat surfaces 391B and 392B are molded by the lower insert 842. Further, the first lower tape regulating portions 381B and 382B and the first lower ribbon regulating portions 386B and 387B are molded by the upper insert 841.

In this way, the first and second lower flat surfaces 391B and 392B, the first lower tape regulating portions 381B and 382B and the first lower ribbon regulating portions 386B and 387B can be molded using the same mold block 84 including the upper insert 841 and the lower insert 842. As a result, a dimensional accuracy can be improved, compared to a case in which the first and second lower flat surfaces 391B and 392B, the first lower tape regulating portions 381B and 382B and the first lower ribbon regulating portions 386B and 387B are molded using separate blocks. Furthermore, as the regulating portions and the reference surfaces are in mutually proximal positions, there may be fewer measurement errors and a dimensional accuracy may be thus improved.

As a consequence, a feeding accuracy of the tape and the ink ribbon 60 may be improved. As the arm portion 34 is in the vicinity of the upstream side of a position at which printing is performed by the thermal head 10, that is, the opening 77 (refer to FIG. 5), by improving the feeding accuracy of the tape and the ink ribbon 60 inside the arm portion 34, a printing accuracy may also be improved.

In addition, after manufacture, a dimensional control of each of the regulating portions may be performed with ease, using the first and second lower flat surfaces 391B and 392B as the reference surfaces. For example, when carrying out product inspection on the tape cassette 30, the first and second lower flat surfaces 391B and 392B, which are the reference surfaces, may be placed on mounting surfaces of a jig and the dimension of each of the regulating portions may be measured. At this time, because each of the regulating portions and the reference surfaces is closer to each other than in the known art, a product inspector can measure dimensions accurately. For example, in the case of the tape cassette 30 molded by the mold block 84 shown in FIG. 23, the first lower flat surface 391B of the bottom case 312 after molding is placed on the mounting surface of the jig. Then, a distance D between the first lower flat surface 391B and the first lower tape regulating portions 381B and 382B in the vertical direction may be accurately measured.

The first and second lower flat surfaces 391B and 392B are spaced at a predetermined distance in the vertical direction from a center position in the width direction of the tape and the ink ribbon 60 housed in the cassette case 31. Accordingly, the vertical position of the tape and the ink ribbon 60 with respect to the vertical position of the first and second lower flat surfaces 391B and 392B may become clearer, and the feeding accuracy of the tape and the ink ribbon 60 may further be improved.

Furthermore, in the first embodiment, a distance between a center position in the width direction of the tape and the ink ribbon 60 and the first and second lower flat surfaces 391B and 392B is constant, regardless of the width of the tape and the ink ribbon 60. Accordingly, in the tape cassettes 30 that respectively house a plurality of types of the tapes and the ink ribbons 60 that have various widths, the position of the first and second lower flat surfaces 391B and 392B can be used as a uniform reference, and the dimensional measurement of the cassette case 31 and a control of parts may thus be made easy.

In addition, each of the regulating portions inside the arm portion 34 is positioned between the first and second lower flat surfaces 391B and 392B in the left-and-right direction of the bottom case 312, and are in the vicinity of both the reference surfaces. Therefore, either of the reference surfaces may be used for the dimension setting and the dimensional measurement. Alternatively, both the reference surfaces may be used for the dimension setting and the dimensional measurement. By using both the reference surfaces, the dimensional accuracy may be further improved at the time of manufacture of each of the regulating portions. Consequently, the feeding accuracy of the tape and the ink ribbon 60 may further be improved. In addition, after manufacture, the dimensional control can be performed more accurately and more easily.

As shown in FIG. 20, a guide pin 327 is provided in the vicinity of the third corner portion 323 further upstream from the arm portion 34 in the tape feed direction. The guide pin 327 is provided with a regulating portion 384B that restricts the movement of the tape in the downward direction, similarly to the first lower tape regulating portions 381B and 382B. Similarly to the first lower tape regulating portions 381B and 382B, a dimension setting and a dimensional control of the regulating portion 384B may also be performed using the first lower flat surface 391B of the first support receiving portion 391 as the reference surface.

A second lower tape regulating portion 363 that restricts the movement of the tape in the downward direction is provided on a base portion of the regulating member 362, which is provided in the bottom case 312 adjacent to the downstream end of the head insertion portion 39. A height position of the second lower tape regulating portion 363 in the vertical direction of the bottom case 312 is set based on the second lower flat surface 392B as the reference surface. More specifically, a distance between a protruding end (top end) of the second lower tape regulating portion 363 and the second lower flat surface 392B in the vertical direction is set in accordance with the tape width. The second lower flat surface 392B is in the second support receiving portion 392, which is also adjacent to the downstream end of the head insertion portion 39. Accordingly, by using the second lower flat surface 392B as the reference surface, the dimensional accuracy may be improved at the time of manufacture of the second lower tape regulating portion 363, and after manufacture, the dimensional control may be performed easily.

In the first embodiment, the distance between the protruding end of the second lower tape regulating portion 363 and the second lower flat surface 392B is the same as the distance between the protruding ends of the first lower tape regulating portions 381B and 382B and the first and second lower flat surfaces 391B and 392B. In other words, the height position of the second lower tape regulating portion 363 provided on the regulating member 362 is the same as the height position of the first lower tape regulating portions 381B and 382B provided in the arm portion 34. As a consequence, the movement of the tape may be restricted in the downward direction by each of the regulating portions, and positioning in the vertical direction may thus be correctly performed. As a result, the tape may be accurately fed from the arm portion 34 to the regulating member 362 in parallel with a center line in the width direction of the tape.

Next, sections of the bottom case 312 that form respective parts of the first and second corner portions 321 and 322, and housing areas of the tape and the ink ribbon 60 will be explained in more detail. As shown in FIG. 20 and FIG. 21, the bottom case 312 includes a third lower flat surface 321B that is the lower surface of the first corner portion 321, and a fourth lower flat surface 322B that is the lower surface of the second corner portion 322. The third lower flat surface 321B and the fourth lower flat surface 322B are both flat surfaces that are positioned above the bottom surface 302.

A distance in the vertical direction (height direction) of the bottom case 312 between the positions of the third and fourth lower flat surfaces 321B and 322B, and the center position of the tape and the ink ribbon 60 in the width direction is constant, regardless of the type of the tape cassette 30. Namely, the distance is constant even when the height in the vertical direction of the tape cassette 30 differs. Accordingly, the greater the width of the tape and the ink ribbon 60 housed in the tape cassette 30, the greater the distance from the bottom surface 302 to the third and fourth lower flat surfaces 321B and 322B.

In the first embodiment, the above-described first and second lower flat surfaces 391B and 392B and the third and fourth lower flat surfaces 321B and 322B are at positions that are separated by the same distance in the vertical direction from the center position in the width direction of the tape and the ink ribbon 60 (in the first embodiment, a center position in the vertical direction of the cassette case 31). In other words, the first, second, third and fourth lower flat surfaces 391B, 392B, 321B and 322B are all at the same height position in the bottom case 312. The third and fourth lower flat surfaces 321B and 322B are used as reference surfaces for the regulating portions that restrict the movements of the tape and the ink ribbon 60 in the downward direction.

The bottom case 312 includes a first lower tape area 400B that forms a part of the first tape area 400, a second lower tape area 410B that forms a part of the second tape area 410, a first lower ribbon area 420B that forms a part of the first ribbon area 420 and a second lower ribbon area 440B that forms a part of the second ribbon area 440.

A third cylindrical member 863 is standing on a rear surface of the third lower flat surface 321B, namely, on the inner surface side of the bottom case 312. More specifically, the third cylindrical member 863 is provided above the third lower flat surface 321B in a direction perpendicular to the third lower flat surface 321B. On the left rear side of the first lower tape area 400B, the third cylindrical member 863 is in contact with a first peripheral wall 70. The structure of the third cylindrical member 863 is the same as that of the above-described first cylindrical member 861 (refer to FIG. 22). The first peripheral wall 70 is a wall that extends along the first lower tape area 400B. The first peripheral wall 70 is provided in a circular arc shape in a plan view, extending from slightly to the left of the rear side of the first lower tape area 400B to slightly to the rear of the left side of the first lower tape area 400B. The third cylindrical member 863 engages with a third insertion pin 873 (refer to FIG. 25) to form a third fitting portion 883, which will be explained in more detail later.

A fourth cylindrical member 864 is standing on a rear surface of the fourth lower flat surface 322B, namely, the inner surface side of the bottom case 312. More specifically, the fourth cylindrical member 863 is provided above the fourth lower flat surface 322B in a direction perpendicular to the fourth lower flat surface 322B. Further, the fourth cylindrical member 864 is provided to the rear right of the second lower tape area 410B and is in contact with a second peripheral wall 71. The structure of the fourth cylindrical member 864 is the same as that of the above-described first cylindrical member 861 (refer to FIG. 22). The second peripheral wall 71 is provided in a circular arc shape in a plan view, extending from the left side of the second lower tape area 410B through the rear side as far as the right front side along the second lower tape area 410B. The fourth cylindrical member 864 engages with a fourth insertion pin 874 (refer to FIG. 25) to form a fourth fitting portion 884, which will be explained in more detail later.

Protruding portions are provided in the first lower tape area 400B such that they protrude slightly upward from the upper surface of the bottom wall 306. More specifically, a ring-shaped protruding portion is provided in a center position of the first lower tape area 400B in which the first tape spool 40 is to be housed. In addition, three line-shaped protruding portions radially extend from the ring-shaped protruding portion to the peripheral edge of the first lower tape area 400B. These protruding portions are collectively referred to as a third lower tape regulating portion 40B. The third lower tape regulating portion 40B restricts the movement in the downward direction of the heat-sensitive paper tape 55, the print tape 57 and the double-sided adhesive tape 58 (refer to FIG. 5 to FIG. 8), which are wound on the first tape spool 40 and housed in the first tape area 400.

The height position of the third lower tape regulating portion 40B in the vertical direction of the bottom case 312 is set using the adjacent third lower flat surface 321B of the first corner portion 321 as the reference surface. More specifically, a distance in the vertical direction between a protruding end (top end) of the third lower tape regulating portion 40B and the third lower flat surface 321B is set in accordance with the width of the tape. Accordingly, by using the third lower flat surface 321B as the reference surface, the dimensional accuracy at the time of manufacture of the third lower tape regulating portion 40B may be improved, and after manufacture, the dimensional control may be performed easily.

In the first embodiment, the distance in the vertical direction between the protruding end of the third lower tape regulating portion 40B and the third lower flat surface 321B is the same as the distance between the protruding ends of the first lower tape regulating portions 381B and 382B and the first and second lower flat surfaces 391B and 392B, and is also the same as the distance between the protruding end of the second lower tape regulating portion 363 and the first and second lower flat surfaces 391B and 392B. In other words, the height position of the third lower tape regulating portion 40B provided in the first lower tape area 400B is the same as the height position of the first lower tape regulating portions 381B and 382B provided in the arm portion 34, and is also the same as the height position of the second lower tape regulating portion 363 provided on the regulating member 362.

As a consequence, the movement of the tape is restricted in the downward direction by each of the regulating portions, and positioning in the vertical direction is correctly performed while the tape is fed. In the case of the receptor type and thermal type tape cassette 30 shown in FIG. 7 and FIG. 8, the print tape 57 or the heat-sensitive paper tape 55 may accurately be fed in parallel with the center line in the tape width direction, from the first tape area 400 through the arm portion 34 to the regulating member 362. In the case of the laminated type tape cassette 30 shown in FIG. 5 and FIG. 6, the film tape 59 may accurately be fed in parallel with the center line in the tape width direction from the arm portion 34 to the regulating member 362. Further, the double-side adhesive tape 58 and the film tape 59 may accurately be fed in a state in which their positions match in the vertical direction.

The feed path for the used ink ribbon 60 extends from a rear end of the ribbon guide wall 47 positioned on the downstream end of the head insertion portion 39 to the second lower ribbon area 440B. A partition wall 48 is provided between the feed path for the used ink ribbon 60 and the first lower tape area 400B, along the outer periphery of the first lower tape area 400B. The partition wall 48 prevents mutual contact between the used ink ribbon 60 and the double-sided adhesive tape 58 that is wound on the first tape spool 40.

A second lower ribbon regulating portion 388B that restricts the movement of the ink ribbon 60 in the downward direction is provided on the rear end of the ribbon guide wall 47. The second lower ribbon regulating portion 388B protrudes slightly upward from the upper surface of the bottom wall 306, and extends in the rearward direction to a position in front of the first lower tape area 400B.

The height position of the second lower ribbon regulating portion 388B in the vertical direction of the bottom case 312 is set using as the reference surface the second lower flat surface 392B of the second support receiving portion 392 that is adjacent to the downstream end of the head insertion portion 39. More specifically, a distance in the vertical direction between a protruding end (top end) of the second lower ribbon regulating portion 388B and the second lower flat surface 392B is set in accordance with the width of the ink ribbon 60. Accordingly, by using the second lower flat surface 392B as the reference surface, the dimensional accuracy at the time of manufacture of the second lower ribbon regulating portion 388B may be improved, and after manufacture, the dimensional control may be performed easily.

In the first embodiment, the distance in the vertical direction between the protruding end of the second lower ribbon regulating portion 388B and the second lower flat surface 392B is the same as the distance between the protruding ends of the first lower ribbon regulating portions 386B and 387B and the first and second lower flat surfaces 391B and 392B. In other words, the height position of the second lower ribbon regulating portion 388B provided on the rear end of the ribbon guide wall 47 is the same as the height position of the first lower ribbon regulating portions 386B and 387B provided in the arm portion 34. As a consequence, the movement of the ink ribbon 60 may be restricted in the downward direction by each of the regulating portions, and positioning in the vertical direction may be correctly performed. As a result, the ink ribbon 60 may be accurately fed from the arm portion 34 to the rear end of the ribbon guide wall 47 in parallel with a center line in the width direction of the ink ribbon 60.

Similarly to the first lower tape area 400B, protruding portions are provided in the second lower tape area 410B such that they protrude slightly upward from the upper surface of the bottom wall 306. More specifically, a ring-shaped protruding portion is provided in a center position of the second lower tape area 410B in which the second tape spool 41 is to be housed, and eight line-shaped protruding portions radially extend from the ring-shaped protruding portion to the peripheral edge of the second lower tape area 410B. These protruding portions are collectively referred to as a fourth lower tape regulating portion 41B. The fourth lower tape regulating portion 41B restricts the movement in the downward direction of the film tape 59 that is wound on the second tape spool 41 and housed in the second tape area 410 in the laminated type tape cassette 30 (refer to FIG. 5 and FIG. 6).

The height position of the fourth lower tape regulating portion 41B in the vertical direction of the bottom case 312 is set using the adjacent fourth lower flat surface 322B of the second corner portion 322 as the reference surface. More specifically, a distance in the vertical direction between a protruding end (top ends) of the fourth lower tape regulating portion 41B and the fourth lower flat surface 322B is set in accordance with the width of the tape. Accordingly, by using the fourth lower flat surface 322B as the reference surface, the dimensional accuracy at the time of manufacture of the fourth lower tape regulating portion 41B may be improved, and after manufacture, the dimensional control may be performed easily.

In the first embodiment, the distance between the protruding end of the fourth lower tape regulating portion 41B and the fourth lower flat surface 322B is the same as the distance in the vertical direction between the protruding ends of the first lower tape regulating portions 381B and 382B and the first and second lower flat surfaces 391B and 392B, and is also the same as the distance in the vertical direction between the protruding end of the second lower tape regulating portion 363 and the first and second lower flat surfaces 391B and 392B. Further, it is also the same as the distance in the vertical direction between the protruding end of the third lower tape regulating portion 40B and the third lower flat surface 321B. In other words, the height position of the fourth lower tape regulating portion 41B provided in the second lower tape area 410B is the same as the height position of the first lower tape regulating portions 381B and 382B provided in the arm portion 34, the same as the height position of the second lower tape regulating portion 363 provided on the regulating member 362, and the same as the height position of the third lower tape regulating portion 40B provided in the first lower tape area 400B.

As a consequence, the movement of the tape may be restricted in the downward direction by each of the regulating portions, and the tape may be fed while being positioned correctly in the vertical direction. In the case of the laminated type tape cassette 30 shown in FIG. 5 and FIG. 6, the film tape 59 may accurately be fed in parallel with the center line in the tape width direction from the second tape area 410 through the arm portion 34 to the regulating member 362. Further, the double-side adhesive tape 58 and the film tape 59 may accurately be fed in a state in which their positions match in the vertical direction.

A protruding portion is provided in the first lower ribbon area 420B such that it protrudes slightly upward from the upper surface of the bottom wall 306. More specifically, a ring-shaped protruding portion is provided in a center position of the second lower tape area 410B in which the second tape spool 41 is to be housed. This protruding portion is referred to as a third lower ribbon regulating portion 42B. The third lower ribbon regulating portion 42B restricts the movement in the downward direction of the unused ink ribbon 60 (refer to FIG. 5 to FIG. 7) that is wound on the ribbon spool 42 and housed in the first ribbon area 420.

The height position of the third lower ribbon regulating portion 42B in the vertical direction of the bottom case 312 is set using the adjacent first lower flat surface 391B of the first support receiving portion 391 as the reference surface. More specifically, a distance in the vertical direction between a protruding end (top end) of the third lower ribbon regulating portion 42B and the first lower flat surface 391B is set in accordance with the width of the ink ribbon 60. Accordingly, by using the first lower flat surface 391B as the reference surface, the dimensional accuracy at the time of manufacture of the third lower ribbon regulating portion 42B may be improved, and after manufacture, the dimensional control may be performed easily.

In the first embodiment, the distance between the protruding end of the third lower ribbon regulating portion 42B and the first lower flat surface 391B is the same as the distance in the vertical direction between the protruding ends of the first lower ribbon regulating portions 386B and 387B and the first and second lower flat surfaces 391B and 392B, and is also the same as the distance in the vertical direction between the protruding end of the second lower ribbon regulating portion 388B and the first and second lower flat surfaces 391B and 392B. In other words, the height position of the third lower ribbon regulating portion 42B provided in the first lower ribbon area 420B is the same as the height position of the first lower ribbon regulating portions 386B and 387B provided in the arm portion 34, and the same as the height position of the second lower ribbon regulating portion 388B provided on the rear end of the ribbon guide wall 47.

As a consequence, the movement of the ink ribbon 60 may be restricted in the downward direction by each of the regulating portions, and the ink ribbon 60 is fed while being positioned correctly in the vertical direction. Thus, the ink ribbon 60 may accurately be fed in parallel with the center line in the width direction of the ink ribbon 60 from the first ribbon area 420 through the arm portion 34 to the ribbon guide wall 47.

Next, the structure of the top case 311 will be explained with reference to FIG. 19 and FIG. 24 to FIG. 26. As shown in FIG. 19, the periphery of the top case 311 is formed by the top surface 301 and an upper peripheral wall 303. The upper peripheral wall 303 extends in the downward direction at a predetermined height from the top wall 305 that forms the top surface 301. Of the upper peripheral walls 303, a section that forms an upper portion of the arm front wall 35 is referred to as an upper arm front wall 351. Further, a wall that forms an upper portion of the arm rear wall 37 is referred to as an upper arm rear wall 371. The upper arm rear wall 371 extends from the top wall 305 and is separated in the rearward direction from the upper arm front wall 351. A peripheral wall that is contiguous to the upper arm rear wall 371 and that defines an upper portion of the head insertion portion 39 is referred to as an upper head peripheral wall 374.

Figure 24:
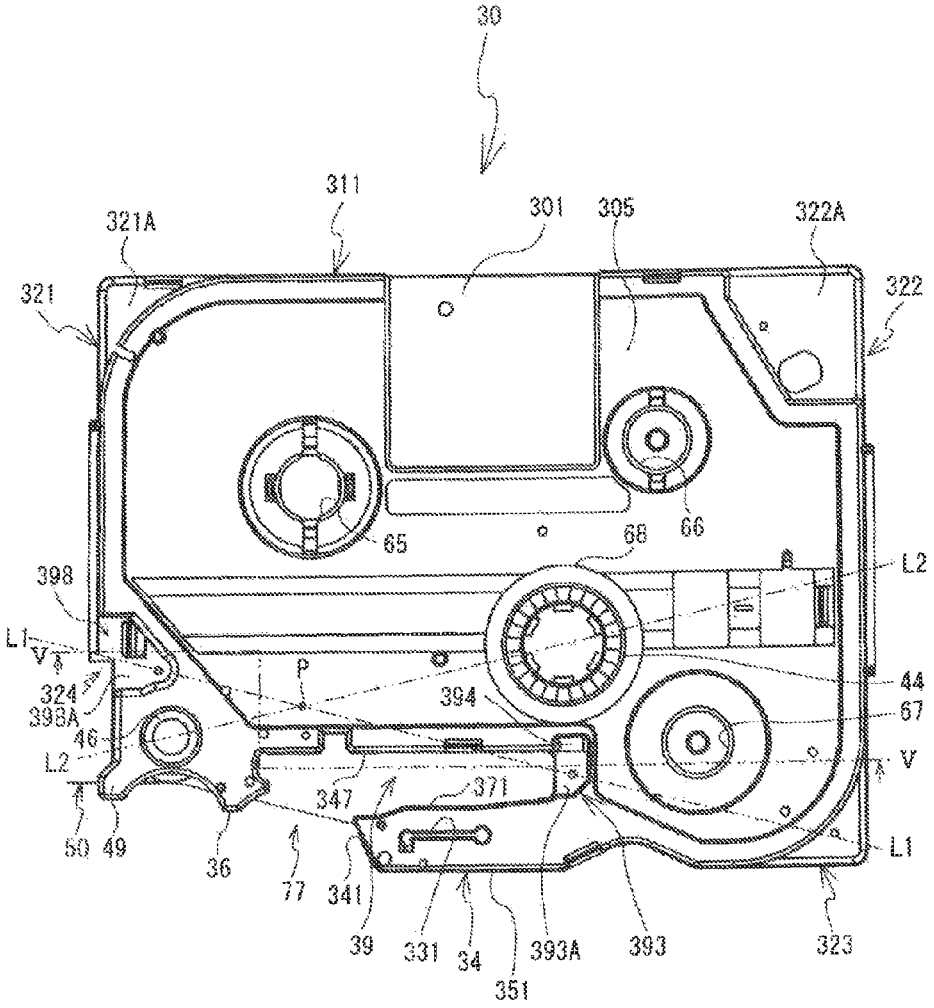
FIG. 24 is a plan view of the tape cassette 30.
Figure 25:
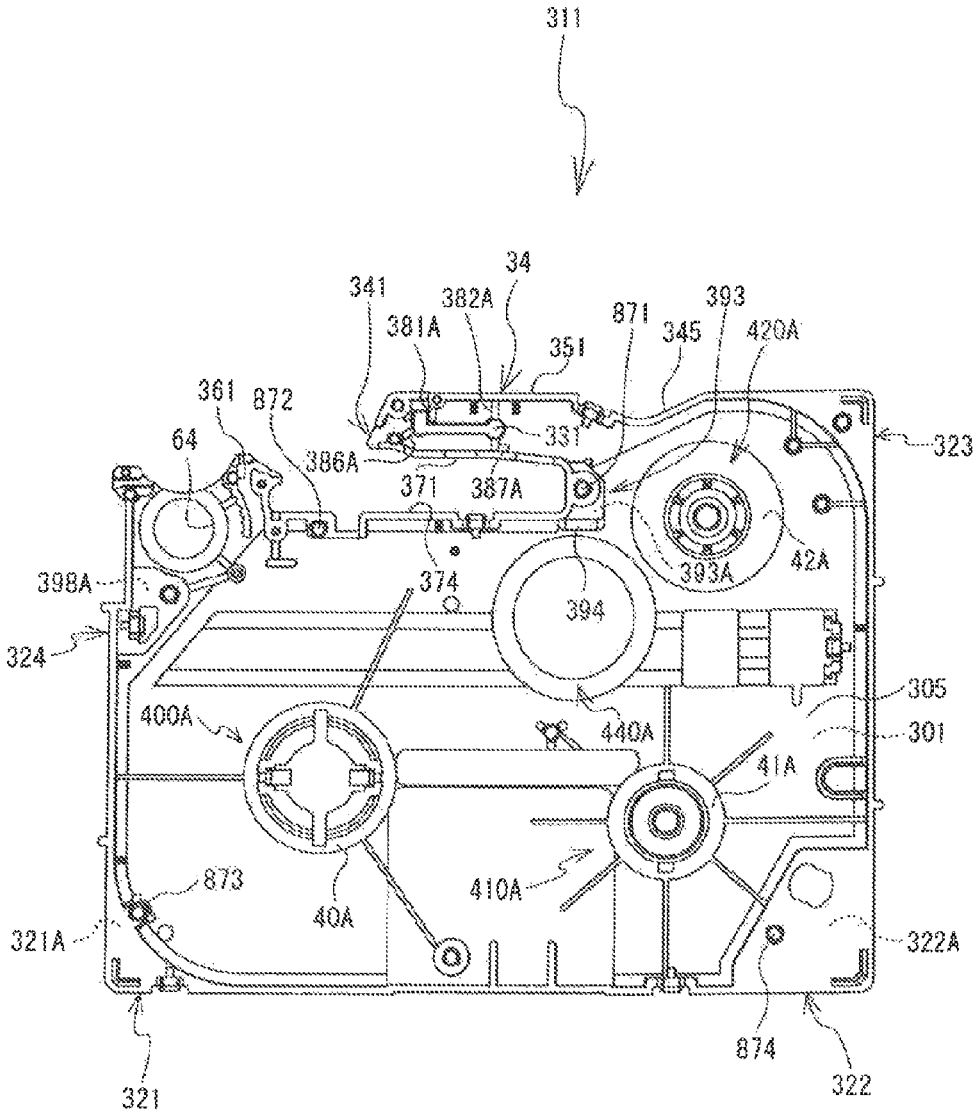
FIG. 25 is a bottom view of a top case 311.

The structure around the head insertion portion 39 in the top case 311 will be explained in more detail. As shown in FIG. 24 and FIG. 25, the first press receiving portion 393 (refer to FIG. 16) is connected to the upstream side end in the tape feed direction of the head insertion portion 39 of the top case 311. The first press receiving portion 393 is an indentation that extends from the top surface 301 toward the bottom surface 302. The first press receiving portion 393 is located at a position such that the first press receiving portion 393 overlaps with the first support receiving portion 391 in the vertical direction when the bottom case 312 and the top case 311 are joined together. The first press receiving portion 393 is an indentation formed by indenting downwardly a section of the top wall 305 connecting to a wall (the upper head peripheral wall 374) that defines the space of the head insertion portion 39. Similarly to the first support receiving portion 391 of the bottom case 312, the first press receiving portion 393 faces the head insertion portion 39 in the direction that is parallel to the arm front wall 35.

The first press receiving portion 393 has a first upper flat surface 393A. The first upper flat surface 393A is positioned below the top surface 301. The first upper flat surface 393A is an upper surface of a flat portion (a bottom wall portion of the indentation) that has a generally rectangular shape in a plan view. A distance in the vertical direction (the height direction) of the top case 311 between a position of the first upper flat surface 393A, and center positions in the width direction of the tape and the ink ribbon 60 housed in the cassette case 31 is constant, regardless of the type of the tape cassette 30. In other words, the distance is constant even when the height in the vertical direction of the tape cassette 30 is different. Accordingly, the greater the width of the tape and the ink ribbon 60 housed in the tape cassette 30, the greater the depth of the indentation of the first press receiving portion 393 provided in the top surface 301.

The first upper flat surface 393A is the reference surface of the top case 311. In the first embodiment, the first upper flat surface 393A is used as a reference surface for various regulating portions (to be described later) that restrict the movement of the tape and the ink ribbon 60 in the upward direction. Furthermore, when the tape cassette 30 is installed in the cassette housing portion 8 and the cassette cover 6 of the tape printer 1 is closed, the first upper flat surface 393A functions as a portion that is pressed from above by the head pressing member 7.

The first lower flat surface 391B of the first support receiving portion 391 provided on the bottom case 312 is positioned directly below the first upper flat surface 393A of the first press receiving portion 393. Namely, the first upper flat surface 393A and the first lower flat surface 391B overlap each other in the vertical direction of the tape cassette 30. An inclined portion 394 is provided to the rear of the first upper flat surface 393A. The inclined portion 394 is a side surface of the first press receiving portion 393 that inclines in the rear upward direction from the rear end of the first upper flat surface 393A and extends to the top surface 301.

The first insertion pin 871, which protrudes downward, is provided on the first press receiving portion 393. More specifically, the first insertion pin 871 is provided below the first upper flat surface 393A in a direction perpendicular to the first upper flat surface 393A. Furthermore, the first insertion pin 871 is provided on the first upper flat surface 393A at a position facing the first cylindrical member 861 (refer to FIG. 20) provided above the first lower flat surface 391B of the bottom case 312. In addition, in the vicinity of the downstream side end of the head insertion portion 39 in the tape feed direction, the second insertion pin 872 protrudes downward, at a position facing the second cylindrical member 862 (refer to FIG. 20) provided above the second lower flat surface 392B of the bottom case 312.

Figure 26:
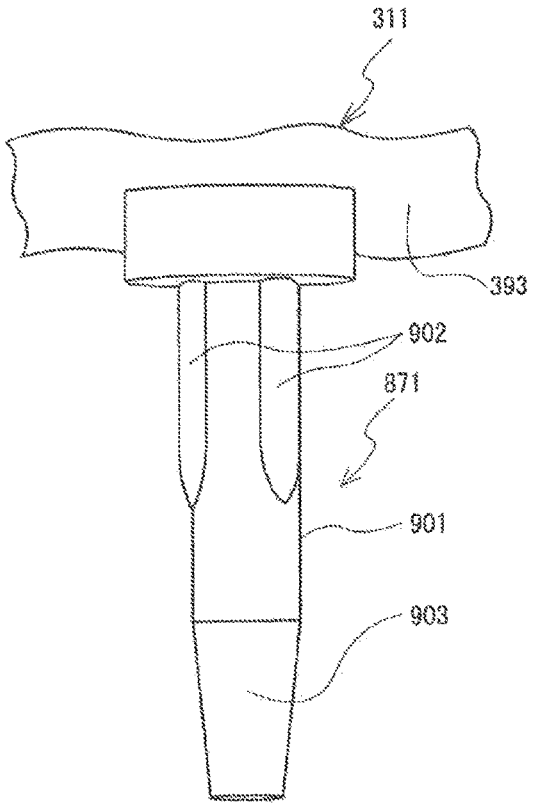
FIG. 26 is a perspective view of a first insertion pin 871.

The first insertion pin 871 and the second insertion pin 872 have the same structure. Therefore, the structure of the first insertion pin 871 will be explained with reference to FIG. 26, representing the structure of the first insertion pin 871 and the second insertion pin 872. Note that, as shown in FIG. 26, the first press receiving portion 393, on which the first insertion pin 871 is provided, has a cylindrical portion that protrudes in the downward direction. The cylindrical portion contacts with the upper end of the first cylindrical member 861, thereby determining the height of the tape cassette 30. However, depending on the locations at which the first insertion pin 871 and the other second to fourth insertion pins 872 to 874 (refer to FIG. 25) are provided, the cylindrical portion may not be needed. Further, the cylindrical portion may be formed as a different shape.

As shown in FIG. 26, the first insertion pin 871 has a pin body 901 and protruding members 902. The pin body 901 extends in the downward direction from the lower surface (the rear surface of the first upper flat surface 393A) of the first press receiving portion 393. The pin body 901 has a generally circular column shape and is formed such that its diameter gradually becomes smaller from a position slightly lower than a center in the vertical direction. Namely, a lower portion of the pin body 901 (hereinafter referred to as an end portion 903) is formed such that the diameter becomes smaller toward its leading end. The diameter of the bottom surface of the end portion 903 is smaller than the diameter of the cylindrical hole 891 (refer to FIG. 22) provided on the first cylindrical member 861. As a result, the pin body 901 can be easily inserted into the cylindrical hole 891.

In addition, a plurality of the protruding members 902 are provided radially on the periphery of the pin body 901. The protruding members 902 are provided on the upper side of a general center of the pin body 901 in the vertical direction. The upper ends of the protruding members 902 are connected to the cylindrical portion formed on the first press receiving portion 393. Further, the protruding members 902 protrude from the pin body 901 in a circular arc shape in a plan view. The diameter of the first insertion pin 871 including the protruding members 902 is larger than the diameter of the cylindrical hole 891 (refer to FIG. 22) of the first cylindrical member 861.

A lower portion of each of the protruding members 902 is formed such that the diameter of the circular arc becomes gradually smaller toward the lower end. In other words, the lower portion of each of the protruding members 902 is formed such that the end becomes narrower. Thus, when the first insertion pin 871 is inserted into the cylindrical hole 891 of the first cylindrical member 861, the lower portions of the protruding members 902 may not be caught on the top surface of the first cylindrical member 861, and the first insertion pin 871 may be inserted smoothly. The fitting mode between first insertion pin 871 and the first cylindrical member 861 will be explained in more detail later.

Next, the second press receiving portion 398 provided in the top case 311 will be described below. The tape cassette 30 includes movable components that are driven to rotate when the tape printer 1 performs printing. The movable components of the tape cassette 30 are portions where vibrations are likely to be generated during printing. In the first embodiment, the tape drive roller 46 and the ribbon take-up spool 44 are the movable components. Accordingly, as shown in FIG. 19 and FIG. 24, the first press receiving portion 393 is provided in the vicinity of the ribbon take-up spool 44. In addition, the second press receiving portion 398, which is another press receiving portion, is provided in the vicinity of the tape drive roller 46. When the tape cassette 30 is installed in the cassette housing portion 8, the second press receiving portion 398 contacts with the periphery pressing member 914 and is pressed from above by the periphery pressing member 914.

Similarly to the first press receiving portion 393, the second press receiving portion 398 is an indentation formed by indenting a section of the top wall 305 downwardly. The second press receiving portion 398 corresponds to an upper portion of the fourth corner portion 324 located at the front left of the tape cassette 30. To the front (lower side in FIG. 24) of the second press receiving portion 398, the support hole 64 is provided in the vicinity of the second press receiving portion 398. The support hole 64 rotatably supports the tape drive roller 46. The second press receiving portion 398 includes a flat surface 398A, which is the upper surface of the fourth corner portion 324.

In the first embodiment, the flat surface 398A of the second press receiving portion 398 and the first upper flat surface 393A of the first press receiving portion 393 are located at the same height position in the vertical direction of the top case 311. Accordingly, a distance in the vertical direction from the height position of the flat surface 398A and the first upper flat surface 393A to the center position in the width direction of the tape and the ink ribbon 60 housed in the cassette case 31 is constant, regardless of the type of the tape cassette 30. In other words, the distance is constant for the tape cassettes 30 with various heights.

When the tape cassette 30 installed in the cassette housing portion 8 is seen in a plan view, the first press receiving portion 393 and the ribbon take-up spool 44 line up in the front-rear direction. In addition, the tape drive roller 46 and the second press receiving portion 398 line up in the front-rear direction. Therefore, a first imaginary line L1 connecting the first and second press receiving portions 393 and 398 intersects with a second imaginary line connecting the tape drive roller 46 and the ribbon take-up spool 44, that is, the movable components (refer to two-dotted lines in FIG. 24). Further, the thermal head 10 inserted in the head insertion portion 39 is positioned in the vicinity of an imaginary point P at which the first line L1 and the second line L2 intersect each other.

Pressing on the first and second press receiving portions 393 and 398 by the head pressing member 7 and the periphery pressing member 914 when the tape cassette 30 is installed in the cassette housing portion 8 and the cassette cover 6 is closed will be described later in detail.

Next, the structure of a section of the top case 311 that forms a part of the arm portion 34 will be explained in more detail. As shown in FIG. 19, the section of the top case 311 in the arm portion 34 included the upper arm front wall 351 and the upper arm rear wall 371 that correspond, respectively, to the lower arm front wall 352 and the lower arm rear wall 372. Accordingly, a height of the upper arm front wall 351 is greater than that of the upper arm rear wall 371. A fitting hole 331 is provided in the top wall 305 in a position corresponding to the separating wall 33 provided in the arm portion 34 of the bottom case 312. The fitting hole 331 has the same shape as the separating wall 33 in a plan view. When the top case 311 and the bottom case 312 are joined together, the separating wall 33 fits with the fitting hole 331.

In the section of the top case 311 in the arm portion 34, the tape feed path extends between the upper arm front wall 351 and the fitting hole 331. On the other hand, the ink ribbon 60 feed path extends between the fitting hole 331 and the upper arm rear wall 371. Regulating pieces that restrict the movements of the tape and the ink ribbon 60 in the upward direction are provided on these feed paths.

As shown in FIG. 25, on the tape feed path, a first upper tape regulating portion 381A is provided on a right side of a left end of the fitting hole 331. In addition, a first upper tape regulating portion 382A is provided in contact with a right end of the fitting hole 331. The first upper tape regulating portions 381A and 382A each protrude slightly downward from the lower surface of the top wall 305. The first upper tape regulating portion 381A extends from the upper arm front wall 351 toward the rear to the front of the fitting hole 331. The first upper tape regulating portion 382A extends from the upper arm front wall 351 toward the rear to the fitting hole 331. The first upper tape regulating portions 381A and 382A each restrict the movement of the tape in the upward direction.

On the ink ribbon 60 feed path, first upper ribbon regulating portions 386A and 387A that restrict the movement of the ink ribbon 60 in the upward direction are provided, respectively, in contact with the left end and the right end of the fitting hole 331. The first upper ribbon regulating portions 386A and 387A each protrude slightly downward from the lower surface of the top wall 305. The first upper ribbon regulating portion 386A extends diagonally backward left from the left end of the fitting hole 331 to the left end of the upper arm rear wall 371. The first upper ribbon regulating portion 387A extends rearwards from the right end of the fitting hole 331 to the upper arm rear wall 371.

The height positions of the first upper tape regulating portions 381A and 382A and of the first upper ribbon regulating portions 386A and 387A in the vertical direction of the top case 311 are set using the above-described first upper flat surface 393A of the first press receiving portion 393 as the reference surface.

More specifically, a distance in the vertical direction between protruding ends (lower ends) of the first upper tape regulating portions 381A and 382A and the first upper flat surface 393A is set in accordance with the tape width. A distance in the vertical direction between protruding ends of the first upper ribbon regulating portions 386A and 387A and the first upper flat surface 393A is set in accordance with the width of the ink ribbon 60. All of these regulating portions are provided inside the arm portion 34 and the first upper flat surface 393A is in the vicinity of the upstream side end of the head insertion portion 39. In other words, each of the regulating portions is in the vicinity of the first upper flat surface 393A that is the reference surface.

Accordingly, by using the first upper flat surface 393A as the reference surface, a dimensional accuracy at the time of manufacture of each of the regulating portions may be improved, and thus a feeding accuracy of the tape and the ink ribbon 60 may be improved. The arm portion 34 is in the vicinity of the upstream side of the position (the opening 77) at which printing is performed by the thermal head 10 (refer to FIG. 5). Therefore, by improving the feeding accuracy of the tape and the ink ribbon 60 inside the arm portion 34, a printing accuracy may also be improved. In the first embodiment, by providing this type of the regulating portions in the top case 311 in addition to the bottom case 312, the movements of the tape and the ink ribbon 60 may be restricted in both the upward and downward directions. As a result, the feeding accuracy and thus the printing accuracy may further be improved. In addition, using the first upper flat surface 393A as the reference surface, a dimensional control of each of the regulating portions may be easily performed after manufacture.

Further, the first upper flat surface 393A is spaced from the center position in the width direction of the tape by a predetermined distance in the vertical direction and the ink ribbon 60 housed in the cassette case 31. Accordingly, the vertical position of the tape and the ink ribbon 60 with respect to the vertical direction position of the first upper flat surface 393A becomes clearer, and the feeding accuracy of the tape and the ink ribbon 60 may further be improved.

Next, sections of the top case 311 that form a part of the first and second corner portions 321 and 322 and housing areas of the tape and the ink ribbon 60 will be explained in more detail. As shown in FIG. 24 and FIG. 25, the top case 311 includes a second upper flat surface 321A that is the upper surface of the first corner portion 321 and a third upper flat surface 322A that is the upper surface of the second corner portion 322. The second upper flat surface 321A and the third upper flat surface 322A are both flat surfaces that are positioned below the top surface 301. When the top case 311 and the bottom case 312 are joined together, the second upper flat surface 321A and the third upper flat surface 322A are respectively positioned to face the third lower flat surface 321B and the fourth lower flat surface 322B of the bottom case 312 in the vertical direction.

As shown in FIG. 25, the third insertion pin 873 that protrudes downward is provided in the first corner portion 321. More specifically, the third insertion pin 873 is provided below the second upper flat surface 321A in a direction perpendicular to the second upper flat surface 321A. Further, the third insertion pin 873 is provided below the second upper flat surface 321A in a position corresponding to the third cylindrical member 863 (refer to FIG. 20) provided above the third lower flat surface 321B of the bottom case 312. The structure of the third insertion pin 873 is the same as that of the above-described first insertion pin 871 (refer to FIG. 26). As described above, the third fitting portion 883 is formed when the third cylindrical member 863 and the third insertion pin 873 are fitted with each other, and this will be explained in more detail later.

The fourth insertion pin 874 is provided in the second corner portion 322. More specifically, the fourth insertion pin 874 is provided below the third upper flat surface 322A in a direction perpendicular to the third upper flat surface 322A. Further, the fourth insertion pin 874 is provided below the third upper flat surface 322A in a position corresponding to the fourth cylindrical member 864 (refer to FIG. 20) provided above the fourth lower flat surface 322B of the bottom case 312. The structure of the fourth insertion pin 874 is the same as that of the above-described first insertion pin 871 (refer to FIG. 26). As described above, the fourth fitting portion 884 is formed when the fourth cylindrical member 864 and the fourth insertion pin 874 are fitted together, and this will be explained in more detail later.

A distance in the vertical direction (the height direction) of the top case 311 between positions of the second and third upper flat surfaces 321A and 322A and the center positions in the width direction of the tape and the ink ribbon 60 are constant, regardless of the type of the tape cassette 30. In other words, the distance is constant even when the height in the vertical direction of the tape cassette 30 is different. Accordingly, the greater the width of the tape and the ink ribbon 60 housed in the tape cassette 30, the greater the distance from the top surface 301 to the second and third upper flat surfaces 321A and 322A.

In the first embodiment, the above-described first upper flat surface 393A and the second and third upper flat surfaces 321A and 322A are spaced from the center position in the width direction of the tape and the ink ribbon 60 (in the first embodiment, the center position in the vertical direction of the cassette case 31) by the same distance in the vertical direction. In other words, the first, second and third upper flat surfaces 393A, 321A and 322A are all in the same height position in the top case 311. The second and third upper flat surfaces 321A and 322A are used as the reference surfaces for the regulating portions that restrict the movements of the tape and the ink ribbon 60 in the upward direction.

The top case 311 includes a first upper tape area 400A that is a portion of the first tape area 400, a second upper tape area 410A that is a portion of the second tape area 410, a first upper ribbon area 420A that is a portion of the first ribbon area 420 and a second upper ribbon area 440A that is a portion of the second ribbon area 440.

Protruding portions are provided on the first upper tape area 400A that protrude slightly downward from the lower surface of the top wall 305. More specifically, a ring-shaped protruding portion is provided in a center position of the first upper tape area 400A in which the first tape spool 40 is to be housed, and three line-shaped protruding portions radially extend from the ring-shaped protruding portion to the peripheral edge of the first upper tape area 400A. These protruding portions are collectively referred to as a second upper tape regulating portion 40A. The second upper tape regulating portion 40A restricts the movement in the upward direction of the heat-sensitive paper tape 55, the print tape 57 and the double-sided adhesive tape 58 (refer to FIG. 7 and FIG. 8), which are wound on the first tape spool 40 and housed in the first tape area 400.

The height position of the second upper tape regulating portion 40A in the vertical direction of the top case 311 is set using the adjacent second upper flat surface 321A of the first corner portion 321 as the reference surface. More specifically, a distance in the vertical direction between a protruding end of the second upper tape regulating portion 40A and the second upper flat surface 321A is set in accordance with the width of the tape. Accordingly, by using the second upper flat surface 321A as the reference surface, a dimensional accuracy at the time of manufacture of the second upper tape regulating portion 40A may be improved, and after manufacture, a dimensional control may be performed easily.

In the first embodiment, the distance between the protruding end of the second upper tape regulating portion 40A and the second upper flat surface 321A is the same as the distance in the vertical direction between the protruding ends of the first upper tape regulating portions 381A and 382A and the first upper flat surface 393A. In other words, the height position of the second upper tape regulating portion 40A provided in the first upper tape area 400A is the same as the height position of the first upper tape regulating portions 381A and 382A provided in the arm portion 34.

As a consequence, the movement of the tape is restricted in the upward direction by each of the regulating portions, and positioning in the vertical direction may be correctly performed while the tape is fed. In the case of the receptor type and thermal type tape cassette 30 shown in FIG. 7 and FIG. 8, the print tape 57 and the heat-sensitive paper tape 55 may be accurately fed in parallel with the center line in the tape width direction from the first tape area 400 to the arm portion 34. In the case of the laminated type tape cassette 30 shown in FIG. 5 and FIG. 6, the film tape 59 may be accurately fed in parallel with the center line in the tape width direction inside the arm portion 34. Further, the double-side adhesive tape 58 and the film tape 59 are accurately fed in a state in which their positions match in the vertical direction.

Similarly to the first upper tape area 400A, protruding portions are provided in the second upper tape area 410A such that they protrude slightly downward from the lower surface of the top wall 305. More specifically, a ring-shaped protruding portion is provided in a center position of the second upper tape area 410A in which the second tape spool 41 is to be housed, and eight line-shaped protruding portions extend radiating from the ring-shaped protruding portion to the peripheral edge of the second upper tape area 410A. These protruding portions are collectively referred to as a third upper tape regulating portion 41A. The third upper tape regulating portion 41A restricts the movement in the upward direction of the film tape 59 (refer to FIG. 5 and FIG. 6) that is wound on the second tape spool 41 and housed in the second tape area 410.

The height position of the third upper tape regulating portion 41A in the vertical direction of the top case 311 is set using the adjacent third upper flat surface 322A of the second corner portion 322 as the reference surface. More specifically, a distance in the vertical direction between a protruding end of the third upper tape regulating portion 41A and the third upper flat surface 322A is set in accordance with the width of the tape. Accordingly, by using the third upper flat surface 322A as the reference surface, a dimensional accuracy at the time of manufacture of the third upper tape regulating portion 41A may be improved, and after manufacture, a dimensional control may be performed easily.

In the first embodiment, the distance between the protruding end of the third upper tape regulating portion 41A and the third upper flat surface 322A is the same as the distance in the vertical direction between the protruding ends of the first upper tape regulating portions 381A and 382A and the first upper flat surface 393A, and is also the same as the distance in the vertical direction between the protruding ends of the second upper tape regulating portion 40A and the second upper flat surface 321A. In other words, the height position of the third upper tape regulating portion 41A provided in the second upper tape area 410A is the same as the height position of the first upper tape regulating portions 381A and 382A provided in the arm portion 34, and is the same as the height position of the second upper tape regulating portion 40A provided in the first upper tape area 400A.

As a consequence, the movement of the tape is restricted in the upward direction by each of the regulating portions, and the tape may be fed while being positioned correctly in the vertical direction. In the case of the laminated type tape cassette 30 shown in FIG. 5 and FIG. 6, the film tape 59 may be accurately fed in parallel with the center line in the tape width direction from the second tape area 410 to the arm portion 34. Further, the double-side adhesive tape 58 and the film tape 59 may be accurately fed in a state in which their positions match in the vertical direction.

A protruding portion is provided in the first upper ribbon area 420A such that it protrudes slightly downward from the lower surface of the top wall 305. More specifically, a ring-shaped protruding portion that is provided in a center position of the first upper ribbon area 420A, in which the ribbon spool 42 is to be housed, is referred to as a second upper ribbon regulating portion 42A. The second upper ribbon regulating portion 42A restricts the movement in the upward direction of the unused ink ribbon 60 (refer to FIG. 5 to FIG. 7) that is wound on the ribbon spool 42 and housed in the first ribbon area 420.

The height position of the second upper ribbon regulating portion 42A in the vertical direction of the top case 311 is set using the adjacent first upper flat surface 393A of the first press receiving portion 393 as the reference surface. More specifically, a distance in the vertical direction between a protruding end of the second upper ribbon regulating portion 42A and the first upper flat surface 393A is set in accordance with the width of the ink ribbon 60. Accordingly, by using the first upper flat surface 393A as the reference surface, a dimensional accuracy at the time of manufacture of the second upper ribbon regulating portion 42A may be improved, and after manufacture, a dimensional control may be performed easily.

In the first embodiment, the distance between the protruding end of the second upper ribbon regulating portion 42A and the first upper flat surface 393A is the same as the distance in the vertical direction between the protruding ends of the first upper ribbon regulating portions 386A and 387A and the first upper flat surface 393A. In other words, the height position of the second upper ribbon regulating portion 42A provided in the first upper ribbon area 420A is the same as the height position of the first upper ribbon regulating portions 386A and 387A provided in the arm portion 34.

As a consequence, the movement of the ink ribbon 60 may be restricted in the downward direction by each of the regulating portions, and the ink ribbon 60 may be fed while being positioned correctly in the vertical direction. Thus, the ink ribbon 60 may be accurately fed in parallel with the center line in the width direction of the ink ribbon 60 from the first ribbon area 420 to the arm portion 34.

Hereinafter, a method of joining together the top case 311 and the bottom case 312 of the tape cassette 30 according to the first embodiment will be explained with reference to FIG. 27 to FIG. 29. Note that FIG. 27 to FIG. 29 show an example of a fitting mode between the first cylindrical member 861 and the first insertion pin 871, but fitting modes between the second to fourth cylindrical members 862 to 864 and the second to fourth insertion pins 872 to 874 are the same as that shown.

Figure 27:
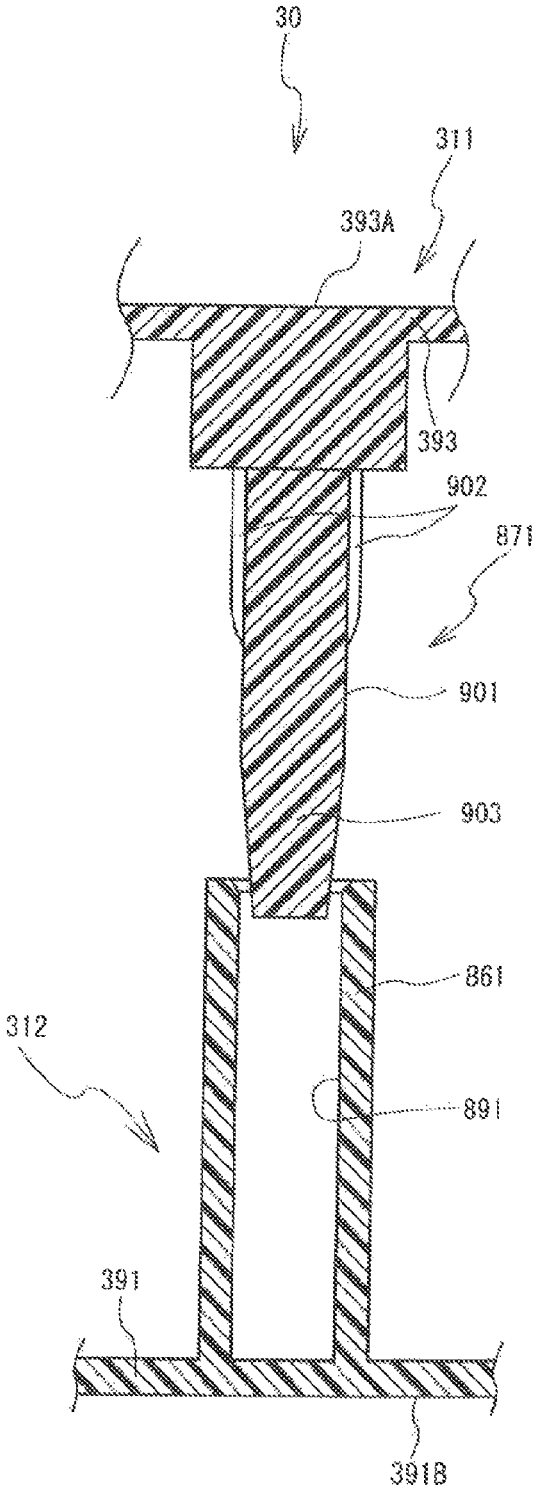
FIG. 27 is a longitudinal section view of the tape cassette 30 illustrating a degree of fit between the first cylindrical member 861 and the first insertion pin 871.

When the top case 311 and the bottom case 312 are joined together, first, the end portion 903 of the first insertion pin 871 is inserted into the cylindrical hole 891 of the first cylindrical member 861, as shown in FIG. 27. As described above, the diameter of the end portion 903 is smaller than the diameter of the cylindrical hole 891. Furthermore, the opening width of the cylindrical hole 891 is wider at its upper end. For that reason, the pin body 903 may be smoothly guided into the cylindrical hole 891. Then, the pin body 901 is inserted along the cylindrical hole 891.

Figure 28:
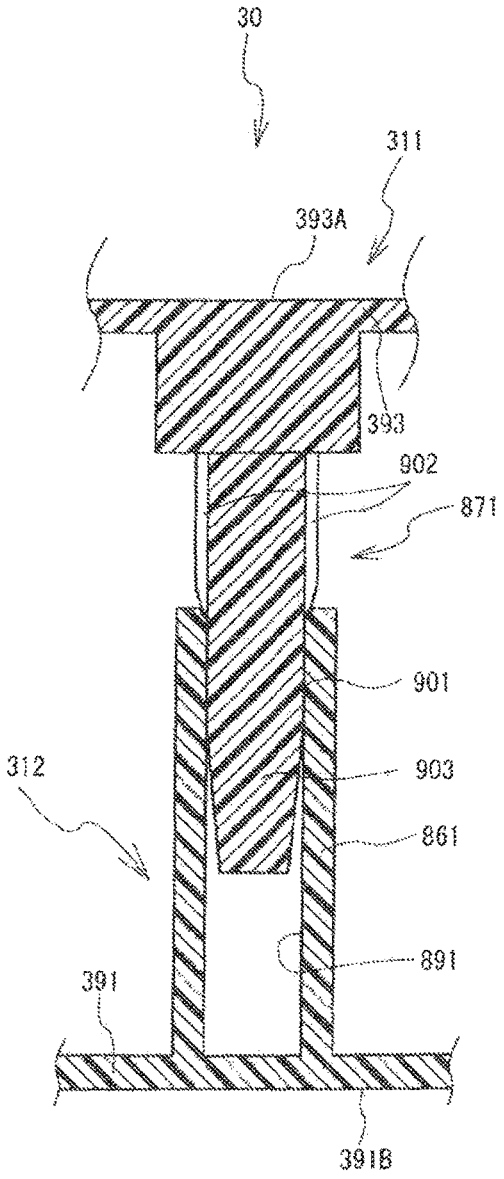
FIG. 28 is another longitudinal section view of the tape cassette 30 illustrating a degree of fit between the first cylindrical member 861 and the first insertion pin 871.
Figure 29:
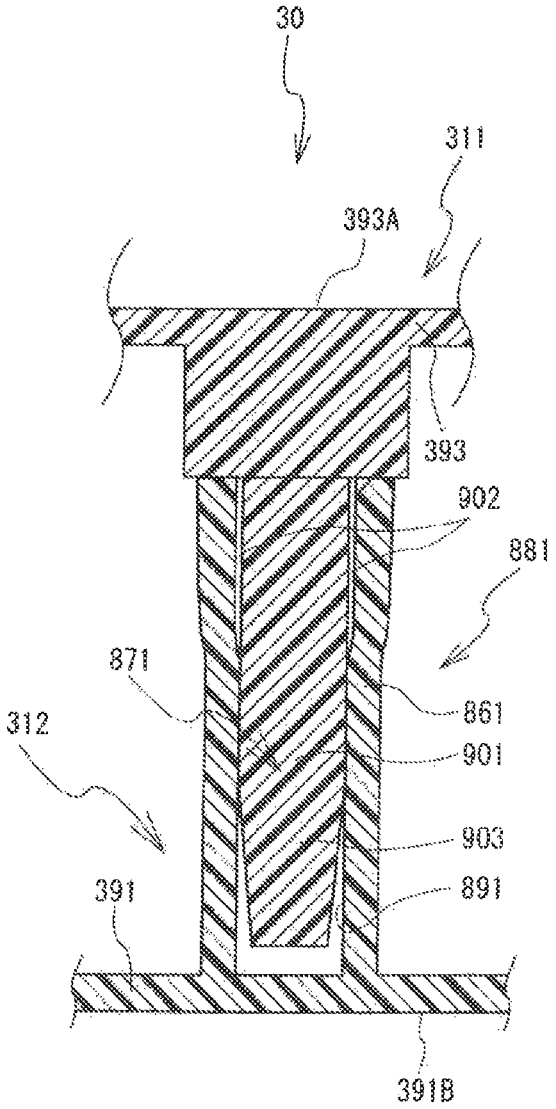
FIG. 29 is a longitudinal section view of the tape cassette 30 illustrating a state in which the first insertion pin 871 is fitted in the first cylindrical member 861.

Next, when the first insertion pin 871 is further inserted into the cylindrical hole 891 of the first cylindrical member 861, the protruding members 902 start to be inserted into the cylindrical hole 891, as shown in FIG. 28. As described above, the lower portion of each of the protruding members 902 is formed such that the end becomes narrower. Furthermore, the opening width of the cylindrical hole 891 is wider at its upper end. For that reason, the lower portions of the protruding members 902 may be smoothly inserted without being caught on the top surface of the first cylindrical member 861.

The diameter of the first insertion pin 871 that includes the protruding members 902 is larger than the diameter of the cylindrical hole 891. As a result, the first insertion pin 871 is inserted into the cylindrical hole 891 while the protruding members 902 are pressed and crushed by the first cylindrical member 861. As the first insertion pin 871 is inserted downwards into the cylindrical hole 891, the first cylindrical member 861 is pressed by the protruding members 902 and thus widened outwards.

As shown in FIG. 29, when the first insertion pin 871 is further inserted into the cylindrical hole 891, the top surface of the first cylindrical member 861 comes into contact with a cylindrical portion of the first press receiving portion 393 that is connected to a base end of the pin body 901. With this, the first insertion pin 871 is completely inserted into the cylindrical hole 891. At that time, the protruding members 902 are pressed and crushed by the first cylindrical member 861, and the first cylindrical member 861 is pressed by the protruding members 902 and widened outwards. In this way, the first insertion pin 871 is pressure-inserted into the first cylindrical member 861, and thus the first cylindrical member 861 and the first insertion pin 871 may be fitted firmly together. The first fitting portion 881 is thus formed.

Similarly, the second to fourth insertion pins 872 to 874 are also inserted into the second to fourth cylindrical portions 862 to 864, respectively, thus forming the second to fourth fitting portions 882 to 884 (refer to FIG. 20). The bottom case 312 and the top case 311 are joined together by the first to fourth fitting portions 881 to 884.

The first fitting portion 881 is provided above the first lower flat surface 391B as the reference surface in a direction perpendicular to the first lower flat surface 391B. Further, the first fitting portion 881 is provided between the first lower flat surface 391B and the first upper flat surface 393A. Thus, the top case 311 and the bottom case 312 may be appropriately joined together by the first fitting portion 881. As a result, the first lower flat surface 391B and the first upper flat surface 393A that are the reference surfaces may be respectively maintained in appropriate positions in the vertical direction. Thus, positions of the regulating portions that are provided in the vicinity of the first lower flat surface 391B and the first upper flat surface 393A may each be appropriately maintained, respectively. These regulating portions include the first lower tape regulating portions 381B and 382B, the separating wall regulating portion 383, the first lower ribbon regulating portions 386B and 387B, the third lower ribbon regulating portion 42B, the first upper tape regulating portions 381A and 382A and the first upper ribbon regulating portions 386A and 387A. As a consequence, the feeding accuracy of the tape and the ink ribbon 60 may improved. Thus, the printing accuracy may also be improved.

In addition, the second fitting portion 882 is provided above the second lower flat surface 392B as the reference surface in a direction perpendicular to the second lower flat surface 392B. Thus, the top case 311 and the bottom case 312 may be appropriately joined together by the second fitting portion 882. As a result, positions of the second lower tape regulating portion 363 and the second lower ribbon regulating portion 388B that are provided in the vicinity of the second fitting portion 882 may be maintained appropriately. In addition, positions of the regulating portions that are provided between the first fitting portion 881 and the second fitting portion 882 in the left-and-right direction are also appropriately maintained. These regulating portions include the first lower tape regulating portions 381B and 382B, the separating wall regulating portion 383, the first lower ribbon regulating portions 386B and 387B, the first upper tape regulating portions 381A and 382A and the first upper ribbon regulating portions 386A and 387A. As a consequence, the feeding accuracy of the tape and the ink ribbon 60 may be improved. Thus, the printing accuracy may also be improved.

Further, the third fitting portion 883 is provided above the third lower flat surface 321B in a direction perpendicular to the third lower flat surface 321B. Further, the third fitting portion 883 is provided between the third lower flat surface 321B and the second upper flat surface 321A. Thus, the top case 311 and the bottom case 312 may be appropriately joined together by the third fitting portion 883. As a result, the third lower flat surface 321B and the second upper flat surface 321A may be respectively maintained in appropriate positions. Thus, the height positions of the third lower tape regulating portion 40B and the second upper tape regulating portion 40A that are provided in the vicinity of the third lower flat surface 321B and the second upper flat surface 321A may be appropriately maintained. As a consequence, the feeding accuracy of the tape may be improved. Thus, the printing accuracy may also be improved.

In addition, the fourth fitting portion 884 is provided above the fourth lower flat surface 322B in a direction perpendicular to the fourth lower flat surface 322B. Further, the fourth fitting portion 884 is provided between the fourth lower flat surface 322B and the third upper flat surface 322A. Thus, the top case 311 and the bottom case 312 may be appropriately joined together by the fourth fitting portion 884. As a result, the fourth lower flat surface 322B and the third upper flat surface 322A may be respectively maintained in appropriate positions. Thus, the height positions of the fourth lower tape regulating portion 41B and the third upper tape regulating portion 41A that are provided in the vicinity of the fourth lower flat surface 322B and the third upper flat surface 322A may be appropriately maintained. As a consequence, the feeding accuracy of the tape may be improved. Thus, the printing accuracy may also be improved.

Further, in the first embodiment, the first to fourth lower flat surfaces 391B, 392B, 321B and 322B are all in the same height position in the bottom case 312. When joining the top case 311 and the bottom case 312 together, the first to fourth lower flat surfaces 391B, 392B, 321B and 322B, which are the reference surfaces, are placed on the mounting surface of the jig. Then, the top case 311 is pressed downwards, and the top case 311 and the bottom case 312 are joined together by the first to fourth fitting portions 881, 882, 883 and 884. On the jig, it may be preferable that dimensions in the vertical direction of the mounting surfaces that contact the first to fourth lower flat surfaces 391B, 392B, 321B and 322B correspond accurately to the dimensions of the first to fourth lower flat surfaces 391B, 392B, 321B and 322B.

In the first embodiment, the height positions of the first to fourth lower flat surfaces 391B, 392B, 321B and 322B are set at the same height. Therefore, the mounting surfaces of the jig on which the first to fourth lower flat surfaces 391B, 392B, 321B and 322B are placed are set in the same height position of the jig. The jig mounting surfaces can be made with more accurate dimensions when they are set in the same height position, as compared to a case in which the mounting surfaces are set in differing height positions. Therefore, the dimensions in the vertical direction of the mounting surfaces of the jig may correspond accurately to the dimensions of the first to fourth lower flat surfaces 391B, 392B, 321B and 322B.

As a result, the top case 311 and the bottom case 312 may be accurately joined together by the first to fourth fitting portions 881, 882, 883 and 884. Thus, the first to fourth lower flat surfaces 391B, 392B, 321B and 322B and the first to third upper flat surfaces 393A, 321A and 322A may be maintained in appropriate positions. As a result, each of the regulating portions provided in the vicinity of the first to fourth lower flat surfaces 391B, 392B, 321B and 322B and the first to third upper flat surfaces 393A, 321A and 322A may be maintained in appropriate positions, and the feeding accuracy of the tape and the ink ribbon 60 may be improved. Thus, printing accuracy may also be improved.

Hereinafter, operations of the tape cassette 30 and the tape printer 1 according to the first embodiment when the tape cassette 30 is installed in the tape printer 1 will be explained.

First, a mode of installing the tape cassette 30 will be explained. When the tape cassette 30 is installed in the cassette housing portion 8, the tape cassette 30 is slotted vertically from above such that the bottom surface 302 of the tape cassette 30 faces the bottom surface (not shown in the figures) of the cavity 811. As shown in FIG. 4, the head holder 74, the ribbon take-up shaft 95 and the tape drive shaft 100 protrude from the bottom surface of the cavity 811. Thus, the tape cassette 30 is slotted in while these members are inserted into the head insertion portion 39, the ribbon take-up spool 44 and a shaft hole of the tape drive roller 46, respectively.

As described above, the first supporting portion 741 and the second supporting portion 742 are respectively provided on the right end and the left end of the head holder 74. Further, the first support receiving portion 391 and the second support receiving portion 392 are respectively provided in the tape cassette 30 at positions corresponding to the first supporting portion 741 and the second supporting portion 742. More specifically, the first support receiving portion 391 and the second support receiving portion 392 are respectively provided on the outer periphery of the head insertion portion 39 of the bottom case 312, on the upstream side end and the downstream side end of the head insertion portion 39 in the feed direction of the tape. The first press receiving portion 393 is provided in the top case 311, to the front of the support hole 68 of the ribbon take-up spool 44 on the outer periphery of the head insertion portion 39 of the top case 31. More specifically, the first press receiving portion 393 is provided on the upstream side of the head insertion portion 39. In addition, the second press receiving portion 398 is provided to the rear of the support hole 64 of the tape drive roller 46 in the upper portion of the corner portion 324 of the top case 31.

Figure 30:
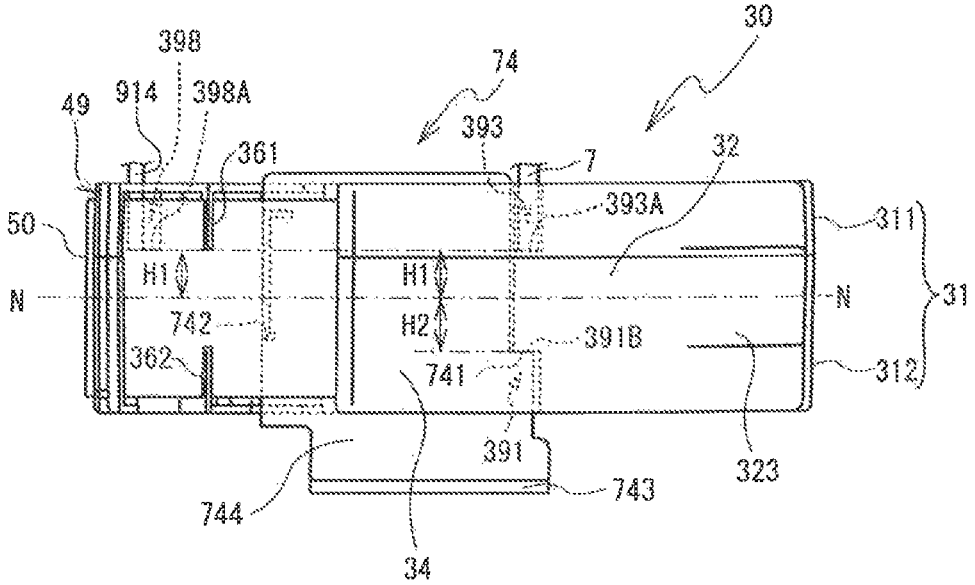
FIG. 30 is an explanatory diagram of the wide-width tape cassette 30 installed in the tape printer 1 as seen from the front.
Figure 31:
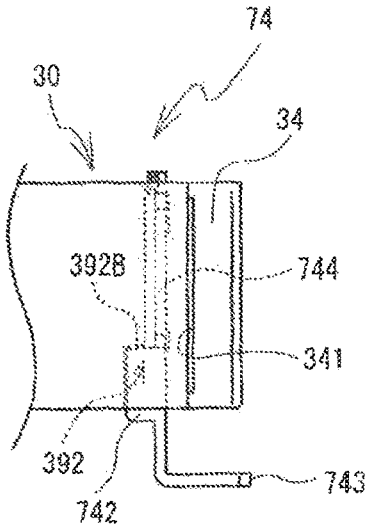
FIG. 31 is an explanatory diagram of the wide-width tape cassette 30 installed in the tape printer 1 as seen from the left side.

When the user pushes in the tape cassette 30 in the downward direction, as shown in FIG. 30, the ceiling wall portion of the first support receiving portion 391, which is the indentation extending upwards from the bottom surface 302, comes into contact with the first supporting portion 741 provided on the head fixing portion 744 of the head holder 74. More specifically, the first lower flat surface 391B comes into contact with the first supporting portion 741, and thus the movement of the first support receiving portion 391 in the downward direction is restricted beyond that point. In addition, as shown in FIG. 31, the ceiling wall portion of the second support receiving portion 392, which is also the indentation extending upwards from the bottom surface 302, comes into contact with the second supporting portion 742 provided on the head fixing portion 744 of the head holder 74. More specifically, the second lower flat surface 392B comes into contact with the second supporting portion 742, and thus the movement of the second support receiving portion 392 in the downward direction is restricted beyond that point. In other words, the tape cassette 30 is maintained in a state in which the reference surfaces, namely, the first and second lower flat surfaces 391B and 392B are supported from underneath by the cassette supporting portions 741 and 742 that are reference points in the vertical direction for the center position of the thermal head 10.

When the cassette cover 6 is closed for printing, the head pressing member 7 and the periphery pressing portion 914 respectively come into contact with the first upper flat surface 393A of the first press receiving portion 393 and the flat surface 398A of the second press receiving portion 398 and press on the tape cassette 30 from above. As shown in FIG. 1 and FIG. 2, the cassette cover 6 is supported at both the left and the right ends of the upper end of the rear surface of the tape printer 1. Accordingly, when the cassette cover 6 is closed, the leading ends of the head pressing member 7 and the periphery pressing member 914 do not approach the top surface 301 of the installed tape cassette 30 perpendicularly, but approach the top surface 301 at an acute angle from the rear toward the front.

Here, the inclined portion 394 (refer to FIG. 24) that is provided on the rear of the first upper flat surface 393A of the first press receiving portion 393 functions as an escape portion to prevent interference when the head pressing member 7 approaches the first upper flat surface 393A. In the first embodiment, the inclined portion 394 is provided only to the first press receiving portion 393. However, a similar inclined portion may be provided on the rear of the second press receiving portion 398.

As described above, with the tape printer 1 and the tape cassette 30 according to the first embodiment, positioning in the vertical direction of the tape that is the print medium (one of the heat sensitive tape paper tape 55, the print tape 57 and the film tape 59) may be accurately performed in the vicinity of the thermal head 10 that performs printing. Furthermore, a center position of printing by the thermal head 10 in the vertical direction, and the center positions of the tape and the ink ribbon 60 in the width direction may be accurately matched. As a result, quality of printing on the tape may be improved.

In particular, the tape cassette 30 according to the first embodiment is supported on both sides with respect to the insertion position of the thermal head 10, that is, the printing position. The tape cassette 30 is supported on both the upstream and downstream sides of the printing position in the feed direction of the film tape 59 that is the print medium. Accordingly, the feed direction of the tape and the ink ribbon 60 can be accurately maintained perpendicularly to the arrangement direction (the vertical direction) of the thermal head 10. As a result, the tape and the ink ribbon 60 may be fed in a stable manner, and also the center position of printing in the vertical direction and the center positions of the tape and the ink ribbon 60 in the width direction can be even more accurately maintained.

In addition, when the tape cassette 30 is installed in the cassette housing portion 8, the first to fourth corner portions 321 to 324 are supported from underneath by the corner support portion 812. In other words, in addition to the first and second lower flat surfaces 391B and 392B, the third and fourth lower flat surfaces 321B and 322B, which are also the reference surfaces, are also supported. Therefore, even if warping or similar deformation of the cassette case 31 occurs, for example, the reference surfaces that are in a plurality of positions are each supported from underneath in the tape printer 1, and thus the height positions may be corrected. As a result, the tape and the ink ribbon 60 may be stably fed and the print position may be accurately maintained.

Moreover, when the tape cassette 30 according to the first embodiment is installed in the cassette housing portion 8 and the cassette cover 6 is closed, the first press receiving portion 393 located in the vicinity of the ribbon take-up spool 44 is pressed from above by the head pressing member 7. Consequently, the vibration of the ribbon take-up spool 44 that is rotated by the ribbon take-up shaft 95 may be suppressed. In addition, the second press receiving portion 398 located in the vicinity of the tape drive roller 46 is pressed from above by the periphery pressing member 914. Consequently, the vibration of the tape drive roller 46 that is rotated by the tape drive shaft 100 may be suppressed.

In the first embodiment, the tape cassette 30 is pressed from above at the upstream side and the downstream side of the thermal head 10 inserted in the head insertion portion 39. Therefore, an influence of the vibrations of the movable components (the ribbon take-up spool 44 and the tape drive roller 46) on the vicinity of the head insertion portion 39 may be suppressed. As a result, vibrations generated on the movable components of the tape cassette 30 may be decreased while the tape printer 1 performs printing, and thus a feeding failure of the tape and deterioration in the print quality may be prevented.

Furthermore, the tape cassette 30 can be firmly fixed in a state in which the first lower flat surface 391B and the first upper flat surface 393A that are the reference surfaces are sandwiched from above and below between the first supporting portion 741 of the head holder 74 and the head pressing member 7. The tape cassette 30 can be firmly fixed in a state in which the lower surface of the fourth corner portion 324 and the flat surface 398A of the second press receiving portion 398 are sandwiched from above and below between the cassette supporting portion 812 and the periphery pressing member 914. As a result, the vibrations generated on the movable components of the tape cassette 30 may be further decreased while the tape printer 1 performs printing. Further, it may possible to restrict the movement of the tape cassette 30 in the upward direction (so-called rising movement) due to the vibrations of the movable components after the tape cassette 30 has been appropriately positioned in the vicinity of the print position. As a result, the center position of printing by the thermal head 10 in the vertical direction, and the center position of the film tape 59 in the tape width direction may be accurately maintained, and tape feeding and printing may be performed in a stable manner.

In a state where the tape cassette 30 is installed in the cassette housing portion 8, the thermal head 10 is positioned in the vicinity of the point P at which the first line L1 and the second line L2 intersect each other, as described above. Thus, the tape cassette 30 installed in the tape printer 1 is pressed in a well-balanced manner, with the vicinity of the thermal head 10 as a center. Therefore, in addition to reducing the vibrations of the tape drive roller 46 and the ribbon drive roller 44, it may be possible to accurately maintain the center position of printing by the thermal head 10 in the vertical direction and the center position of the film tape 59 in the tape width direction. Accordingly, feeding of the tape and printing may be performed in a stable manner.

Further, the periphery pressing members 911, 912 and 913 come into contact with the second upper flat surface 321A of the first corner portion 321, the third upper flat surface 322A of the second corner portion 322, and the upper surface of the third corner portion 323, and press them from above. In other words, the tape cassette 30 is sandwiched from above and below in at least three locations. A surface area that is surrounded by a line connecting the three locations extends over a wide range. Therefore, the tape cassette 30 may be fixed more securely. Therefore, even if warping or similar deformation of the cassette case 31 occurs, for example, the height positions of each of the reference surfaces may be accurately corrected. As a result, feed performance of the tape and the ink ribbon 60 and print position accuracy can be improved.

Further, in the first embodiment, the first support receiving portion 391 and the second support receiving portion 392 of the tape cassette 30 face the head insertion portion 39 in the directions that are perpendicularly intersecting with each other at the printing position, that is, at the position of the heating element row 10A of the thermal head 10. Both the support receiving portions 391 and 392, which are indented portions, are supported by the cassette supporting portions 741 and 742 inserted therein. The cassette supporting portions 741 and 742 extend in the directions that are perpendicularly intersecting with each other. Consequently, the movement of the tape cassette 30 may be restricted not only in the vertical direction, but also in the left-and-right direction and the back-and-forth direction. As a result, a proper positional relationship can be maintained between the thermal head 10 and the head insertion portion 39.

Figure 32:
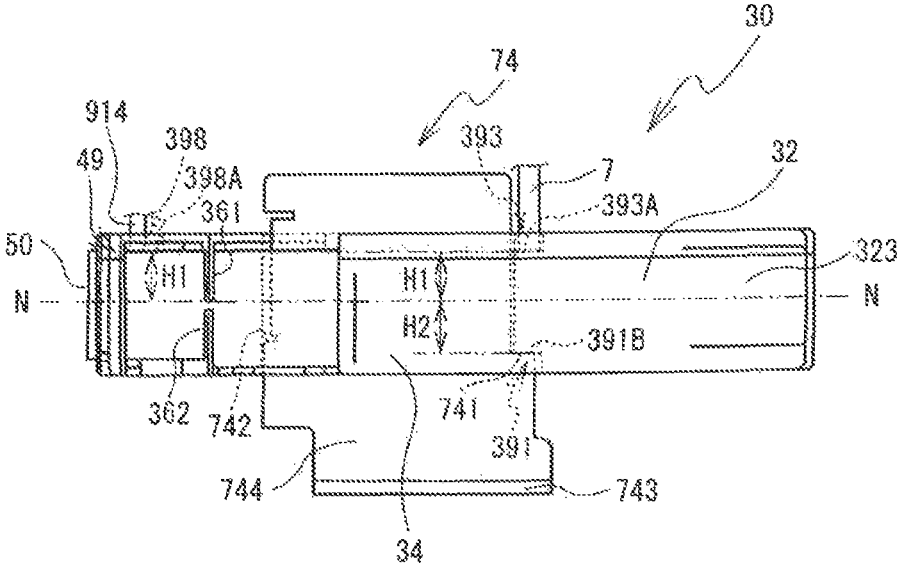
FIG. 32 is an explanatory diagram of the narrow-width tape cassette 30 installed in the tape printer 1 as seen from the front.
Figure 33:
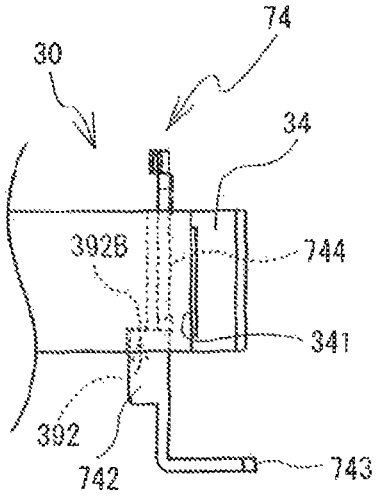
FIG. 33 is an explanatory diagram of the narrow-width tape cassette 30 installed in the tape printer 1 as seen from the left side.

Also, when the tape cassette 30 that has a lower height than the tape cassette 30 shown in FIG. 30 and FIG. 31 is installed in the cassette housing portion 8, the support receiving portions 391 and 392 (more specifically, the first and second lower flat surfaces 391B and 392B) respectively contact with and are supported by the cassette supporting portions 741 and 742 as shown in FIG. 32 and FIG. 33. When the cassette cover 6 is closed, the head pressing member 7 and the periphery pressing member 914 respectively contact with the first upper flat surface 393A of the first press receiving portion 393 and the flat surface 398A of the second press receiving portion 398, and press the tape cassette 30 from above.

In the tape cassette 30 shown in FIG. 32 and FIG. 33, the support receiving portions 391 and 392, which are indented portions provided to the bottom surface 302, have a smaller depth than in the tape cassette 30 shown in FIGS. 30 and 31. A distance H2 in the vertical (height) direction of the tape cassette 30 between the position of the first and second lower flat surfaces 391B and 392B of the support receiving portions 391 and 392 and the center position (the center line in the vertical direction of the cassette case 31) N in the vertical direction of the tape housed in the cassette case 31 is constant, regardless of the type of the tape cassette 30.

Further, in the tape cassette 30 shown in FIGS. 32 and 33, the first and second press receiving portions 393 and 398, which are indented portions provided to the top surface 301, have a smaller depth than in the tape cassette 30 shown in FIG. 30 and FIG. 31. A distance H1 in the vertical (height) direction of the tape cassette 30 between the positions of the first upper flat surface 393A and the flat surface 398A, and the center line N in the vertical direction of the cassette case 31 is also constant, regardless of the type of the tape cassette 30.

In this manner, regardless of the type of the tape cassette 30, in other words, even when the height of the tape cassette 30 in the vertical direction is different, the distance H1 and the distance H2 are constant. Therefore, a plurality of types of the tape cassette 30 with different heights can be used in the same tape printer 1. In addition, even when tapes with different widths are used, the tapes may be fed at a position where the centers of the tapes in the tape width direction are matched. Therefore, it may be possible to inhibit the tapes from moving around, which may occur due to difference in pressure applied to the tapes in the tape width direction when the centers of the tapes are not aligned in the tape width direction.

Further, in the first embodiment, regardless of the type of the tape cassette 30, the distance H1 and the distance H2 are set to be the same. In other words, a distance in the vertical direction between the lower end of the head pressing member 7 when the cassette cover 6 is closed and the center position in the vertical direction of the thermal head 10 (the heating element row 10A) is equal to a distance in the vertical direction between the height position of the first and second supporting portions 741 and 742, and the center position in the vertical direction of the thermal head 10. In this situation, the support from underneath of the tape cassette 30 and the pressure on the tape cassette 30 from above may be well-balanced. Therefore, an appropriate positional relationship between the center position of printing by the thermal head 10 in the vertical direction and the center positions of the tape and the ink ribbon 60 in the width direction may be appropriately maintained.

Next, the engagement of the tape cassette 30 by the cassette hook 75 will be explained with reference to FIG. 14. When the tape cassette 30 is inserted by the user into the cassette housing portion 8 and pushed downwards, first, the bottom surface 302 of the tape cassette 30 comes into contact with an upper portion of the claw portion 752 of the cassette hook 75. The upper portion of the claw portion 752 inclines rearward (to the left side in FIG. 14). Therefore, when the user further pushes the tape cassette 30 in the downward direction, the flexible protruding portion 751 bends forward (to the right side in FIG. 14) due to a pressing force from the bottom surface 302.

If the user further pushes the tape cassette 30 in the downward direction, the most protruding position of the claw portion 752 moves in the upward direction along the lower head peripheral wall 373 and reaches the latching portion 397. Then, the protruding portion 751 returns to the original position again, and the claw portion 752 engages with the latching portion 397, as shown in FIG. 14. At this time, the tape cassette 30 is supported at the support receiving portions 391 and 392. Therefore, similarly to the pressure applied on the first and second press receiving portions 393 and 398 by the head pressing member 7 and the periphery pressing member 914, the engagement by the cassette hook 75 may restrict any rising movement of the tape cassette 30, namely, the movement of the tape cassette 30 in the upward direction after the tape cassette 30 is installed in the tape printer 1. As a result, tape feeding and printing may be stably performed.

Next, detection of the type of the tape cassette 30 by the arm detection portion 200 and latching into the latching hole 820 by the latching piece 225 will be explained. When the user installs the tape cassette 30 at the proper position in the cassette housing portion 8 and the cassette cover 6 is closed, the platen holder 12 moves from the stand-by position shown in FIG. 5 toward the print position shown in FIG. 6 to FIG. 8. When this happens, the arm detection portion 200 and the latching piece 225 provided on the cassette-facing surface 122 of the platen holder 12 move to positions respectively facing the arm indicator portion 800 and the latching hole 820 provided on the arm front wall 35 of the tape cassette 30.

Each of the switch terminals 222 of the five arm detecting switches 210 protruding from the cassette-facing surface 122 face the non-pressing portion 801 or the pressing portion 802 provided in the corresponding position in the arm indicator portion 800. Thus, the switch terminals 222 of the five arm detecting switches 210 are selectively pressed. With the wide-width tape cassette 30 shown in FIG. 4 and FIG. 16, in the upper row within the height T1 of the common indicator portion 831, the non-pressing portion 801 is provided on the left side and the pressing portion 802 is provided on the right side. In the lower row within the height T1, the pressing portion 802 is provided on the left side and the non-pressing portion 801 is provided on the right side. Then, the pressing portion 802 is provided extending over the common indicator portion 831 within the predetermined height T2 below the common indicator portion 831.

Figure 34:
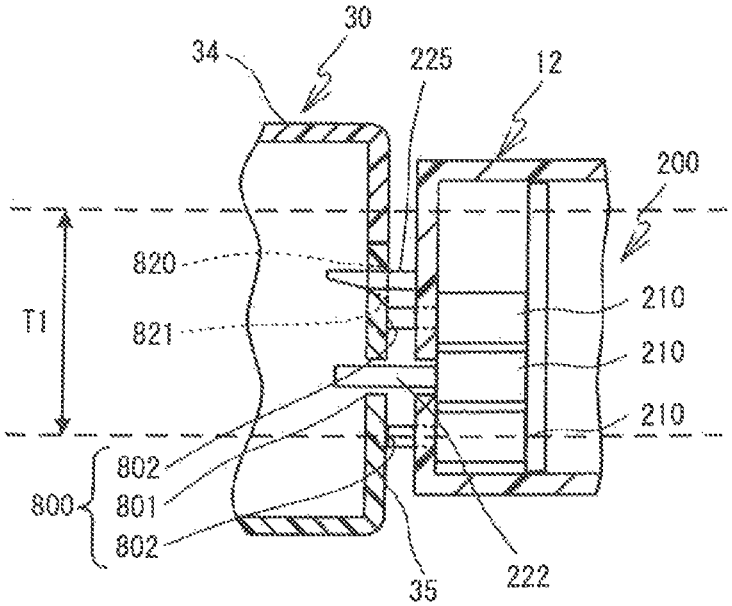
FIG. 34 is a cross-sectional view along a III-III line shown in FIG. 16 as seen in the direction of the arrows, when the tape cassette 30 shown in FIG. 16 is facing the platen holder 12.

Accordingly, as shown in FIG. 34, the switch terminals 222 facing the pressing portion 802 on the right side in the upper row in the common indicator portion 831, the pressing portion 802 on the left side in the lower row in the common indicator portion 831 and the pressing portion 802 extending from the common indicator portion 831 into the extension portion 832 below the common indicator portion 831 are pressed by the surface portions of the arm front wall 35 that are the pressing portions 802. As a result, the arm detecting switches 210 having those switch terminals 222 are in the on state. On the other hand, the switch terminals 222 facing the non-pressing portion 801 on the left side in the upper row and the non-pressing portion 801 on the right side in the lower row within the range of the height T1 of the common indicator portion 831 are inserted into the switch holes that are the non-pressing portions 801, and the arm detecting switches 210 having those switch terminals 222 are thus in the off state.

With the narrow-width tape cassette 30 shown in FIG. 17 and FIG. 18, the escape hole 803 is provided in the common indicator portion 831. Accordingly, when the tape cassette 30 is installed in the cassette housing portion 8, the switch terminal 222 facing the escape hole 803 is not pressed, and the arm detecting switch 210 having this switch terminal 222 is constantly in the off state. The type of the tape cassette 30 is identified based on the combination of the on and off states of the five arm detecting switches 210 obtained in this way. More specifically, a cassette identification table is stored in advance in the ROM 502 (refer to FIG. 15). In the cassette identification table, combinations of the on and off states of the arm detecting switches 210 are respectively associated with the types of the tape cassette 30. The CPU 501 (refer to FIG. 15) refers to the cassette identification table and identifies the type of the tape cassette 30 corresponding to the combination of the on and off states of the arm detecting switches 210.

In the example of the wide-width tape cassette 30 shown in FIG. 16, the indicator in the lowermost row (the pressing portion 802) is provided extending from the common indicator portion 831 into the extension portion 832 below the common indicator portion 831. However, the indicator (the pressing portion 802) may be included completely in the extension portion 832 without extending into the common indicator portion 831. In this case, when the narrow-width tape cassette 30 shown in FIG. 17 and FIG. 18 is installed in the cassette housing portion 8, the lower edge of the arm front wall 35 is above a height position corresponding to the indicator portion. Thus, in this type of case, there is no need to provide the escape hole 803 or the escape steps in the narrow-width tape cassette 30. Further, the indicator(s) may be provided in only the extension portion 832 above the common indicator portion 831 of the wide-width tape cassette 30, or may be provided in both the extension portion 832 above and below the common indicator portion 831.

In the first embodiment, the support receiving portions 391 and 392 that are used for positioning of the tape cassette 30 in the vertical direction are provided in positions that face the head insertion portion 39 when the tape cassette 30 is installed in the tape printer 1, namely, in positions contiguous to the arm portion 34 on which the arm indicator portion 800 is provided. As a result, when the tape cassette 30 is installed in the tape printer 1, a positional relationship between the arm detecting switches 210 and the arm indicator portion 800 may be accurately maintained, and thus erroneous detection by the arm detecting switches 210 may be prevented.

Furthermore, in the case of the wide-width tape cassette 30, the indicator(s) may also be formed in a predetermined area (the extension portion 832) of the arm front wall 35. The predetermined area is expanded in the vertical direction of the tape cassette 30 from the common indicator portion 831. By effectively using the extension portion 832 in this way, detection accuracy may be maintained even when the number of types of the tape cassette 30 that can be detected by the tape printer 1 is increased.

In addition, as described above, the protruding length of the latching piece 225 is generally the same as or greater than the protruding length of each of the switch terminals 222. Accordingly, when the tape cassette 30 is installed in the cassette housing portion 8 at the proper position, the latching piece 225 is inserted into the latching hole 820. On the other hand, when the tape cassette 30 is not installed in the cassette housing portion 8 at the proper position and thus the latching piece 225 does not face the latching hole 820 but instead faces the surface portion of the arm front wall 35, none of the switch terminals 222 are pressed by the arm front wall 35.

In the first embodiment, positioning of the tape cassette 30 in the vertical direction may be accurately performed by the support receiving portions 391 and 392 and the first and second press receiving portion 393 and 398. When insertion in the downward direction is insufficient, and the tape cassette 30 is not installed at the proper position, in this way, the latching piece 225 prevents a contact between each of the switch terminals 222 and the arm indicator portion 800. As a result, the arm detecting switches 210 are all in the off state. Thus, if, in the above-described cassette identification table, a combination in which all the arm detecting switches 210 are in the off state is defined as a state in which the tape cassette 30 is installed at an improper position, the installation state of the tape cassette 30 can be detected.

As described above, the thickness of the end of the latching piece 225 is reduced by the inclined portion 226 that is formed on the lower surface of the latching piece 225. The opening width of the latching hole 820 is increased in the vertical direction toward the arm front wall 35 by the inclined portion 821 formed on the lower wall of the latching hole 820. As a consequence, if the position of the latching piece 225 is very slightly misaligned with respect to the latching hole 820 in the downward direction (if the cassette case 31 is in a slightly raised position with respect to the proper position in the cassette housing portion 8), when the platen holder 12 moves toward the print position, the interplay of the inclined portion 226 and the inclined portion 821 guides the latching piece 225 into the latching hole 820. In this way, if the cassette case 31 is in a slightly raised position with respect to the proper position in the cassette housing portion 8, the latching piece 225 may be appropriately inserted into the latching hole 820, and the arm detecting switches 210 may be accurately positioned to face the arm indicator portion 800.

As described above, the indicators provided in the arm indicator portion 800 are arranged in a zigzag pattern, and thus none of the indicators is aligned on the same line in the vertical direction. In other words, in a case in which the latching piece 225 is not provided in the tape printer 1 and the latching hole 820 is not provided in the tape cassette 30, when the tape cassette 30 is displaced in the vertical direction, similarly, all the arm detecting switches 210 are in the on state. Thus, when this type of detection result has been obtained, the tape printer 1 can recognize that the tape cassette 30 is not installed at the proper position, and thus the likelihood of erroneous detection may be reduced.

As described above, when the tape cassette 30 is placed at the proper position in the vertical direction and installed in the cassette housing portion 8, the tape drive shaft 100 is fittingly inserted into the tape drive roller 46 and the ribbon take-up shaft 95 is fittingly inserted into the ribbon take-up spool 44. After that, when the cassette cover 6 is closed, the platen holder 12 moves to the print position, and the platen roller 15 faces the thermal head 10. At the same time, the movable feed roller 14 presses the tape drive roller 46. Thus, the tape printer 1 can perform printing on the tape that is the print medium. Furthermore, the type of the tape cassette 30 can be accurately detected by the arm detection portion 200.

In a case where the laminated type tape cassette 30 shown in FIG. 5 and FIG. 6 is installed, and printing is performed by the tape printer 1, the tape drive roller 46, which is driven to rotate via the tape drive shaft 100, pulls out the film tape 59 from the second tape spool 41 by moving in concert with the movable feed roller 14. Further, the ribbon take-up spool 44, which is driven to rotate via the ribbon take-up shaft 95, pulls out the unused ink ribbon 60 from the ribbon spool 42 in synchronization with the print speed.

The film tape 59 that has been pulled out from the second tape spool 41 passes the outer edge of the ribbon spool 42 and is fed along the feed path within the arm portion 34. Then, the film tape 59 is discharged through the exit 341 toward the head insertion portion 39 (the opening 77) in a state in which the ink ribbon 60 is joined to the surface of the film tape 59. The film tape 59 is then fed between the thermal head 10 and the platen roller 15 of the tape printer 1. Also during this period, the support receiving portions 391 and 392, the head pressing member 7 and the periphery pressing member 914, and the cassette hook 75 function to maintain a stable installment state.

Then, characters are printed onto the print surface of the film tape 59 by the thermal head 10 in a state in which the center position of printing by the thermal head 10 in the vertical direction and the center position of the film tape 59 in the tape width direction are accurately matched with each other. Following this, the used ink ribbon 60 is separated from the printed film tape 59 at the ribbon guide wall 47 and wound onto the ribbon take-up spool 44.

Meanwhile, the double-sided adhesive tape 58 is pulled out from the first tape spool 40 by the tape drive roller 46 moving in concert with the movable feed roller 14. While being guided and caught between the tape drive roller 46 and the movable feed roller 14, the double-sided adhesive tape 58 is layered onto and affixed to the print surface of the printed film tape 59. The printed film tape 59 to which the double-sided adhesive tape 58 has been affixed (namely, the printed tape 50) is then fed toward the tape discharge portion 49, discharged from the tape discharge portion 49, and is cut by the cutting mechanism 17.

In a case where the receptor type tape cassette 30 shown in FIG. 7 is installed, the tape drive roller 46, which is driven to rotate via the tape drive shaft 100, pulls out the print tape 57 from the first tape spool 40 by moving in concert with the movable feed roller 14. Further, the ribbon take-up spool 44, which is driven to rotate via the ribbon take-up shaft 95, pulls out the unused ink ribbon 60 from the ribbon spool 42 in synchronization with the print speed. The print tape 57 that has been pulled out from the first tape spool 40 is bent in the leftward direction in the front right portion of the cassette case 31, and fed along the feed path within the arm portion 34.

Then, the print tape 57 is discharged through the exit 341 toward the head insertion portion 39 in a state in which the ink ribbon 60 is joined to the surface of the print tape 57. The print tape 57 is then fed between the thermal head 10 and the platen roller 15 of the tape printer 1. Then, characters are printed onto the print surface of the print tape 57 by the thermal head 10. Following that, the used ink ribbon 60 is separated from the printed print tape 57 at the ribbon guide wall 47 and wound onto the ribbon take-up spool 44. Meanwhile, the printed print tape 57 (in other words, the printed tape 50) is fed toward the tape discharge portion 49, discharged from the tape discharge portion 49, and is cut by the cutting mechanism 17.

In a case where the thermal type tape cassette 30 shown in FIG. 8 is installed, the tape drive roller 46, which is driven to rotate via the tape drive shaft 100, pulls out the heat-sensitive paper tape 55 from the first tape spool 40 by moving in concert with the movable feed roller 14. The heat-sensitive paper tape 55 that has been pulled out from the first tape spool 40 is bent in the leftward direction in the front right portion of the cassette case 31, and is fed along the feed path within the arm portion 34.

Then, the heat-sensitive paper tape 55 is discharged through the exit 341 of the arm portion 34 toward the opening 77 and is then fed between the thermal head 10 and the platen roller 15. Then, characters are printed onto the print surface of the heat-sensitive paper tape 55 by the thermal head 10. Following that, the printed heat-sensitive paper tape 55 (namely, the printed tape 50) is further fed toward the tape discharge portion 49 by the tape drive roller 46 moving in concert with the movable feed roller 14, discharged from the tape discharge portion 49, and is cut by the cutting mechanism 17.

Note that, in the thermal type tape cassette 30, when printing is performed, the ribbon take-up spool 44 is also driven to rotate via the ribbon take-up shaft 95. However, there is no ribbon spool housed in the thermal type tape cassette 30. For that reason, the ribbon take-up spool 44 does not pull out the unused ink ribbon 60, nor does it wind the used ink ribbon 60. In other words, even when the thermal type tape cassette 30 is used in the tape printer 1 that is equipped with the ribbon take-up shaft 95, the rotation drive of the ribbon take-up shaft 95 does not have an influence on the printing operation of the heat-sensitive paper tape 55 and printing can be correctly performed. In the thermal type tape cassette 30, the ribbon take-up spool 44 may not be provided, and the ribbon take-up shaft 95 may perform idle running inside the support hole 68 in a similar way.

In the first embodiment, the general purpose tape cassette 30 is used in the general purpose tape printer 1. Therefore, a single tape printer 1 can be used with each type of the tape cassette 30, such as the thermal type, the receptor type, the laminated type and the thermal laminated type etc., and it may not be necessary to use the different tape printer 1 for each type. Furthermore, the tape cassette 30 is normally formed by injecting plastic into a plurality of combined molds. In the case of the tape cassette 30 that corresponds to the same tape width, common molds may be used, except for the mold including the portion that forms the arm indicator portion 800. Thus, costs may be significantly reduced.

Second Embodiment

Figure 35:
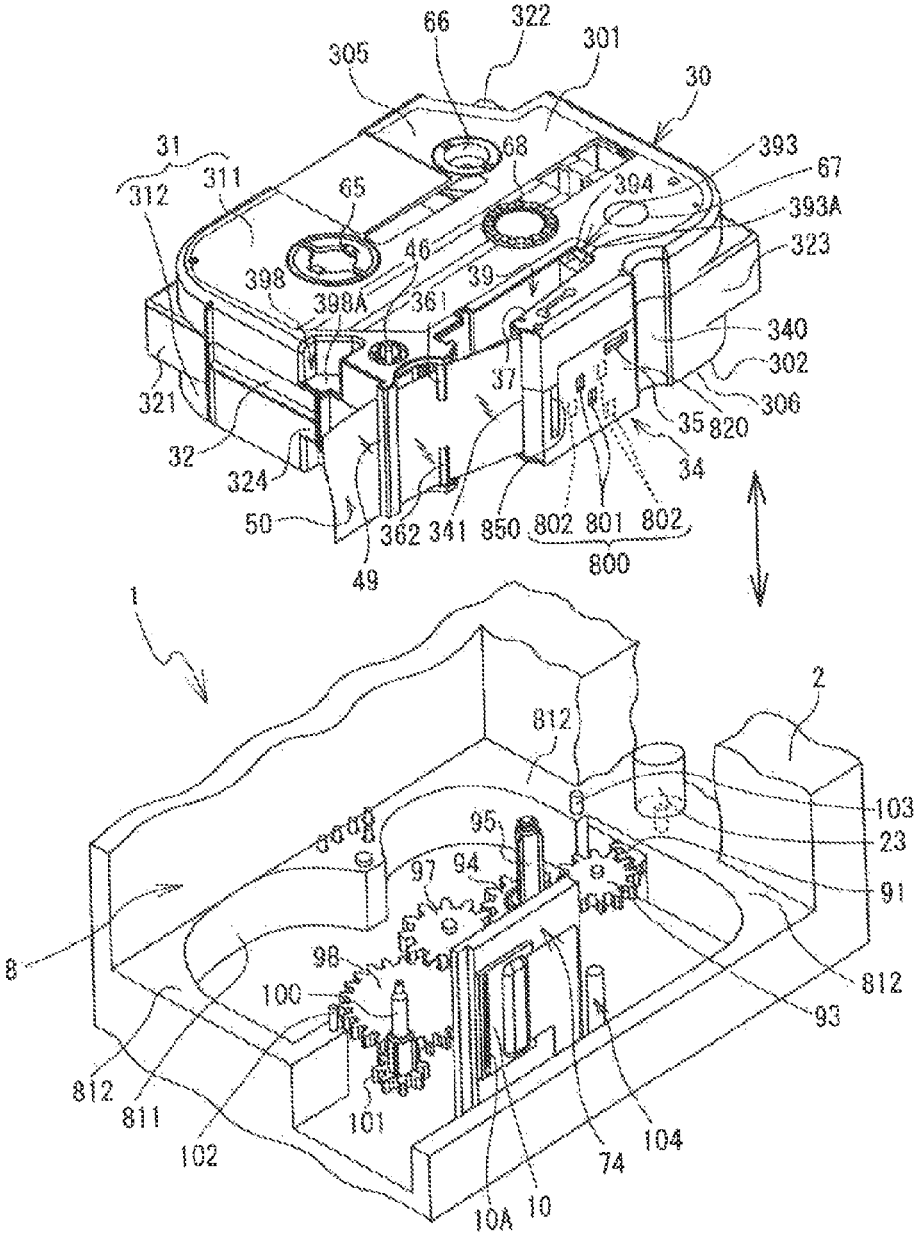
FIG. 35 is a perspective view illustrating a tape cassette 30 and a cassette housing portion 8 according to a second embodiment.
Figure 36:
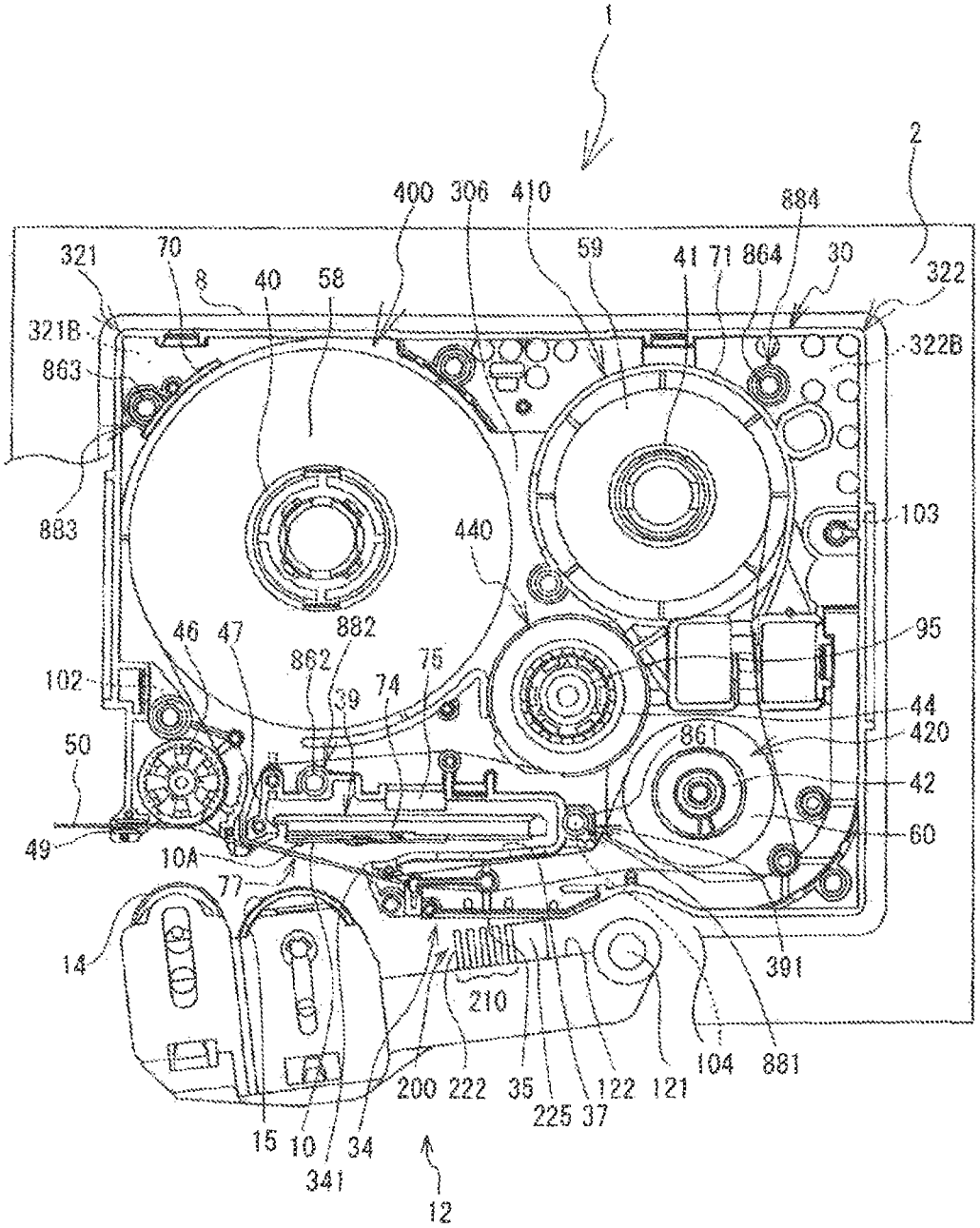
FIG. 36 is a plan view of the cassette housing portion 8 according to the second embodiment in which the tape cassette 30 is installed.

A second embodiment will be explained with reference to FIG. 35 to FIG. 38. Note that the tape cassette 30 shown in FIG. 36 is an example of the laminated type tape cassette 30 shown with the top case 311 removed. In the first embodiment, the head holder 74 of the tape printer 1 is provided with the two cassette supporting portions 741 and 742 in two locations on the upstream side and the downstream side of the thermal head 10. Further, on the tape cassette 30, the support receiving portions 391 and 392 are provided corresponding to the cassette supporting portions 741 and 742 in two locations facing the head insertion portion 39. In the second embodiment, an example will be described in which a support portion for supporting the tape cassette 30 is provided on the upstream side of the head holder 74 only. On the tape cassette 30 also, a support receiving portion is provided in one only location facing the head insertion portion 39. Hereinafter, the explanation will concentrate on structures that are different to that of the first embodiment and will omit explanation of structures that are the same as the first embodiment.

First, the tape printer 1 according to the second embodiment will be explained. As shown in FIG. 35 and FIG. 36, the head holder 74 according to the second embodiment is a plate-shaped member that is standing on the front side of the cassette housing portion 8 along the left-and-right direction of the tape printer 1. More specifically, the head holder 74 is provided with the seat portion 743 that is fixed to the underneath of the bottom surface of the cavity 811, and the head fixing portion 744 that is bent generally perpendicularly from the seat portion 743 and extends in the upward direction. The head holder 74 is arranged in the cassette housing portion 8 to face the head insertion portion 39 when the tape cassette 30 is installed in the cassette housing portion 8.

As shown in FIG. 36, in contrast to the first embodiment (refer to FIG. 4), the length in the left-and-right direction of the head holder 74 according to the second embodiment is shorter than the length of the head insertion portion 39 in its longitudinal (left-and-right) direction, and the head holder 74 has a size that can be housed completely inside the head insertion portion 39. In the second embodiment, no support portions for positioning the tape cassette 30 in the vertical direction and supporting the tape cassette 30 from underneath are provided on the head holder 74 itself. Instead, as shown in FIG. 35, an upstream support pin 104 is provided adjacent to the right side end of the head holder 74.

The upstream support pin 104 is a cylindrical member that is standing from the cavity 811 in the upward direction. When the tape cassette 30 is installed in the tape printer 1, a top surface of the cylinder comes into contact with the first lower flat surface 391B of the first support receiving portion 391 of the tape cassette 30, and thus supports the tape cassette 30 from underneath. Accordingly, as shown in FIG. 36, a diameter of the upstream support pin 104 is slightly smaller than a short side of the first lower flat surface 391B that has a rectangular shape in a bottom view.

Figure 37:
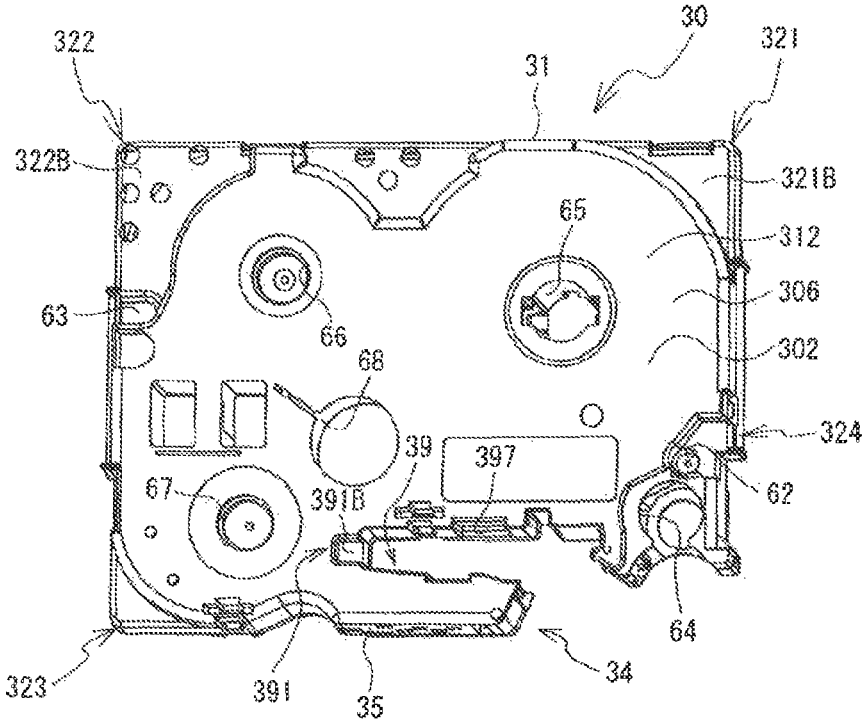
FIG. 37 is a perspective view of the tape cassette 30 according to the second embodiment as seen from the bottom surface 302 side.

Next, the tape cassette 30 according to the second embodiment will be explained. As shown in FIG. 37, similarly to the first embodiment, the first support receiving portion 391 is provided in the bottom case 312 according to the second embodiment. The first support receiving portion 391 is in a position on the upstream side of the thermal head 10 in the tape feed direction, facing the head insertion portion 39 (on the outer periphery of the head insertion portion 39). More specifically, the first support receiving portion 391 is connected to the upstream end of the head insertion portion 39 in the tape feed direction. The above-described arrangement can be alternatively expressed as follows, in relation to the position of the heating element row 10A of the thermal head 10 of the head holder 74, that is, the print position, when the tape cassette 30 is installed in the cassette housing portion 8. The first support receiving portion 391 to be supported by the support pin 104 is located in a position to face the head insertion portion 39 and in the direction (the first direction) toward the most upstream side of the head insertion portion 39 in the tape feed direction with respect to the heating element row 10A.

Figure 38:
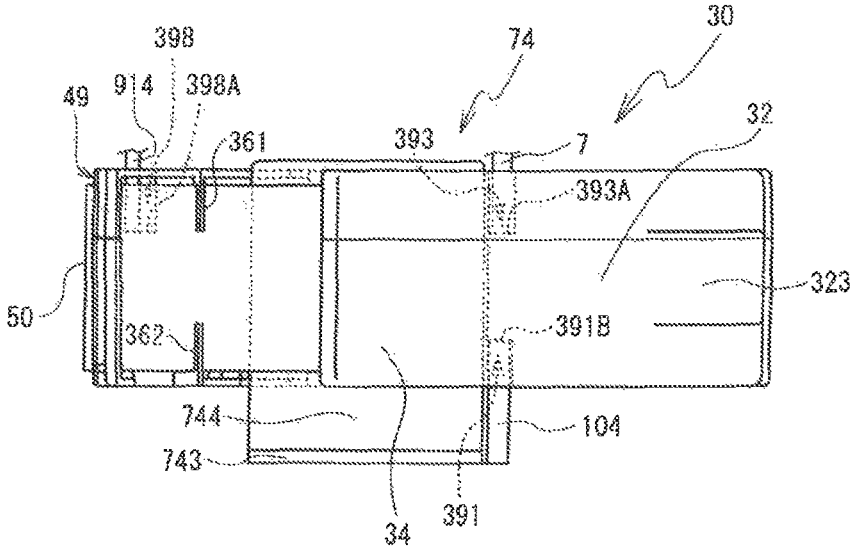
FIG. 38 is an explanatory diagram of the tape cassette 30 installed in the tape printer 1 according to the second embodiment, as seen from the front.

Further, the first press receiving portion 393 is provided in the top case 311 in a position above the first support receiving portion 391 in the vertical direction of the cassette case 31 such that it overlaps with the first support receiving portion 391 in a plan view (refer to FIG. 38). The first upper flat surface 393A of the first press receiving portion 393 at least partly faces the first lower flat surface 391B in the vertical direction.

On the other hand, in contrast to the first embodiment, in the bottom case 312, an indentation that functions as a support portion is not provided on the downstream side of the head insertion portion 39. As a consequence, the height position in the vertical direction of the first lower tape regulating portions 381B and 382B provided inside the arm portion 34 is set using only the first lower flat surface 391B as the reference surface.

Hereinafter, operations of the tape cassette 30 and the tape printer 1 according to the second embodiment when the tape cassette 30 is installed in the tape printer 1 will be explained with reference to FIG. 38.

When the user inserts the tape cassette 30 in the cassette housing portion 8 and pushes the tape cassette 30 in the downward direction, as shown in FIG. 38, the first lower flat surface 391B of the first support receiving portion 391 comes into contact with the top surface of the upstream support pin 104, and thus the movement of the first support receiving portion 391 in the downward direction is restricted beyond that point. Then, the tape cassette 30 may be maintained in a state in which the first lower flat surface 391B is supported from underneath by the upstream support pin 104.

Further, similarly to the first embodiment, the head pressing member 7 comes into contact with the first upper flat surface 393A that is positioned directly above the first lower flat surface 391B and presses the first upper flat surface 393A from above. Thus, the tape cassette 30 that has been appropriately positioned in the vicinity of the print position using the above-described reference surfaces is firmly fixed in place. As a result, the center position of printing by the thermal head 10 in the vertical direction, and the center position of the film tape 59 in the width direction may be accurately maintained, and tape feeding and printing may be performed in a stable manner.

In this way, in the tape cassette 30 according to the second embodiment, the first support receiving portion 391 is provided in a position immediately before printing is performed on the film tape 59 as the print medium. Therefore, positioning of the tape cassette 30 in the vertical direction may be performed in a most efficient position when matching the center position of printing by the thermal head 10 in the vertical direction and the center position of the film tape 59 in the tape width direction. As a result, when installing the tape cassette 30 in the tape printer 1, a positional relationship between the arm detecting switches 210 and the arm indicator portion 800 may be accurately maintained, and thus erroneous detection by the arm detecting switches 210 may be prevented.

Third Embodiment

Hereinafter, a third embodiment will be explained with reference to FIG. 39 to FIG. 48. In the tape cassette 30 in the first and second embodiments, the flat surface (the first lower flat surface 391B) of the first support receiving portion 391 to be supported by the first supporting portion 741 of the head holder 74 is provided in the bottom case 312. In the third embodiment, an example will be explained in which the flat surface of the first support receiving portion 391 to be supported by the first supporting portion 741 is provided in the top case 311. Note that the tape printer 1 is almost the same as the tape printer 1 in the first embodiment. However, the head pressing member 7 and the periphery pressing members 911 to 914, which are provided to the cassette cover 6 in the first embodiment, are not provided in the third embodiment. The explanation that follows will focus on the structures that are different from the first embodiment, while the same reference numerals are assigned to, and explanations are omitted for, structures that are the same as in the first embodiment.

First, the structure of the bottom case 312 and the top case 311 of the tape cassette 30 in the third embodiment will be explained in detail with reference to FIG. 39 to FIG. 46. Note that in FIG. 40, for ease of explanation, the arrangement and feed paths of the film tape 59, the double-sided adhesive tape 58, and the ink ribbon 60 when the laminated type tape cassette 30 is used are shown as two-dotted lines.

Figure 41:
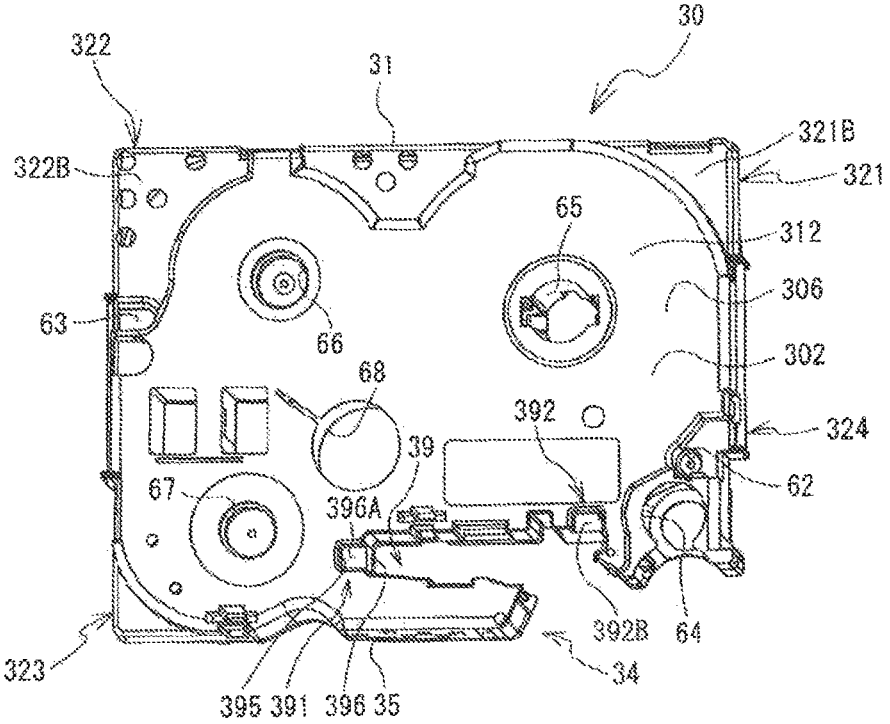
FIG. 41 is a perspective view of the tape cassette 30 according to the third embodiment when seen from the bottom surface 302 side.

First, support receiving portions that are provided in cassette case 31 will be explained. As shown in FIG. 41, two support receiving portions are provided on the outer periphery of the head insertion portion 39 in positions that face the head insertion portion 39. The support receiving portions are used to determine the position of the tape cassette 30 in the vertical direction when the tape cassette 30 is installed in the tape printer 1. More specifically, the first support receiving portion 391 and the second support receiving portion 392 are respectively provided on the upstream side and the downstream side of the insertion position of the thermal head 10 (more specifically, the print position, that is the position of the heating element row 10A) (refer to FIGS. 4 to 7) in relation to the feed direction of the tape.

The first support receiving portion 391 is connected to the end of the arm portion 34 on the upstream side in the tape feed direction and also to the upstream side end of the head insertion portion 39 in the tape feed direction. The second support receiving portion 392 is connected to the downstream side end of the head insertion portion 39. In other words, the first support receiving portion 391 and the second support receiving portion 392 are provided in the same positions as in the first embodiment. The structure of the second support receiving portion 392 is the same as in the first embodiment, so a detailed explanation will be omitted. In contrast, the structure of the first support receiving portion 391 is different from that in the first embodiment, so it will be explained in detail below.

Figure 42:
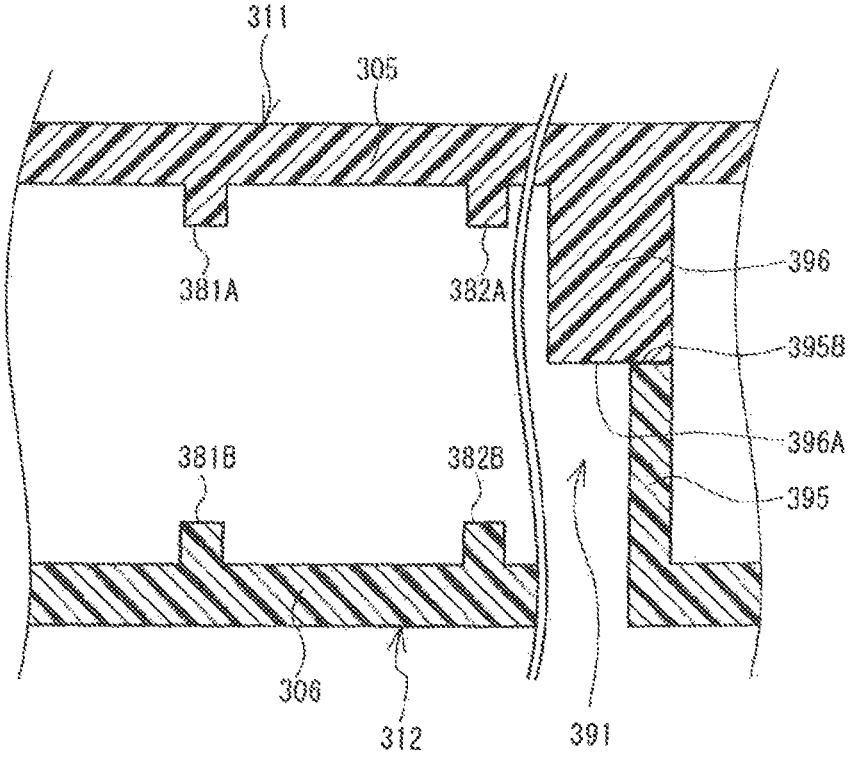
FIG. 42 is a cross-sectional view along a IV-IV line shown in FIG. 41 as seen in the direction of the arrows, when the top case 311 and the bottom case 312 according to the third embodiment are joined.

As shown in FIG. 41, in a case where the tape cassette 30 is viewed from the bottom, the first support receiving portion 391 is an indentation that extends upward from the bottom surface 302. The first support receiving portion 391 is connected to the head insertion portion 39 in the direction along the arm front wall 35. As shown in FIG. 42, the lower surface of a ceiling wall portion of the indentation is a first upper flat surface 396A. Further, a side wall of the indentation is formed by a first lower projecting portion 395 that is a wall that projects upward from the upper surface of the bottom wall 306 of the bottom case 312. In other words, the first support receiving portion 391 of the third embodiment includes the first upper flat surface 396A of the top case 311 and the first lower projecting portion 395 of the bottom case 312. Note that the first upper flat surface 396A is not shown in FIG. 40, but the position of the first support receiving portion 391 is shown for ease of explanation.

Figure 39:
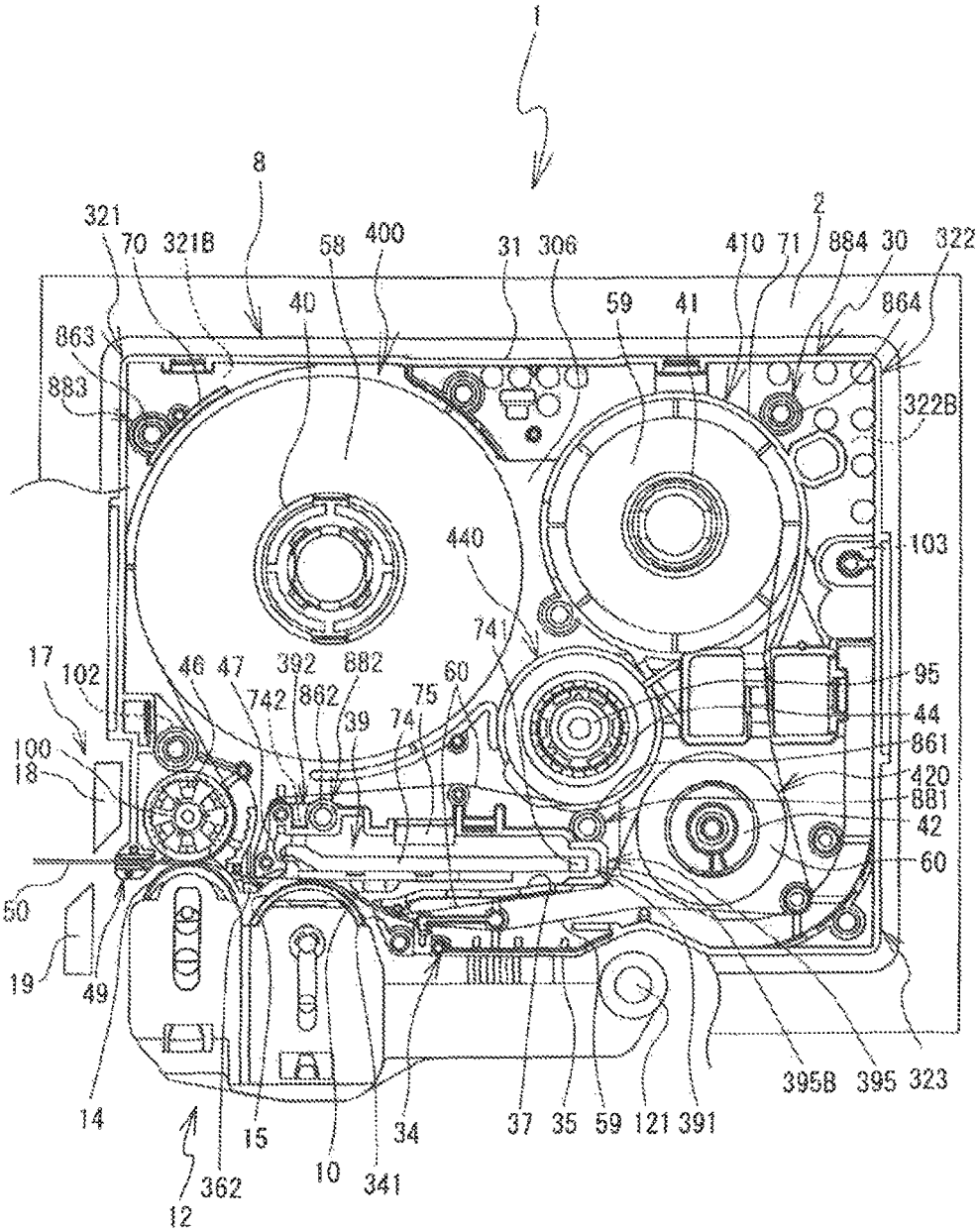
FIG. 39 is a perspective view illustrating a tape cassette 30 and a cassette housing portion 8 according to a third embodiment.
Figure 40:
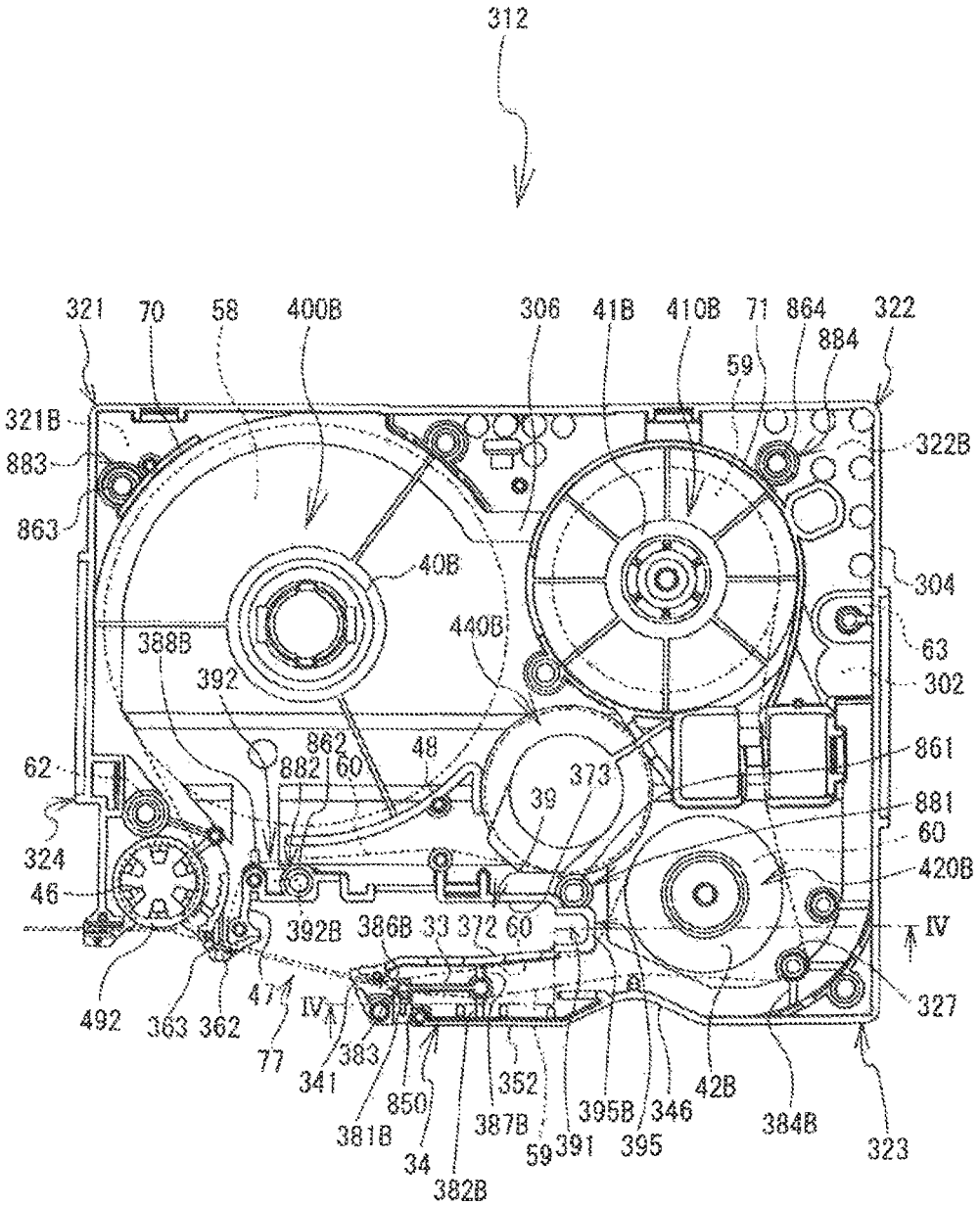
FIG. 40 is a plan view of a bottom case 312 according to the third embodiment.

Next, the structure of the bottom case 312 will be explained. As shown in FIG. 41, the first lower projecting portion 395 projects from the upper surface of the bottom wall 306 to oppose an end that is not an end of the first upper flat surface 396A on the downstream side in the tape feed direction (herein after referred to as a downstream side end). As shown in FIG. 40, in a plan view, the first lower projecting portion 395 has a U shape that is rotated ninety degrees in a counterclockwise direction. As shown in FIG. 39, when the tape cassette 30 is installed in the cassette housing portion 8, the first lower projecting portion 395 is positioned on the right side of the head holder 74 such that the first lower projecting portion 395 is arranged around the right end portion of the head holder 74. In other words, the first lower projecting portion 395 does not contact with the head holder 74.

As shown in FIG. 42, a first lower flat surface 395B is provided on the upper end of the first lower projecting portion 395. The first lower flat surface 395B is a flat surface that contacts with the end of the first upper flat surface 396A that is not the downstream side end. In the present embodiment, the first lower flat surface 395B contacts with three sides of the first upper flat surface 396A, which has a rectangular shape in a bottom view, other than a side located at the most downstream side in the tape feed direction. The first lower flat surface 395B and the second lower flat surface 392B of the second support receiving portion 392 (refer to FIGS. 20 and 21) are spaced from the center position of the tape and the ink ribbon 60 in the width direction by the same distance in the vertical direction. In other words, the first and second lower flat surfaces 395B and 392B are at the same height position in the bottom case 312. Note that in the present embodiment, the center position of the tape and the ink ribbon 60 in the width direction matches a center position of the cassette case 31 in the vertical direction. The first lower projecting portion 395 (more specifically, the first lower flat surface 395B) may not necessarily oppose all ends (three sides) of the first upper flat surface 396A other than the downstream side end. Specifically, the first lower projecting portion 395 may project from the upper surface of the bottom wall 306 to oppose any one of the ends of the first upper flat surface 396A, as far as the end is not the downstream side end. For example, the first lower projecting portion 395 may be provided to oppose only the end of the first upper flat surface 396A on the upstream side in the feed direction of the tape. In such a case, the first lower flat surface 395B may contact only the upstream side end of the first upper flat surface 396A.

The first and second lower flat surfaces 395B and 392B are reference surfaces in the bottom case 312. In the third embodiment, the first and second lower flat surfaces 395B and 392B are the reference surfaces for various regulating members that restrict the movements of the tape and the ink ribbon 60 in the width direction. Furthermore, in a case where the tape cassette 30 is installed in the cassette housing portion 8, the second lower flat surface 392B functions as a portion that is supported from underneath by the second supporting portion 742 that is provided on the head holder 74.

As shown in FIG. 39 and FIG. 40, the first cylindrical member 861 is standing upwards on the rear side of the first lower projecting portion 395. In other words, the first cylindrical member 861 is provided in the vicinity of the first lower projecting portion 395, in a position that is different from its position in the first embodiment. The second cylindrical member 862 is standing upwards on the upper side of the second support receiving portion 392. In other words, the second cylindrical member 862 is provided directly above the second lower flat surface 392B in the vertical direction. The second cylindrical member 862 is in contact with the lower head peripheral wall 373. The structures of the first cylindrical member 861 and the second cylindrical member 862 are the same as in the first embodiment.

As shown in FIG. 40, in the section of the bottom case 312 that forms a part of the arm portion 34, in the same manner as in the first embodiment, regulating portions are provided on the feed paths of the tape and the ink ribbon 60 that respectively restrict the movements of the tape and the ink ribbon 60 in the width direction (the vertical direction of the cassette case 31).

Specifically, on the tape feed path, the first lower tape regulating portions 381B and 382B that restrict the movement of the tape in the downward direction are provided on lower edge portions of the left end and the right end, respectively, of the separating wall 33. The separating wall regulating portion 383 that restricts the movement of the tape in the upward direction is provided on the upper edge of the left end of the first separating wall 33. On the feed path of the ink ribbon 60, the first lower ribbon regulating portions 386B and 387B that restrict movement of the ink ribbon 60 in the downward direction are provided on lower edge portions of the left end and the right end, respectively, of the separating wall 33. The structures of the regulating portions are the same as in the first embodiment.

The heights at which first lower tape regulating portions 381B and 382B, and the first lower ribbon regulating portions 386B and 387B the separating wall regulating portion 383 are positioned in the vertical direction of the bottom case 312 are set using the first and second lower flat surfaces 395B and 392B as reference surfaces.

More specifically, a distance between the protruding ends (top ends) of the first lower tape regulating portions 381B and 382B and the first and second lower flat surfaces 395B and 392B in the vertical direction is set in accordance with the tape width. A distance between the bottom end of the separating wall regulating portion 383 and the first and second lower flat surfaces 395B and 392B in the vertical direction is also set in accordance with the tape width. A distance between the protruding ends (top ends) of the first lower ribbon regulating portions 386B and 387B and the first and second lower flat surfaces 395B and 392B in the vertical direction is set in accordance with the width of the ink ribbon 60.

All of the above-described regulating portions are provided inside the arm portion 34, and the first and second lower flat surfaces 395B and 392B are respectively in the vicinity of the upstream end and the downstream end of the head insertion portion 39. In other words, each of the regulating portions inside the arm portion 34 is in a position that is close to the first and second lower flat surfaces 395B and 392B that are the reference surfaces. Therefore, there may be fewer measurement errors, and it may be more likely that the regulating portions and the reference surfaces can be formed with the same mold block.

Figure 43:
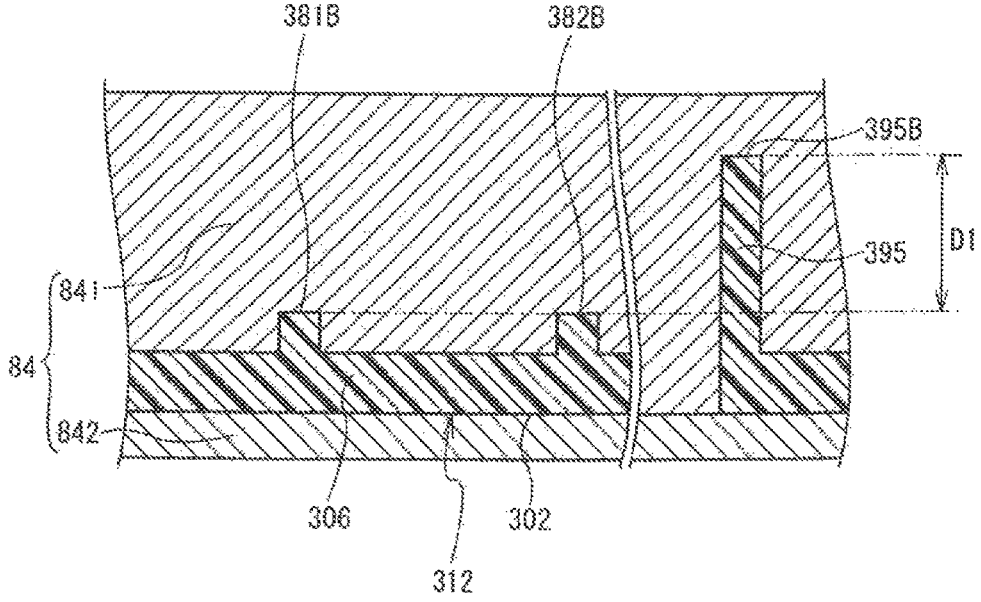
FIG. 43 is a diagram showing a cross section of the bottom case 312 shown in FIG. 42 and the mold block 84, when the bottom case 312 is manufactured.
Figure 44:
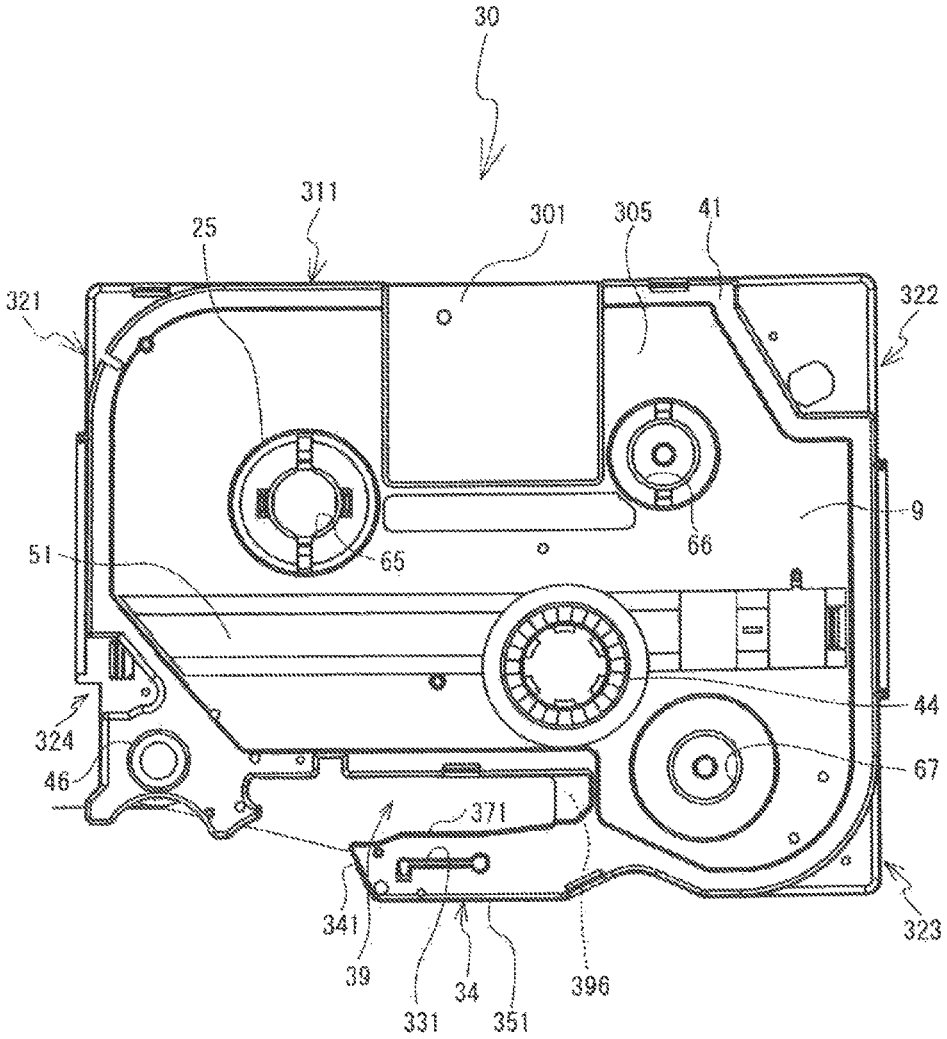
FIG. 44 is a plan view of the tape cassette 30 according to the third embodiment.

A case in which the regulating portions inside the arm portion 34 and the reference surfaces of the bottom case 312 are formed using the single mold block 84 will be explained with reference to FIG. 43. Note that in FIG. 43, parts that do not require explanation have been omitted from the diagram. As shown in FIG. 43, in the manufacturing of the bottom case 312, the first lower flat surface 395B and the first lower tape regulating portions 381B and 382B are manufactured using the same mold block 84. Note that the first lower ribbon regulating portions 386B and 387B and the second lower flat surface 392B are also manufactured using the same mold block 84, although they have been omitted from FIG. 43.

The mold block 84 includes the upper insert 841 and the lower insert 842. The second lower flat surface 392B and the bottom surface 302 of the bottom wall 306 are molded by the lower insert 842. Further, the upper surface of the bottom wall 306, the first lower flat surface 395B, the first lower tape regulating portions 381B and 382B, and the first lower ribbon regulating portions 386B and 387B are molded by the upper insert 841.

In this way, the first and second lower flat surfaces 395B and 392B, the first lower tape regulating portions 381B and 382B, and the first lower ribbon regulating portions 386B and 387B are molded using the same mold block 84 that includes the upper insert 841 and the lower insert 842. This may make the dimensional accuracy better than in a case in which the first and second lower flat surfaces 395B and 392B, the first lower tape regulating portions 381B and 382B, and the first lower ribbon regulating portions 386B and 387B are molded using separate mold blocks. Furthermore, because the regulating portions and the reference surfaces are close to one another, there may be fewer measurement errors, which may also improve the dimensional accuracy.

In addition, the first lower flat surface 395B, the first lower tape regulating portions 381B and 382B, and the first lower ribbon regulating portions 386B and 387B are formed using the same upper insert 841. This may make it possible to achieve a better dimensional accuracy than in a case where these portions are formed separately in the upper insert 841 and the lower insert 842.

As a consequence, the feeding accuracy of the tape and the ink ribbon 60 may be improved. Because the arm portion 34 is in the vicinity of the upstream side of the position (the opening 77) at which printing is performed by the thermal head 10, the improved the feeding accuracy of the tape and the ink ribbon 60 inside the arm portion 34 may also improve the printing accuracy.

In addition, after manufacture, the first and second lower flat surfaces 395B and 392B are used as the reference surfaces, and a dimensional control of each of the regulating portions may thus be performed with ease. For example, when the tape cassette 30 is inspected, dimensions of each of the regulating portions are measured using as references the first and second lower flat surfaces 395B and 392B that are the reference surfaces. At this time, the distances between each of the regulating portions and the reference surfaces are shorter than in the known art, so a product inspector can measure the dimensions accurately. For example, in the case of the tape cassette 30 that is formed using the mold block 84 that is shown in FIG. 43, a distance D1 between the first lower flat surface 395B and the first lower tape regulating portions 381B and 382B in the vertical direction may be measured accurately by using the formed first lower flat surface 395B of the bottom case 312 as the reference.

The first and second lower flat surfaces 395B and 392B are spaced from the center position in the width direction of the tape and the ink ribbon 60 that are housed in the cassette case 31 by a predetermined distance in the vertical direction. The feeding accuracy of the tape and the ink ribbon 60 is therefore further improved, because the vertical position of the tape and the ink ribbon 60 with respect to the vertical direction position of the first and second lower flat surfaces 395B and 392B is made clearer.

Furthermore, in the present embodiment, the distance between the center position in the width direction of the tape and the ink ribbon 60 and the first and second lower flat surfaces 395B and 392B is constant, regardless of the width of the tape and the ink ribbon 60. Accordingly, in the tape cassette 30 that houses a plurality of types of the tape and the ink ribbon 60 that have differing tape widths, the position of the first and second lower flat surfaces 395B and 392B may be used as a uniform reference, and dimension measurement of the cassette case 31 and parts control may thus be performed easily.

In addition, each of the regulating portions inside the arm portion 34 is positioned between the first and second lower flat surfaces 395B and 392B in the left-right direction of the bottom case 312 and is close to each one of the reference surfaces. In other words, it may be possible to use either one of the reference surfaces to perform dimension setting and dimension measurement, and it may also be possible to use both of the reference surfaces. Using both of the reference surfaces may make it possible to further improve the dimensional accuracy at the time of manufacture of the various regulating portions, further improving the feeding accuracy of the tape and the ink ribbon 60. In addition, after the various regulating portions have been manufactured, dimensional control can be performed more accurately and more easily.

In the present embodiment, the structures of and the relationships among the other reference surfaces that are provided in the bottom case 312 (the third lower flat surface 321B, the fourth lower flat surface 322B) and the other regulating portions (the second lower tape regulating portion 363, the third lower tape regulating portion 40B, the fourth lower tape regulating portion 41B, the second lower ribbon regulating portion 388B, and the third lower ribbon regulating portion 42B) that respectively restrict the movements of the tape and the ink ribbon 60 in the width direction (the vertical direction of the cassette case 31) are all the same as in the first embodiment. In addition, the structures of the portions other than the reference surfaces and the regulating portions are also the same as in the first embodiment. Explanations of these portions will therefore be omitted.

Figure 45:
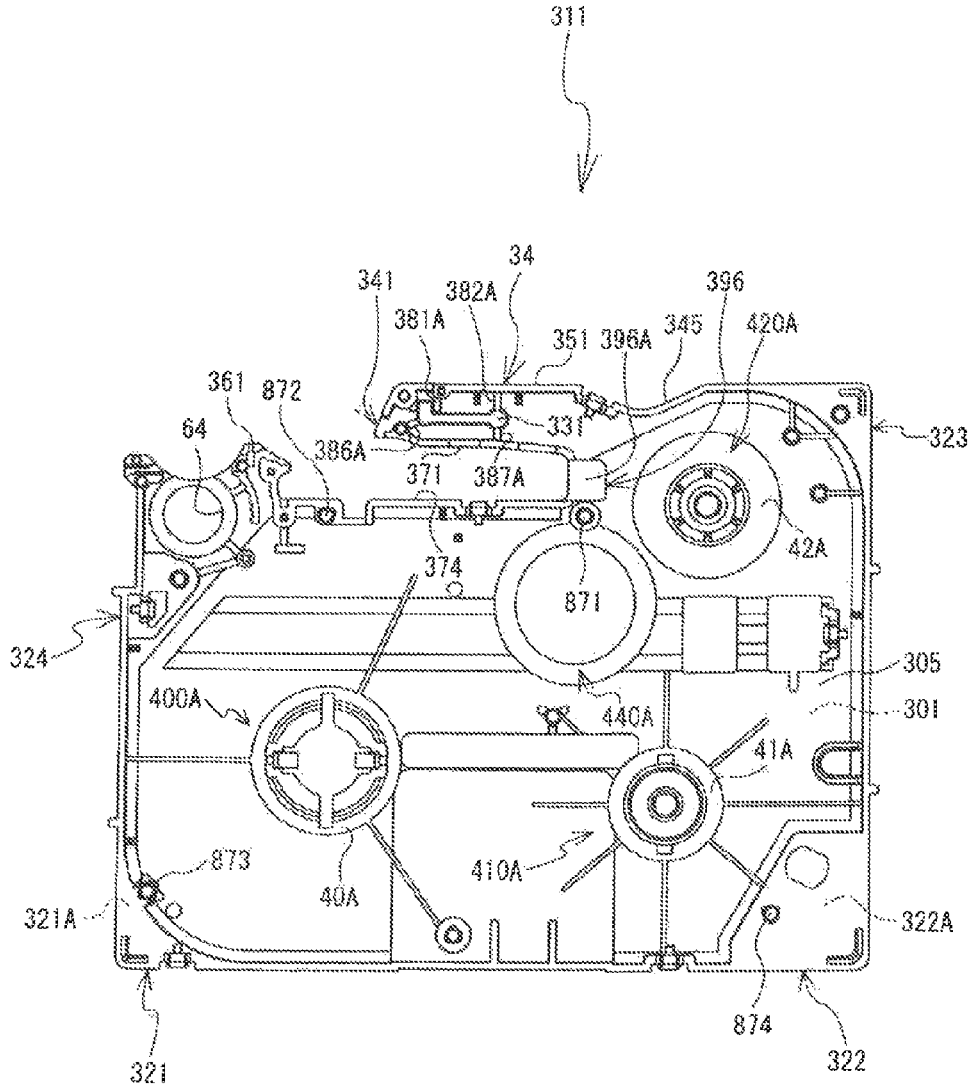
FIG. 45 is a bottom view of the top case 311 according to the third embodiment.

Next, the structure of the top case 311 will be explained. As shown in FIGS. 42 and 45, a first upper projecting portion 396 is connected to the upstream side end in the tape feed direction of the head insertion portion 39 of the top case 311. As shown in FIG. 42, the first upper projecting portion 396 projects downward from the lower surface of the top wall 305, and the first upper flat surface 396A is provided on its lower end. When the bottom case 312 and the top case 311 are joined together, an end of the first upper flat surface 396A other than the downstream side end contacts with the first lower flat surface 395B of the bottom case 312. In the present embodiment, the first upper flat surface 396A, which has a rectangular shape in a bottom view (refer to FIG. 45), contacts with the first lower flat surface 395B on the three sides other than the side located at the most downstream side in the tape feed direction. Together with the first lower projecting portion 395, the first upper flat surface 396A forms the first support receiving portion 391.

A distance between the position of the first upper flat surface 396A in the vertical direction (the height direction) of the top case 311 and the center positions in the width direction of the tape and the ink ribbon 60 that are housed in the cassette case 31 are constant, regardless of the type of the tape cassette 30. In other words, the distance is constant even when the height in the vertical direction of the tape cassette 30 is different. Accordingly, the greater the widths of the tape and the ink ribbon 60 that are housed in the tape cassette 30 are, the longer the distance is from the top surface 301 to the first upper flat surface 396A.

The first upper flat surface 396A is the reference surface of the top case 311. In the present embodiment, the first upper flat surface 396A is the reference surface for various regulating portions that will be described later and that restrict the movements of the tape and the ink ribbon 60 in the upward direction. Furthermore, in a case where the tape cassette 30 is installed in the cassette housing portion 8, the first upper flat surface 396A functions as a portion that is supported from underneath by the first supporting portion 741 that is provided in the head holder 74.

As shown in FIG. 45, the first insertion pin 871 projects downward on the rear side of the first upper projecting portion 396. In other words, the first insertion pin 871 is provided in the vicinity of the first upper flat surface 396A. The first insertion pin 871 is provided adjacent to the first upper flat surface 396A at a position that corresponds to the first cylindrical member 861 (refer to FIG. 40) that is provided in the bottom case 312. Thus, the arrangement position of the first insertion pin 871 is different from that in the first embodiment. In addition, in the vicinity of the downstream side end of the head insertion portion 39 in the tape feed direction, the second insertion pin 872 projects downward in a position that corresponds to the second cylindrical member 862 (refer to FIG. 40) that is provided on the second lower flat surface 392B of the bottom case 312. The structures of the first insertion pin 871 and the second insertion pin 872 are the same as in the first embodiment.

As shown in FIG. 45, in the section of the top case 311 that forms a part of the arm portion 34, in the same manner as in the first embodiment, regulating portions are provided on the feed paths of the tape and the ink ribbon 60 that respectively restrict the movements of the tape and the ink ribbon 60 in the upward direction.

Specifically, on the tape feed path, the first upper tape regulating portion 381A is provided on the right side of the left end of the fitting hole 331. In addition, the other first upper tape regulating portion 382A is provided in contact with the right end of the fitting hole 331. On the ink ribbon 60 feed path, the first upper ribbon regulating portions 386A and 387A that restrict the movement of the ink ribbon 60 in the upward direction are provided respectively in contact with the left end and the right end of the fitting hole 331.

The height positions in the vertical direction of the top case 311 of the first upper tape regulating portions 381A and 382A and the first upper ribbon regulating portions 386A and 387A are set using the first upper flat surface 396A of the first upper projecting portion 396 as the reference surface.

More specifically, the distances in the vertical direction between the projecting ends (the bottom ends) of the first upper tape regulating portions 381A and 382A and the first upper flat surface 396A are set in accordance with the tape width. The distances in the vertical direction between the projecting ends of the first upper ribbon regulating portions 386A and 387A and the first upper flat surface 396A are set in accordance with the width of the ink ribbon 60. All of these regulating members are provided inside the arm portion 34, and the first upper flat surface 396A is in the vicinity of the upstream side end of the head insertion portion 39. In other words, each of the regulating portions is in a position that is close to the first upper flat surface 396A that is the reference surface. Therefore, there may be fewer measurement errors, and it may be more likely that the regulating portions and the reference surfaces can be formed using the same mold block.

Figure 46:
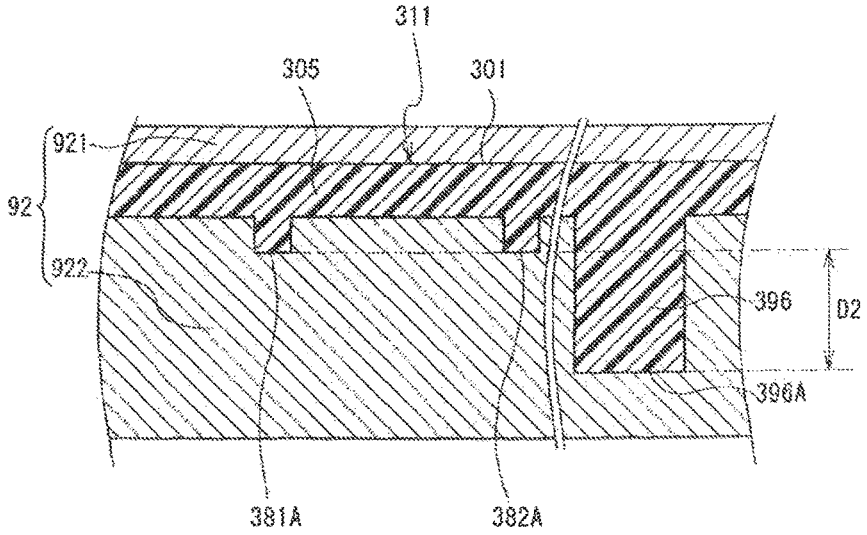
FIG. 46 is a diagram showing a cross section of the top case 311 shown in FIG. 42 and the mold block 84, when the top case 311 is manufactured.

A case in which the regulating portions and the reference surfaces inside the arm portion 34 of the top case 311 are formed using a single mold block 92 will be explained with reference to FIG. 46. Note that in FIG. 46, parts that do not require explanation are omitted from the diagram. As shown in FIG. 46, in the manufacturing of the top case 311, the first upper flat surface 396A and the first upper tape regulating portions 381A and 382A are manufactured using the same mold block 92. Note that the first upper ribbon regulating portions 386A and 387A are also manufactured in the same manner using the same mold block 92, although they are not shown in FIG. 46.

The mold block 92 includes an upper insert 921 and a lower insert 922. The top surface 301 of the top wall 305 is molded by the upper insert 921. Further, the lower surface of the top wall 305, the first upper flat surface 396A, the first upper tape regulating portions 381A and 382A, and the first upper ribbon regulating portions 386A and 387A are molded by the lower insert 922.

In this way, the first upper flat surface 396A, the first upper tape regulating portions 381A and 382A, and the first upper ribbon regulating portions 386A and 387A are molded using the same mold block 92 that includes the upper insert 921 and the lower insert 922. This may make the dimensional accuracy better than in a case in which the first upper flat surface 396A, the first upper tape regulating portions 381A and 382A, and the first upper ribbon regulating portions 386A and 387A are molded using separate mold blocks. Furthermore, because the regulating portions and the reference surfaces are close to one another, there may be fewer measurement errors, which may also improve the dimensional accuracy.

In addition, the first upper flat surface 396A, the first upper tape regulating portions 381A and 382A, and the first upper ribbon regulating portions 386A and 387A are formed using the same lower insert 922. This may make it possible to achieve a better dimensional accuracy than in a case where these portions are formed separately by the lower insert 922 and the upper insert 921.

Therefore, using the first upper flat surface 396A as the reference surface may make it possible to improve the dimensional accuracy during the manufacturing of the various regulating portions, thus improving the feeding accuracy of the tape and the ink ribbon 60. Because the arm portion 34 is in the vicinity of the upstream side of the position (the opening 77) at which printing is performed by the thermal head 10, improving the feeding accuracy of the tape and the ink ribbon 60 inside the arm portion 34 may also improve the printing accuracy. In the present embodiment, the regulating portions are provided in both the bottom case 312 and the top case 311. Consequently, the movements of the tape and the ink ribbon 60 may be restricted both in the downward direction and in the upward direction, so the feeding accuracy and the printing accuracy may further be improved.

In addition, after manufacture, a dimensional control of each of the regulating portions may be performed with ease, using the first upper flat surface 396A as the reference surface. For example, when the tape cassette 30 is inspected, each of the regulating portions can be measured using the first upper flat surface 396A as the reference. At this time, as the distances from the reference surface to each of the regulating portions are short, the product inspector can measure the dimensions accurately. For example, in the case of the tape cassette 30 that is formed using the mold block 92 that is shown in FIG. 46, a distance D2 between the first upper flat surface 396A and the first upper tape regulating portions 381A and 382A in the vertical direction may be measured accurately by using the formed first upper flat surface 396A of the top case 311 as the reference.

The first upper flat surface 396A is spaced from the center position in the width direction of the tape and the ink ribbon 60 that are housed in the cassette case 31 by a predetermined distance in the vertical direction. Therefore, the feeding accuracy of the tape and the ink ribbon 60 may further be improved, because the vertical position of the tape and the ink ribbon 60 with respect to the vertical direction position of the first upper flat surface 396A is made clearer.

In the present embodiment, the structures of and the relationships among the other reference surfaces that are provided in the top case 311 (the second upper flat surface 321A, the third upper flat surface 322A) and the other regulating portions (the second upper tape regulating portion 40A, the third upper tape regulating portion 41A, the second upper ribbon regulating portion 42A) that respectively restrict the movements of the tape and the ink ribbon 60 in the upward direction are all the same as in the first embodiment. In addition, the structures of the portions other than the reference surfaces and the regulating portions are also the same as in the first embodiment. Explanations of these portions will therefore be omitted.

In the third embodiment, in the same manner as in the first embodiment, the top case 311 and the bottom case 312 are joined together to form the tape cassette 30 by fitting the first to the fourth insertion pins 871 to 874 into the first to the fourth cylindrical members 861 to 864.

The first fitting portion 881 is provided between the bottom case 312 and the top case 311 in the vicinity of the first lower flat surface 395B and the first upper flat surface 396A that are the reference surfaces. The top case 311 and the bottom case 312 are appropriately joined together by the first fitting portion 881. Therefore, the first lower flat surface 395B and the first upper flat surface 396A that are the reference surfaces may be respectively maintained in appropriate positions in the vertical direction such that they are in appropriate contact with one another.

The positions of the various regulating portions that are provided in the vicinity of the first lower flat surface 395B and the first upper flat surface 396A may also be appropriately maintained, the various regulating portions being the first lower tape regulating portions 381B and 382B, the separating wall regulating portion 383, the first lower ribbon regulating portions 386B and 387B, the third lower ribbon regulating portion 42B, the first upper tape regulating portions 381A and 382A, and the first upper ribbon regulating portions 386A and 387A. As a result, the feeding accuracy of the tape and the ink ribbon 60 may be improved. Accordingly, the printing accuracy may also be improved. The fitting modes of the second to the fourth fitting portions 882 to 884 are the same as in the first embodiment.

Hereinafter, the operation of the tape cassette 30 and the tape printer 1 according to the third embodiment when the tape cassette 30 is installed in the tape printer 1 will be explained with reference to FIG. 31, FIG. 33, and FIG. 47 to FIG. 48.

Figure 47:
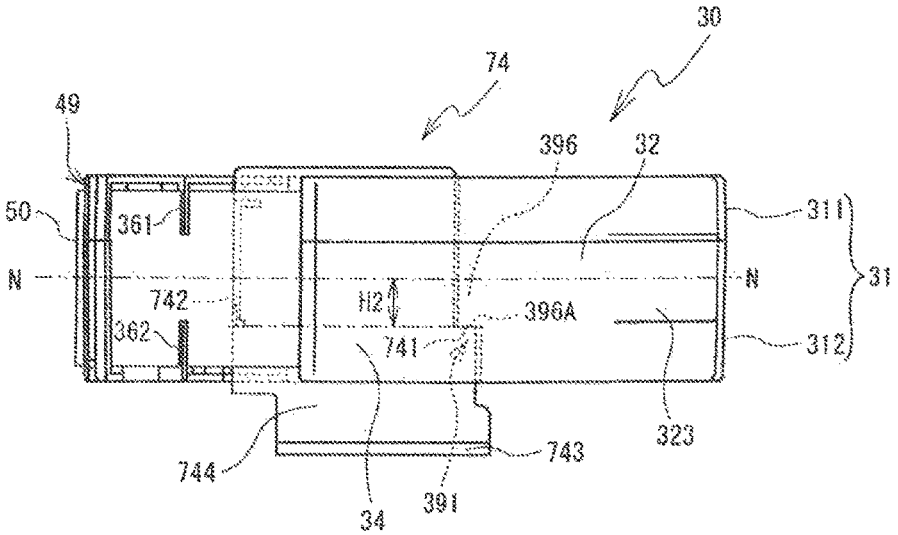
FIG. 47 is an explanatory diagram of the wide-width tape cassette 30 according to the third embodiment installed in the tape printer 1 as seen from the front.

When the user installs the tape cassette 30 in the cassette housing portion 8 and pushes the tape cassette 30 downward, the ceiling wall portion of the first support receiving portion 391, which is the indentation extending upwards from the bottom surface 302, comes into contact with the first supporting portion 741 provided on the head fixing portion 744 of the head holder 74. More specifically, the first upper flat surface 396A comes into contact with the first supporting portion 741, and thus the movement of the first support receiving portion 391 in the downward direction is restricted beyond that point, as shown in FIG. 47. In addition, as shown in FIG. 31, the ceiling wall portion of the second support receiving portion 392, which is the indentation extending upwards from the bottom surface 302, comes into contact with the second supporting portion 742 that is provided on the head fixing portion 744 of the head holder 74. More specifically, the second lower flat surface 392B comes into contact with the second supporting portion 742, and further downward movement is restricted. In other words, the tape cassette 30 is maintained in a state in which the first upper flat surface 396A of the top case 311 and the second lower flat surface 392B of the bottom case 312, which are the reference surfaces, are supported from underneath by the cassette supporting portions 741 and 742, which serve as reference points in the vertical direction for the center position of the thermal head 10.

Therefore, according to the tape printer 1 and the tape cassette 30 in the present embodiment, in the same manner as in the first embodiment, the positioning of the tape that is the print medium (one of the heat sensitive tape paper tape 55, the print tape 57 or the film tape 59) may be accurately performed in the vertical direction in a position that is in the vicinity of the thermal head 10 that performs the printing. Furthermore, the center positions in the width direction of the tape and the ink ribbon 60 may be accurately matched to the center position in the vertical direction for printing by the thermal head 10. Accordingly, the quality of the printing on the tape may be improved.

Figure 48:
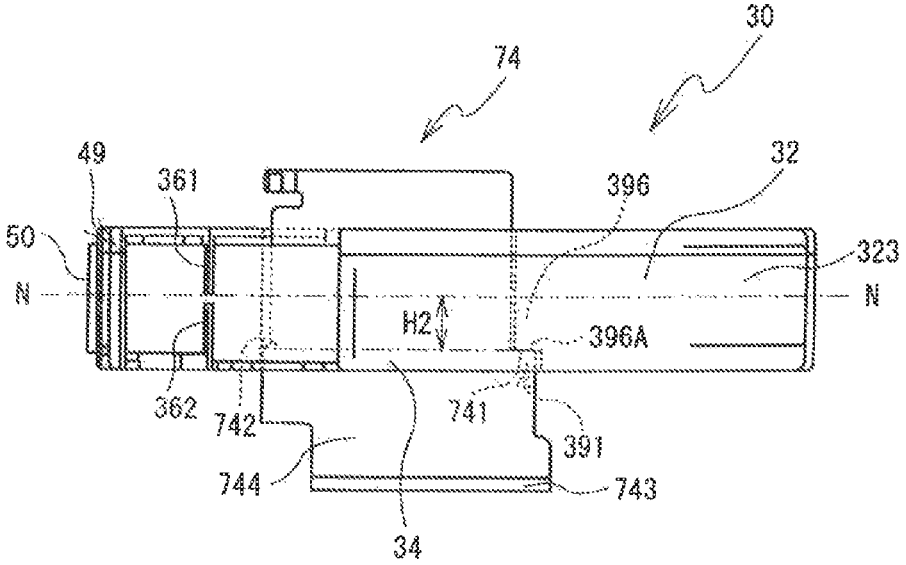
FIG. 48 is an explanatory diagram of the narrow-width tape cassette 30 according to the third embodiment installed in the tape printer 1 as seen from the front.

In a case where the tape cassette 30 that is installed in the cassette housing portion 8 has a lower height than the tape cassette 30 that is shown in FIG. 47 and FIG. 31, the first upper flat surface 396A and the second lower flat surface 392B respectively come into contact with and are supported by the cassette supporting portions 741 and 742, as shown in FIG. 48 and FIG. 33.

In the tape cassette 30 shown in FIG. 48 and FIG. 33, the distance in the vertical direction from the bottom surface 302 to the first upper flat surface 396A and the second lower flat surface 392B is shorter than in the tape cassette 30 that is shown in FIGS. 47 and 31. The distance H2 in the vertical direction (the height direction) of the tape cassette 30 between the positions of the first upper flat surface 396A and the second lower flat surface 392B and a center position N (a line that runs through the center of the vertical direction of the cassette case 31) in the vertical direction of the tape that is housed in the cassette case 31 is constant, regardless of the type of the tape cassette 30. Further, a distance in the vertical (height) direction of the tape cassette 30 between the positions of the second upper flat surface 321A and the third upper flat surface 322A and the center line N in the vertical direction of the cassette case 31 is also constant, regardless of the type of the tape cassette 30.

This may make it possible to use a plurality of types of the tape cassette 30 with different heights in the same tape printer 1. Even if tapes with different widths are used, the tapes may be fed at a position where the centers of the tapes in the tape width direction are matched. Therefore, it may be possible to inhibit the tapes from moving around due to differences in the pressure that is applied to the tapes in the tape width direction when the centers of the tapes are not aligned in the tape width direction.

Fourth Embodiment

A fourth embodiment will be explained with reference to FIG. 49 to FIG. 52. In the third embodiment, the first upper flat surface 396A that is the reference surface in the top case 311 and the first lower flat surface 395B that is the reference surface in the bottom case 312 are in contact with each other. In the fourth embodiment, an example will be explained in which the position at which the top case 311 and the bottom case 312 are in contact is different. The explanation that follows will focus on the structures that are different from the third embodiment, while the same reference numerals are assigned to, and explanations are omitted for, structures that are the same as in the third embodiment.

Figure 49:
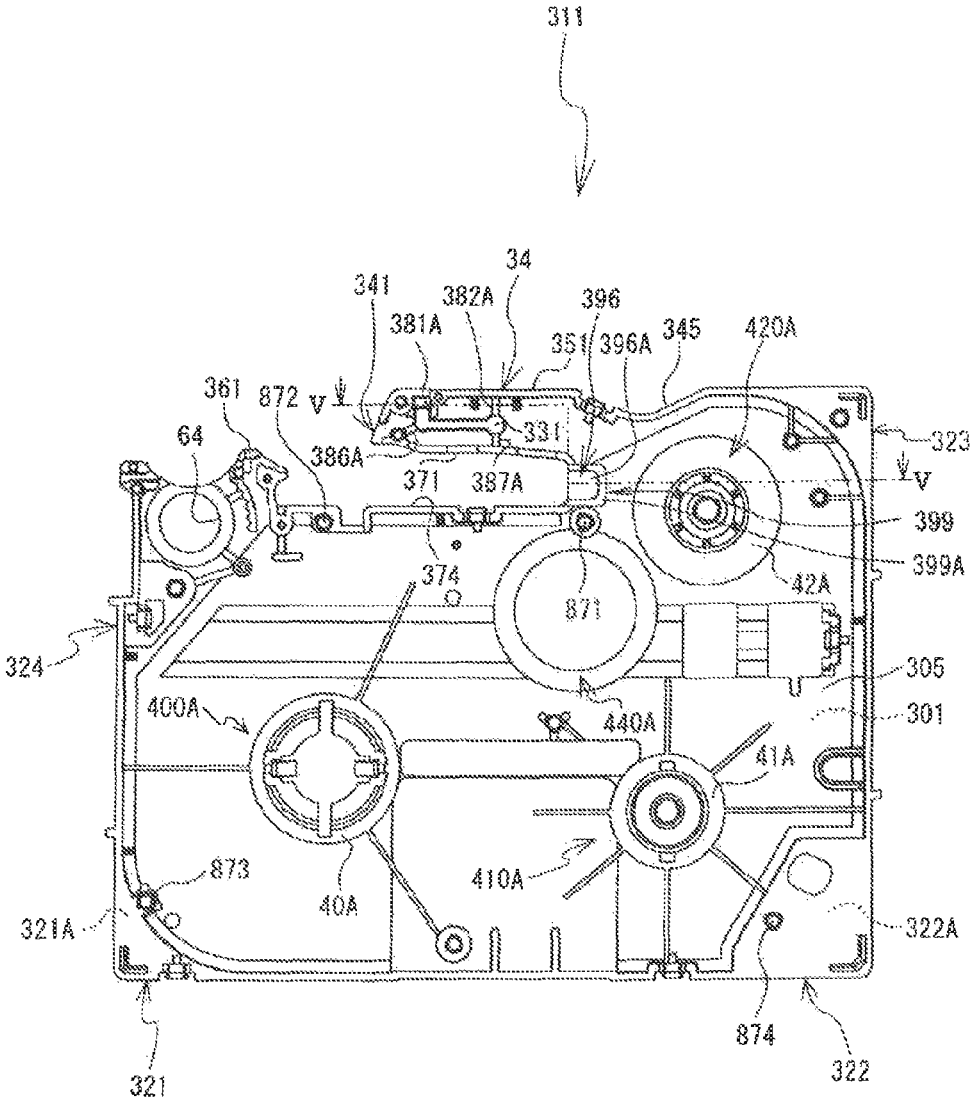
FIG. 49 is a bottom view of the top case 311 according to a fourth embodiment.
Figure 50:
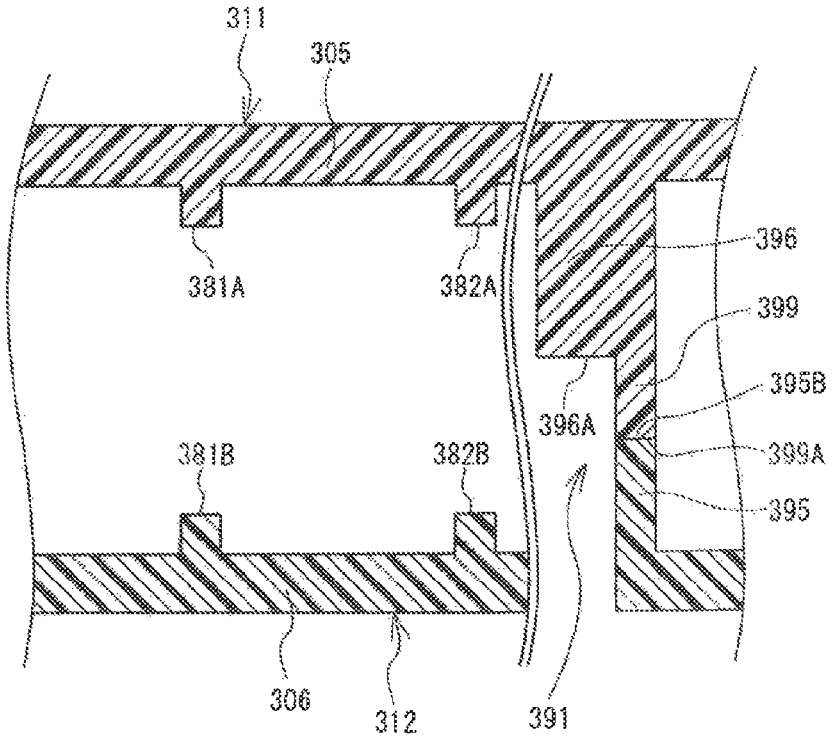
FIG. 50 is a cross-sectional view along a V-V line shown in FIG. 49 as seen in the direction of the arrows, when the top case 311 and the bottom case 312 according to the third embodiment are joined.

The structures of a section around the first upper flat surface 396A in the top case 311 in the fourth embodiment will be explained in detail. As shown in FIGS. 49 and 50, the first upper projecting portion 396 is connected to the upstream side end of the head insertion portion 39 of the top case 311 in the tape feed direction. The first upper projecting portion 396 is provided with the first upper flat surface 396A on its lower end.

A second upper projecting portion 399 projects downward from the top wall 305 such that it is connected to an end of the first upper flat surface 396A that is not the downstream side end. More specifically, in the fourth embodiment, the second upper projecting portion 399 is connected to three sides other than the side located at the most downstream side. As shown in FIG. 49, in a bottom view, the second upper projecting portion 399 has a U shape that is rotated ninety degrees in a counterclockwise direction. The second upper projecting portion 399 is provided with an upper contact flat surface 399A, which is a flat surface, on its lower end. In the present embodiment, the position of the upper contact flat surface 399A in the vertical direction is lower than that of the first upper flat surface 396A. When the top case 311 are joined together with the bottom case 312, the upper contact flat surface 399A contacts with the first lower flat surface 395B of the bottom case 312. In the fourth embodiment, the first support receiving portion 391 includes the first upper flat surface 396A, the first lower projecting portion 395, and the second upper projecting portion 399, as shown in FIG. 50. The second upper projecting portion 399 may not necessarily be connected to all ends (three sides) of the first upper flat surface 396A other than the downstream side end. Specifically, the second upper projecting portion 399 may project downward from the top wall 305 such that it is connected to any one of the ends of the first upper flat surface 396A, as far as the end is not the downstream side end. For example, the second upper projecting portion 399 may be connected only to the end of the first upper flat surface 396A on the upstream side in the feed direction of the tape. In such a case, the first lower projecting portion 395 may be provided such that it is positioned adjacent only to the upstream side end of the first upper flat surface 396A.

As in the third embodiment, the distance between the position of the first upper flat surface 396A in the vertical direction (the height direction) of the top case 311 and the center positions in the width direction of the tape and the ink ribbon 60 that are housed in the cassette case 31 is constant, regardless of the type of the tape cassette 30. In other words, the distance is constant even when the height in the vertical direction of the tape cassette 30 is different. Accordingly, the greater the widths of the tape and the ink ribbon 60 that are housed in the tape cassette 30 are, the longer the distance is from the top surface 301 to the first upper flat surface 396A.

The first upper flat surface 396A is the reference surface of the top case 311. In the fourth embodiment, in the same manner as in the third embodiment, the first upper flat surface 396A is the reference surface for various regulating portions that restrict the movements of the tape and the ink ribbon 60 in the upward direction. The first upper flat surface 396A is also the reference surface for the upper contact flat surface 399A. In a case where the tape cassette 30 is installed in the cassette housing portion 8, the first upper flat surface 396A functions as a portion that is supported from underneath by the first supporting portion 741 that is provided in the head holder 74.

Figure 51:
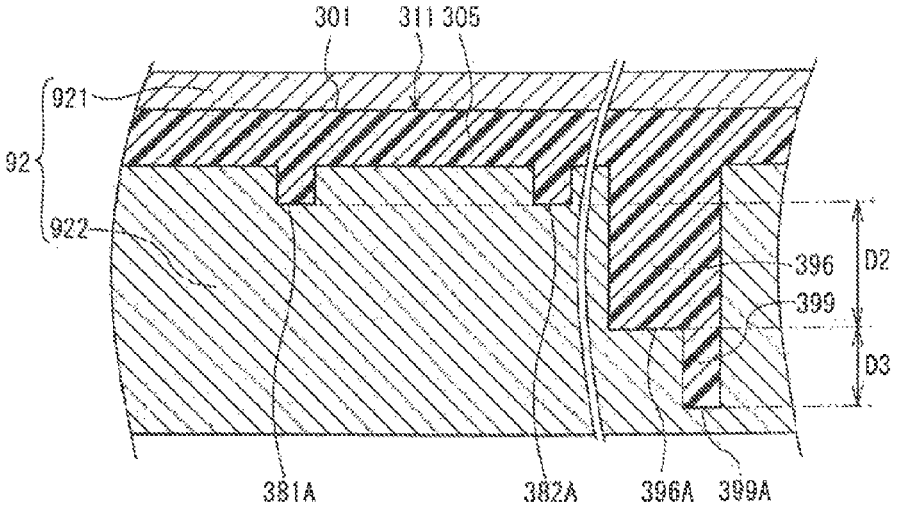
FIG. 51 is a diagram showing a cross section of the top case 311 shown in FIG. 50 and the mold block 92, when the top case 311 is manufactured.

As the distances from the upper contact flat surface 399A and the regulating portions to the reference surface are short, it may be more likely that the upper contact flat surface 399A, the regulating portions, and the reference surface can be formed using the same mold block 92, as shown in FIG. 51. The method for manufacturing the top case 311 using the mold block 92 is the same as that described above in the third embodiment, except that the upper contact flat surface 399A is also formed by the lower insert 922.

Using the first upper flat surface 396A as the reference surface for the tape cassette 30 in the present embodiment, in the same manner as in the third embodiment, may make it possible to improve a dimensional accuracy during the manufacturing of the various regulating portions. Thus, both the feeding accuracy of the tape and the ink ribbon 60 and the printing accuracy may be improved. Moreover, after manufacture, the first upper flat surface 396A can be used as the reference surface, and the dimensional control of each of the regulating portions and the upper contact flat surface 399A may be performed with ease.

For example, when the tape cassette 30 is inspected, each of the regulating portions and the upper contact flat surface 399A may be measured using the first upper flat surface 396A as the reference surface. At this time, as the distances from the reference surface to each of the regulating portions and the upper contact flat surface 399A are short, a product inspector can measure the dimensions accurately. For example, in the case of the tape cassette 30 that is formed using the mold block 92 that is shown in FIG. 51, the distance D2 between the first upper flat surface 396A and the first upper tape regulating portions 381A and 382A in the vertical direction may be measured accurately by using the formed first upper flat surface 396A of the molded top case 311 as the reference. A distance D3 between the first upper flat surface 396A and the upper contact flat surface 399A in the vertical direction may also be measured accurately by using the first upper flat surface 396A as the reference.

In this manner, using the first upper flat surface 396A as the reference surface may make it possible to improve a dimensional accuracy of the upper contact flat surface 399A. In the fourth embodiment, the first lower flat surface 395B is the reference surface in the bottom case 312. Therefore, placing the first lower flat surface 395B in contact with the first upper flat surface 396A, for which the dimensional control has been performed, may make it possible to position the regulating portions accurately in relation to the first upper flat surface 396A, thus improving the tape feeding accuracy.

Next, the structures of a section around the first lower flat surface 395B in the bottom case 312 in the fourth embodiment will be explained in detail.

In the bottom case 312, the upstream side end in the tape feed direction of the head insertion portion 39 is indented from the head insertion portion 39 in a shape that corresponds to the upper contact flat surface 399A of the top case 311. Further, a side wall in the indented area is formed by the first lower projecting portion 395 that projects upward from the bottom wall 306 of the bottom case 312. The shape of the first lower projecting portion 395 in a plan view is the same as that in the third embodiment (refer to FIG. 40). The first lower flat surface 395B, which is the flat surface that is adjacent to an end of the first upper flat surface 396A that is not the downstream side end, is provided on the upper end of the first lower projecting portion 395.

When the top case 311 and the bottom case 312 are joined together, the upper contact flat surface 399A contacts with the first lower flat surface 395B of the bottom case 312. In other words, compared to the first lower projecting portion 395 in the third embodiment (refer to FIG. 42), the height of the first lower projecting portion 395 is different, and the position of the first lower flat surface 395B in the vertical direction is different, as shown in FIG. 50. However, the distance from the top surface 301 to the bottom surface 302 of the tape cassette 30 of the fourth embodiment is the same with that of the third embodiment.

As the distances between the regulating portions and the reference surfaces are also short in the bottom case 312 in the fourth embodiment, it may be more likely that the regulating portions and the reference surfaces can be formed using the same mold block. In the manufacturing of the bottom case 312 in the fourth embodiment, the regulating portions and the reference surfaces are formed using the same mold block, in the same manner as in the third embodiment (refer to FIG. 43). Thus, the dimensional accuracy may be improved, which in turn may improve the feeding accuracy of the tape and the ink ribbon 60. The printing accuracy may also be improved accordingly.

Figure 52:
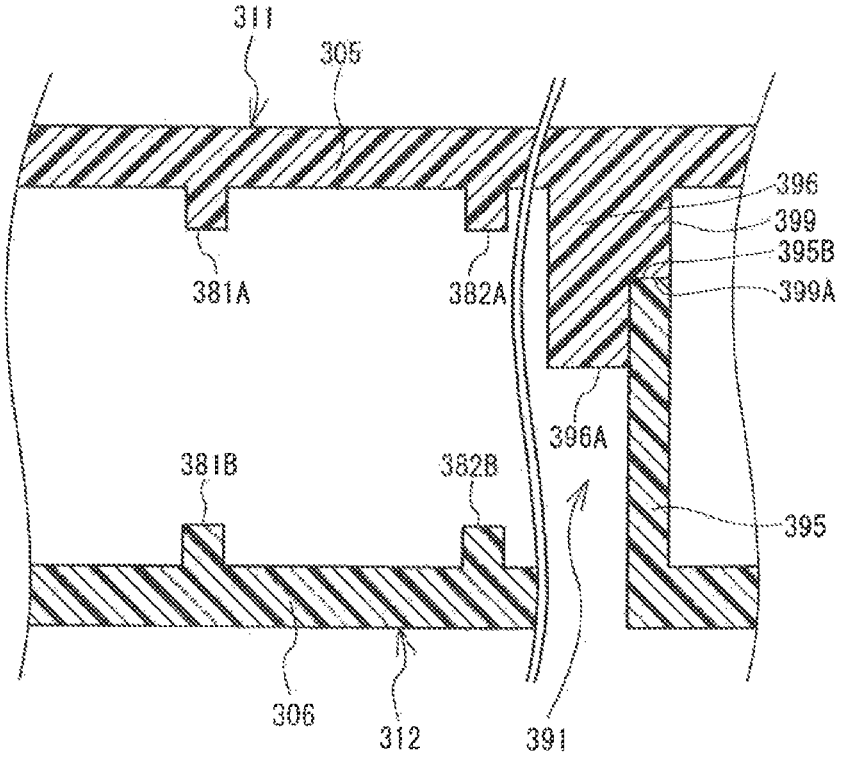
FIG. 52 is a cross-sectional view of a modified example of the tape cassette 30 shown in FIG. 49 according to the fourth embodiment.

In FIG. 50, the position in the vertical direction of the upper contact flat surface 399A is lower than that of the first upper flat surface 396A, but the upper contact flat surface 399A may also be formed in a position that is higher than that of the first upper flat surface 396A, as shown in FIG. 52, for example. In this case, the height of the first lower projecting portion 395 is increased in accordance with the position of the upper contact flat surface 399A.

Figure 53:
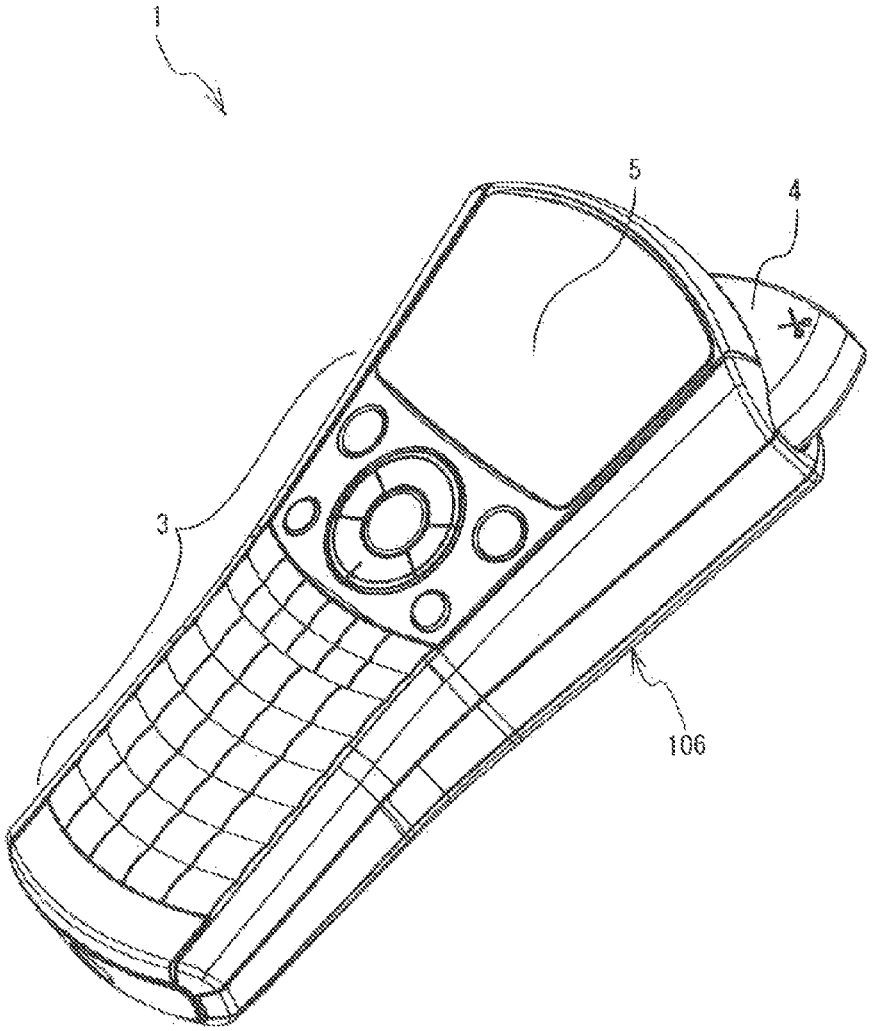
FIG. 53 is a perspective view of a tape printer 1 according to a modified example as seen from above when a bottom cover 106 is closed.
Figure 54:
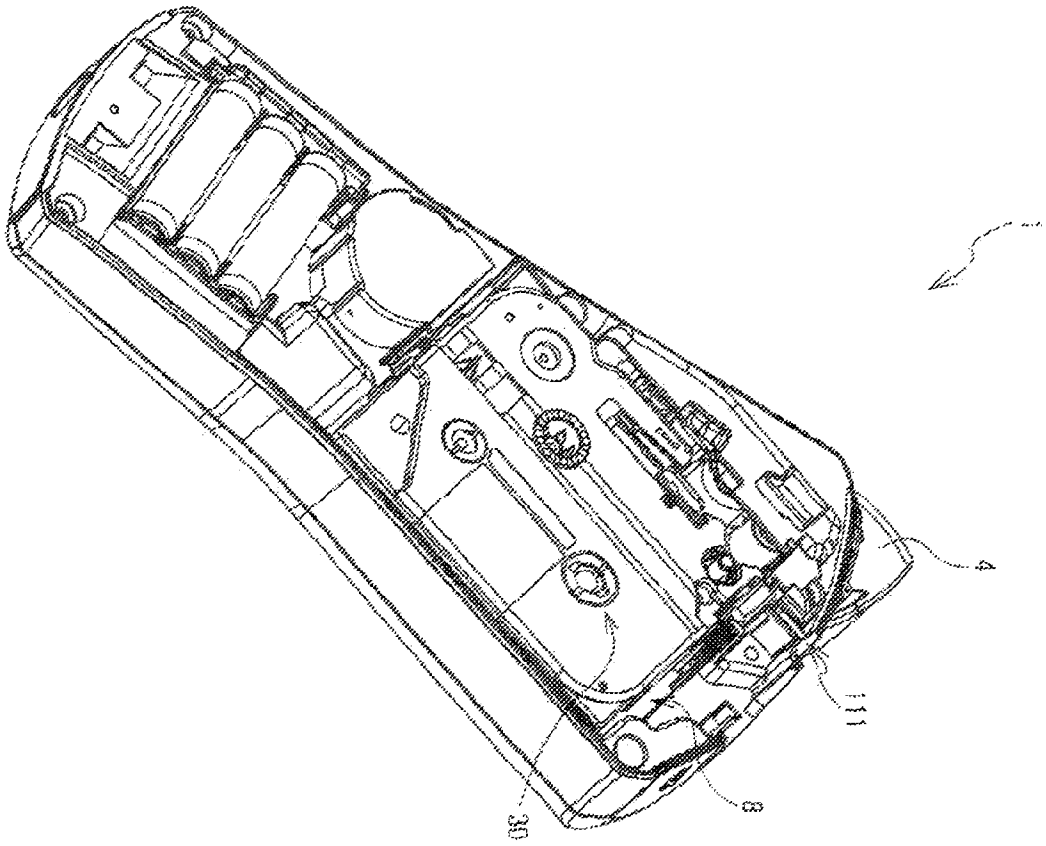
FIG. 54 is a perspective view of a tape printer 1 according to the modified example as seen from below when the bottom cover 106 is open.

In the third embodiment, when the tape cassette 30 is inserted into the tape printer 1, the downward direction for the tape printer 1 matches the downward direction for the tape cassette 30. However, the downward direction for the tape printer 1 may not always match the downward direction for the tape cassette 30. For example, FIG. 53 and FIG. 54 show the tape printer 1 according to a modified example. When the tape cassette 30 is inserted into the tape printer 1 that is shown in FIG. 53 and FIG. 34, the downward direction for the tape printer 1 is the same as the upward direction for the tape cassette 30. In other words, the up-down orientation of the tape cassette 30 when printing is performed by the tape printer 1 in FIG. 53 is the opposite of what it is in the tape printer 1 in FIG. 1.

The tape printer 1 according to the modified example will be explained with reference to FIG. 53 and FIG. 54. In FIG. 53, the lower left side, the upper right side, the lower right side, and the upper left side of the page correspond respectively to the front side, the rear side, the right side, and the left side of the tape printer 1. Further, the front side of the page corresponds to the top side of the tape printer 1, and the rear side of the page corresponds to the bottom side of the tape printer 1.

An overview of the configuration of the tape printer 1 according to the modified example will be explained. The tape printer 1 is a general-purpose tape printer in which various types of tape cassettes can be used, such as the thermal type, the receptor type, the laminate type, the heat-sensitive laminate type, and the like.

As shown in FIG. 53, the tape printer 1 is formed in a roughly rectangular shape. The display 5 for displaying print data, a setting screen, and the like is provided in the rear portion of the top surface (the upper right in FIG. 53). The keyboard 3 for operating the tape printer 1 is provided in the front portion of the top surface (the lower left in FIG. 53). The discharge slit 111 from which a printed tape 50 is discharged is provided on the rear face of the tape printer 1 (refer to FIG. 54). A cut button 4 for cutting the printed tape 50 in the width direction is provided in the right-hand portion of the rear face of the tape printer 1.

A bottom cover 106 is provided on the bottom side of the tape printer 1 that is shown in FIG. 53. When the bottom cover 106 is removed, a user can insert and remove the tape cassette 30. In other words, the cassette housing portion 8 is provided such that the tape cassette 30 can be inserted and removed from the bottom side of the tape printer 1, as shown in FIG. 54. When the user uses the tape printer 1, the operation of the tape printer 1 can be performed by orienting the tape printer 1 such that the top side, where the keyboard 3 and the like are provided, faces upward. Therefore, the upward direction for the tape cassette 30 becomes the downward direction in the tape printer 1. In other words, the up-down orientation of the tape cassette 30 when printing is performed is the opposite of what it is when the tape printer 1 that is shown in FIG. 1 is used.

In this case as well, the various regulating portions of the top case 311 of the tape cassette 30 are accurately formed, using the first upper flat surface 396A and the like as the references. Thus, the tape and the ink ribbon 60 may be fed with good accuracy. The printing quality may therefore be improved. The various regulating portions are also provided in the bottom case 312, so the tape and the ink ribbon 60 may be fed with even better accuracy. The printing quality may therefore be improved even more.

Figure 55:
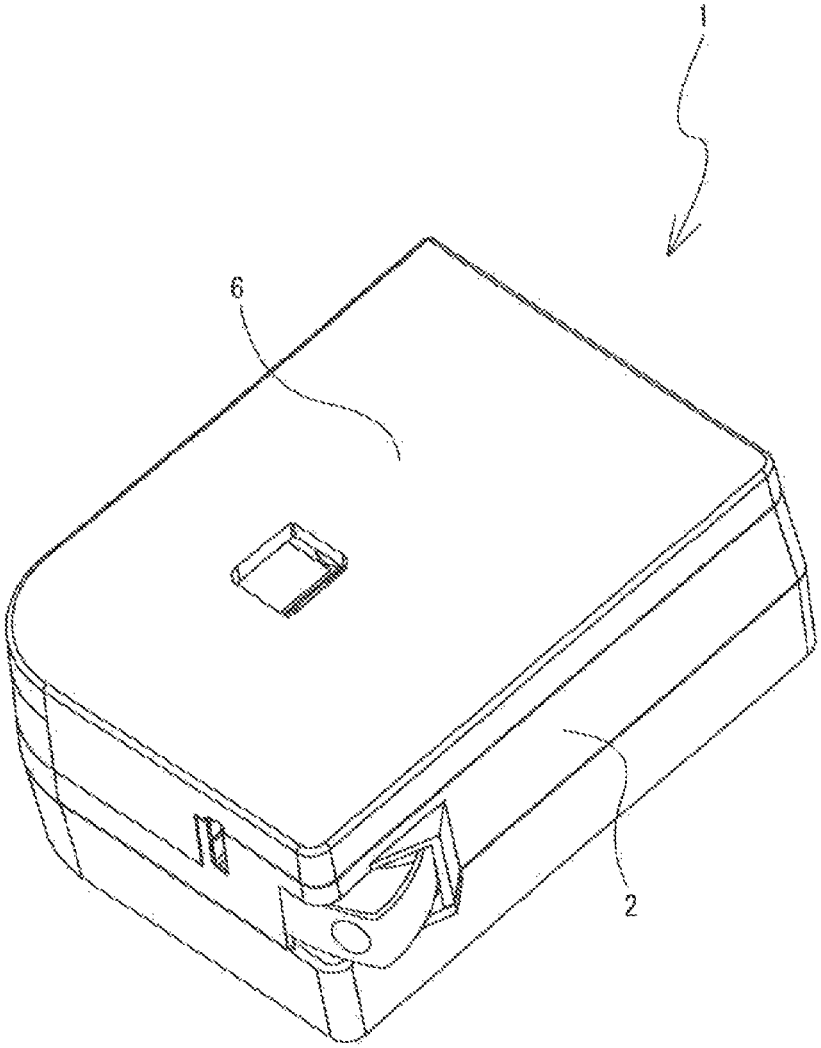
FIG. 55 is a perspective view of the tape printer 1 according to another modified example as seen from above when the cassette cover 6 is closed.
Figure 56:
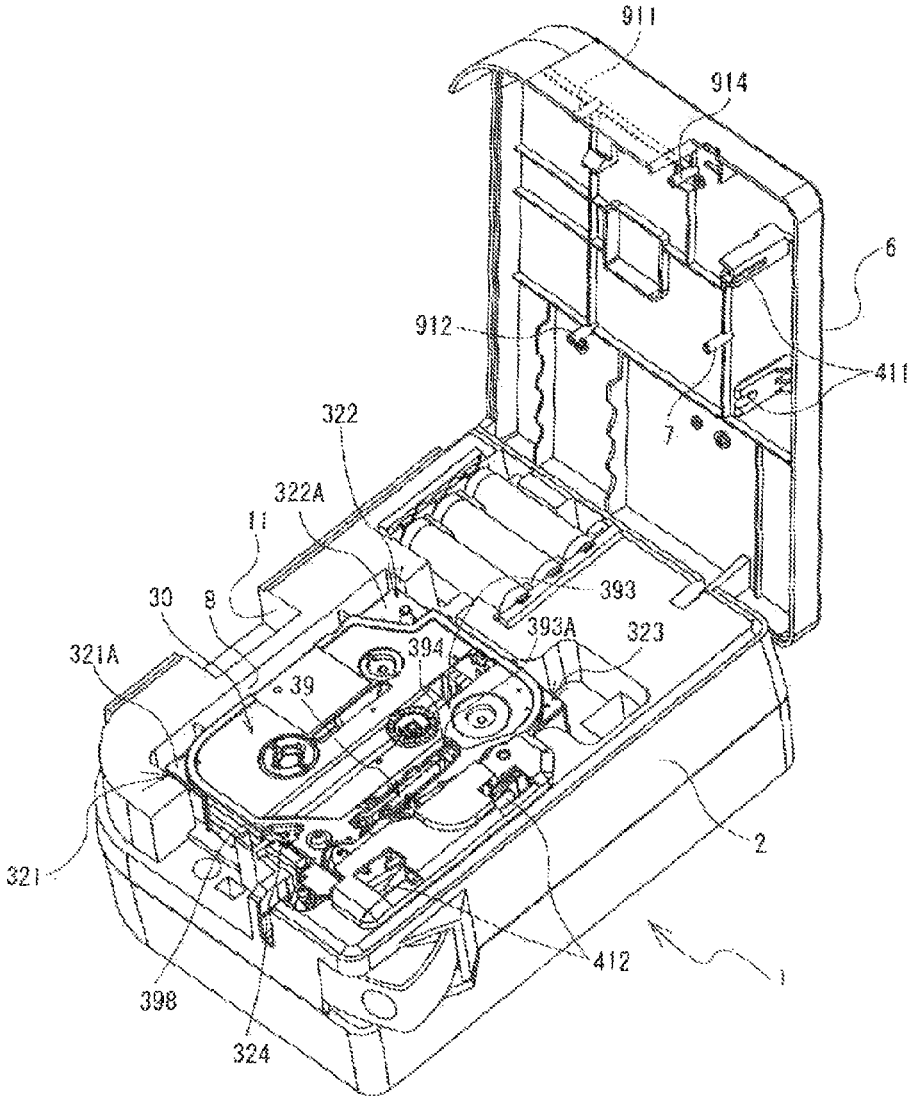
FIG. 56 is a perspective view of the tape printer 1 according to the other modified example as seen from above when the tape cassette 30 is installed and the cassette cover 6 is open.

Further, in the tape printers 30 in the first to fourth embodiments, the cassette cover 6 is opens toward the rear by moving rotationally around a shaft extending in the left-and-right direction (refer to FIG. 1 and FIG. 2). However, the cassette cover 6 may open in a different direction. For example, FIG. 55 and FIG. 56 show the tape printer 1 according to another modified example. The upper right side in FIG. 55 and FIG. 56 is the right side of the tape printer 1, the lower left side is the left side of the tape printer 1, the upper left side is the rear side of the tape printer 1 and the lower right side is the front side of the tape printer 1.

The tape printer 1 according to this modified example is a type that can be connected to a general purpose computer, such as a personal computer, and is not provided with a keyboard and a display. Here, the cassette cover 6 is supported by a shaft on the right end of the top surface of the tape printer 1, and moves rotationally around the shaft extending in the back-and-forth direction. Thus, the cassette cover 6 opens in the rightward direction. The shapes of the head pressing member 7 and the periphery pressing member 914 are not limited, as long as they can contact and press from above the first upper flat surface 393A of the first press receiving portion 393 and the flat surface 398A of the second press receiving portion 398 of the tape cassette 30 when the cassette cover 6 is closed. As shown in FIG. 56, in this modified example, the head pressing member 7 and the periphery pressing member 914 are cylindrical members that protrude downward from a lower surface of the cassette cover 6. In addition, in the first embodiment, the four periphery pressing members 911 to 914 are provided, but in the modified example, only the three periphery pressing members 911, 912 and 914 are provided.

Note that, in the tape printer 1 in which the cassette cover 6 opens in the rightward direction, the head pressing member 7 approaches the first press receiving portion 393 along the head insertion portion 39 that is a space extending in the left-and-right direction. Thus, the head pressing member 7 does not interfere with the tape cassette 30 before it contacts the first upper flat surface 393A. However, by providing the inclined portion 394 on the rear of the first upper flat surface 393A, the tape cassette 30 can be used in both types of the tape printer 1, namely, the type in which the cassette cover 6 opens in the rearward direction (refer to FIG. 1 and FIG. 2) and the type in which the cassette cover 6 opens in the rightward direction (refer to FIG. 55 and FIG. 56).

Various modifications may of course be made to the embodiments described above. One of the various technical features of the tape cassette 30 and the tape printer 1 disclosed in the above-described embodiments may be employed alone, or at least two of the technical features may be employed. Some modifications that may be made to the tape cassette 30 and the tape printer 1 will be exemplified below.

The shapes and the arrangement positions of the support receiving portions 391 and 392 are not limited to those exemplified in the embodiments. The first and second lower flat surfaces 391B and 392B of the support portions 391 and 392 are each rectangular in a bottom view. However, the first and second lower flat surfaces 391B and 392B may have another shape, such as a triangle or the like. Moreover, the shape of the first press receiving portion 393 is not limited to that exemplified in the embodiments. For example, it may be modified in the same manner as in the case of the first and second lower flat surfaces 391B and 392B of the support portions 391 and 392.

In the above-described embodiments, the tape printer 1 includes the cassette hook 75, and the tape cassette 30 includes the latching portion 397. However, the tape printer 1 may not always have the cassette hook 75. Then, the tape cassette 30 may not always have the latching portion 397.

In the above-described embodiments, the tape printer 1 includes the arm detection portion 200, and the tape cassette 30 includes the arm indicator portion 800. However, the tape printer 1 may not always have the arm detection portion 200. Then, the tape cassette 30 may not always have the arm indicator portion 800.

In the above-described embodiments, the first to fourth lower tape regulating portions 381B, 382B, 363, 40B and 41B are provided on the bottom case 312, and the first to third upper tape regulating portions 381A, 382A, 40A and 41A are provided on the top case 311. However, the tape cassette 30 may have a single regulating portion inside the arm portion 34 of the bottom case 312. The tape cassette 30 may have a single regulating portion inside the arm portion 34 of the top case 311. In either case, the position in which the regulating portion is provided inside the arm portion 34 is not limited to the examples described in the embodiments. The tape cassette 30 may additionally have a regulating portion(s) in another section (other sections).

In a case where the regulating portions are provided both in the bottom case 312 and the top case 311, it may be preferable for the regulating portion provided in the top case 311 to be arranged in a position facing the regulating portion provided in the bottom case 312 in the vertical direction. This is because the pair of regulating portions in the vertical direction can restrict the movement of the tape in both the upward and downward directions.

In addition, in the above-described embodiments, in addition to the regulating portions that restrict the movement of the tape in the vertical direction, the regulating portions that restrict the movement of the ink ribbon 60 in the vertical direction (the first to third lower ribbon regulating portions 386B, 387B, 388B and 42B, and the first and second upper ribbon regulating portions 386A, 387A and 42A) are provided on the tape cassette 30. However, the tape cassette 30 may have only a regulating portion(s) that restricts the movement of the tape in the upward or downward direction.

Furthermore, in the above-described embodiments, in the bottom case 312, all of the first to fourth lower flat surfaces 391B, 392B, 321B and 322B that are the reference surfaces are at the same distance from the center position of the tape in the width direction. In other words, they are all in the same plane. This may be preferable as it allows easy dimension setting and dimensional control of each of the regulating portions. However, it is not necessary for each of the distances between the center position of the tape in the width direction and the first to fourth lower flat surfaces 391B, 392B, 321B and 322B to all be the same. Similarly, in the top case 311, each of the distances between the first to third upper flat surfaces 393A, 321A and 322A that are the reference surfaces and the center position of the tape in the width direction need not necessarily all be the same.

Further, in the tape cassettes 30 described in the above-described embodiments, the first to fourth fitting portions 881 to 884 are provided respectively above the first to fourth lower flat surfaces 391B, 392B, 321B and 322B that are the reference surfaces. However, the tape cassette 30 may not always have such fitting portions. Further, at least one of the first to fourth fitting portions 881 to 884 may be provided above at least one of the corresponding first to fourth lower flat surfaces 391B, 392B, 321B and 322B.

In this case, for example, a tape cassette may include a housing, a tape as a print medium, an arm portion, a first lower indentation, a first lower regulating portion, and a first joining portion. The housing has a top surface, a bottom surface, a front surface and a pair of side surfaces. The housing may include a top case and a bottom case. The top case may include a top wall that forms the top surface, and the bottom case includes a bottom wall that forms the bottom surface. The tape may be housed in the housing. The arm portion may include a part of the front surface and an exit, and direct the tape to the exit, along a section of a predetermined feed path extending in parallel with the front surface. The first lower indentation may be an indentation formed by upwardly indenting a part of the bottom surface, and may be connected to an end on an upstream side of the arm portion in a tape feed direction of the tape. The first lower indentation may include a first lower flat surface, which is in a higher position than the bottom surface of the housing. The first lower regulating portion may be provided in a section of the bottom case that forms a part of the arm portion and on an upstream side of the exit in the tape feed direction. The first lower regulating portion may be provided in a position spaced from the first lower flat surface in the vertical direction by a distance determined in accordance with a width of the tape. The first lower regulating portion may be adapted to restrict the movement of the tape in a downward direction. The first joining portion may be provided in a direction perpendicular to the first lower flat surface. The first joining portion may be adapted to join the top case and the bottom case.

In this case, in the bottom case, the first lower regulating portion and the first lower flat surface of the tape cassette are provided in mutually proximal positions with the arm portion as a point of reference. The position of the first lower regulating portion in the vertical direction is determined using the first lower flat surface as the reference surface. The first joining portion joins the top case and the bottom case in the direction perpendicular to the first lower flat surface. As a result, a position in the vertical direction of the first lower flat surface may be appropriately maintained. Therefore, the first regulating portion provided in the vicinity of the first lower flat surface may be appropriately positioned. Thus, a feeding accuracy of the tape may be improved, and thus a printing accuracy may also be improved.

The tape cassette may further include another regulating portion (in the above-described embodiments, any one of the second to fourth lower tape regulating portions 363, 40B and 41B) provided in the vicinity of another flat surface, and the a position in the vertical direction of the other regulating portion may be determined using the other flat surface. In addition, the tape cassette may further include another joining portion (in the above-described embodiments, any one of the second to fourth joining portions 882 to 884) provided in a direction perpendicular to the other flat surface.

The tape cassette, for example, may further include a head holder insertion portion, a second lower indentation, and a second joining portion. The head holder insertion portion may be a space that is adjacent to the arm portion at the rear thereof, and extend through the housing in a vertical direction. The head holder insertion portion may extend along a left-and-right direction of the housing. The second indentation may be provided in the bottom case on a periphery of the head holder insertion portion and in the vicinity of an end on a downstream side of the head holder insertion portion in the tape feed direction. The second lower indentation may be an indentation formed by upwardly indenting a part of the bottom surface. The second lower indentation may include a second lower flat surface, which is in a higher position than the bottom surface of the housing. The second joining portion may be provided in a direction perpendicular to the second lower flat surface. The second joining portion may be adapted to join the top case and the bottom case. Then, the first lower indentation may be provided on the periphery of the head holder insertion portion and in the vicinity of an end on an upstream side of the head holder insertion portion in the tape feed direction. The first lower regulating portion may be positioned between the first lower flat surface and the second lower flat surface in the left-and-right direction of the housing. The first lower flat surface and the second lower flat surface may be spaced in the vertical direction from a center position of the tape in a width direction by a same distance.

In this case, in the bottom case, the position in the vertical direction of the first lower regulating portion is determined using the first lower flat surface and the second lower flat surface as reference surfaces. The first lower flat surface and the second lower flat surface are respectively provided in the vicinity of the upstream side end and the downstream side end of the head holder insertion portion, sandwiching the first lower regulating portion. The first joining portion joins the top case and the bottom case in the direction perpendicular to the first lower flat surface. The second joining portion joins the top case and the bottom case in the direction perpendicular to the second lower flat surface. Therefore, the positions in the vertical direction of the first and second flat surfaces may be appropriately maintained. Thus, the first lower regulating portion disposed between the first and second joining portions may be maintained further appropriately. As a result, the feeding accuracy of the tape may be improved further, and thus the printing accuracy may also be improved further.

The tape cassette may further include a tape guide portion and a second lower regulating portion. The tape guide portion may be positioned on a downstream side of the exit in the tape feed direction and in the vicinity of the end on the downstream of the head holder insertion portion in the tape feed direction. The tape guide portion may guide the tape discharged from the exit and exposed. The second lower regulating portion may be provided in the section of the bottom case that forms the part of the tape guide portion, and in a position spaced from the second lower flat surface in the vertical direction by a distance determined in accordance with the type of the tape. The second lower regulating portion may be adapted to restrict the movement of the tape in a downward direction.

In this case, in the bottom case, the second lower regulating portion is provided in the vicinity of the second lower flat surface, and the position of the second lower regulating portion in the vertical direction is determined using the second flat surface. The second joining portion joins the top case and the bottom case in the direction perpendicular to the second flat surface. Therefore, the position in the vertical direction of the second flat surface may be appropriately maintained, and the second regulating portion provided in the vicinity of the second lower flat surface may be appropriately positioned. Thus, the feeding accuracy of the tape may be improved further, and thus the printing accuracy may also be improved further.

The tape cassette 30 may alternatively configured as a ribbon cassette in which only an ink ribbon is mounted, without a tape as a print medium. In this case, for example, the ribbon cassette may include a housing, an ink ribbon for printing, an arm portion, a first lower indentation, and a first lower regulating portion. The housing has a top surface, a bottom surface, a front surface and a pair of side surfaces. The housing may include a top case and a bottom case. The top case may include a top wall that forms the top surface, and the bottom case includes a bottom wall that forms the bottom surface. The ink ribbon may be housed in the housing. The arm portion may include a part of the front surface and an exit, and direct the ink ribbon to the exit, along a section of a predetermined feed path. The feed path extends from a first area, in which the ink ribbon that has not been used is housed, to a second area, in which the ink ribbon that has been used is housed. The section of the feed path extends in parallel with the front surface. The first lower indentation may be an indentation formed by upwardly indenting a part of the bottom surface, and may be connected to an end on an upstream side of the arm portion in a feed direction of the ink ribbon. The first lower indentation may include a first lower flat surface, which is in a higher position than the bottom surface of the housing. The first lower regulating portion may be provided in a section of the bottom case that forms a part of the arm portion and on an upstream side of the exit in the feed direction. The first lower regulating portion may be provided in a position spaced from the first lower flat surface in the vertical direction by a distance determined in accordance with a width of the ink ribbon. The first lower regulating portion may be adapted to restrict the movement of the ink ribbon in a downward direction.

In this case, in the bottom case, the first lower regulating portion and the first lower flat surface of the ribbon cassette are provided in mutually proximal positions with the arm portion as a point of reference. The position of the first lower regulating portion in the vertical direction is determined using the first lower flat surface as a reference surface. Accordingly, a dimensional accuracy may be improved when the first lower regulating portion is manufactured, and thus a feeding accuracy of the ink ribbon may be improved. In addition, after manufacture, a dimensional control of the first lower regulating portion may be performed easily using the first lower flat surface as the reference surface.

In addition to the first lower regulating portion (in the above-described embodiments, the first lower ribbon regulating portions 386B and 387B) provided in the arm portion, the ribbon cassette may further include another regulating portion (in the above-described embodiments, the second lower ribbon regulating portion 388B) for restricting the movement of the ink ribbon in the downward direction. In such a case, the position of the other regulating portion in the vertical direction may be determined using another flat surface that functions as a reference surface.

For example, the ribbon cassette may further include a head holder insertion portion, a ribbon guide portion, and a second lower indentation. The head holder insertion portion may be a space that is adjacent to the arm portion at the rear thereof, and extend through the housing in a vertical direction. The head holder insertion portion may extend along a left-and-right direction of the housing. The ribbon guide portion may be provided in the housing on a downstream side of the exit in the feed direction and at an end on a downstream end of the head holder insertion portion in the feed direction. The ribbon guide portion may cause the ink ribbon discharged through the exit to bend along the feed path toward the second area. The second lower indentation may be provided in the bottom case on a periphery of the head holder insertion portion in the vicinity of the ribbon guide portion. The second lower indentation may also be positioned in front of a section of the feed path connecting the ribbon guide portion and the second area. The second lower indentation may be an indentation formed by upwardly indenting a part of the bottom surface. The second lower indentation may include a second lower flat surface, which is in a higher position than the bottom surface of the housing. Then, the first lower indentation may be provided on the periphery of the head holder insertion portion and in the vicinity of an end on an upstream side of the head holder insertion portion in the feed direction. The first lower regulating portion may be positioned between the first lower flat surface and the second lower flat surface in the left-and-right direction of the housing. The first lower flat surface and the second lower flat surface may be spaced from a center position of the ink ribbon in a width direction in the vertical direction by a same distance.

In this case, in the bottom case, the position in the vertical direction of the first lower regulating portion may be determined using the first lower flat surface and the second lower flat surface as reference surfaces. The first lower flat surface and the second lower flat surface are respectively provided in the vicinity of the upstream side end and the downstream side end of the head holder insertion portion, sandwiching the first lower regulating portion. Therefore, the dimensional accuracy may be improved further when the first lower regulating portion is manufactured, and the feeding accuracy of the ink ribbon may thus be improved further. In addition, after manufacture, the dimensional control of the first lower regulating portion may be performed even more easily using the first lower flat surface and the second lower flat surface as the reference surfaces.

The ribbon cassette may further include a second lower regulating portion. The second lower regulating portion may be provided in the section of the bottom case that forms the part of the ribbon guide portion, and in a position spaced from the second lower flat surface in the vertical direction by a distance determined in accordance with the width of the ink ribbon. The second lower regulating portion may be adapted to restrict the movement of the ink ribbon in a downward direction.

In this case, in the bottom case, the second lower flat surface and the second lower regulating portion are provided in the vicinity of the end of the head holder insertion portion on the downstream side in the feed direction. The position of the second lower regulating portion in the vertical direction may be determined using the second lower flat surface as the reference surface. In this case, the dimensional accuracy at the time of manufacture of the second lower regulating portion may be improved further, and, after manufacture, the dimensional control may be easily performed. Furthermore, the first lower flat surface and the second lower flat surface are in positions spaced from the center position in the width direction of the ink ribbon by the same distance. Thus, the position of the first lower regulating portion and the second lower regulating portion in the vertical direction is the same. Accordingly, the movement of the ink ribbon in the downward direction may be restricted by each of the regulating portions, and the ink ribbon may be accurately fed from the arm portion to the ribbon guide portion in parallel with the center position in the width direction of the ink ribbon.

In the ribbon cassette in the above-described example, the position of the regulating portion provided in the arm portion may not be limited to the positions exemplified in the embodiments. For example, one regulating portion may be provided on the feed path of the ink ribbon 60 in the arm portion 34. In such a case, it may be preferable that the position of the regulating portion is spaced from the exit 341 by a certain distance. This may reduce a possibility of wrinkling of the ink ribbon 60 at the exit 341. Specifically, it may be preferable that the regulating portion is spaced from the exit 341 by a distance that is at least a half the length of the arm portion 34 in the left-and-right direction.

The tape printer 1 exemplified in the embodiments includes a printhead, a tape drive shaft, and a ribbon drive shaft. The printhead performs printing on a tape as a print medium using an ink ribbon. The tape drive shaft feeds the tape by way of the printhead. The ribbon drive shaft feeds the ink ribbon by way of the printhead. In a case where such a tape printer performs printing using a tape cassette that can be installed in the tape printer, a vibration may be generated in movable components in the tape cassette. Therefore, the tape cassette may be configured as follows, in order to reduce the vibration.

Specifically, a tape cassette may be installed in and removed from a tape printer having a printhead that performs printing on a tape as a print medium using an ink ribbon, a tape drive shaft that feeds the tape by way of the printhead, and a ribbon drive shaft that feeds the ink ribbon by way of the printhead, and the tape cassette may comprise a housing, a tape, an ink ribbon, a head insertion portion, a tape drive roller, a ribbon drive roller, a first press receiving portion, and a second press receiving portion. The housing has a top surface, a bottom surface, a front surface and a pair of side surfaces. The housing may include a top case having the top surface and a bottom case having the bottom surface. The tape may be housed in a tape housing area in the housing. The ink ribbon may be housed in a ribbon housing area in the housing. The head insertion portion may be a space extending through the housing in the vertical direction. The printhead may be inserted in the head insertion portion form the bottom surface side of the housing. The tape drive roller may be a cylindrical member. The tape drive shaft may be inserted in the tape drive roller from the bottom surface side of the housing. The tape drive roller may be provided on a downstream side of an insertion position of the printhead in the head insertion portion in a feed direction of the tape. The tape drive roller may be driven by the tape drive shaft to rotate in a direction to pull out the tape from the tape housing area. The ribbon drive roller may be a cylindrical member. The ribbon drive shaft may be inserted in the ribbon drive roller from the bottom surface side of the housing. The ribbon drive roller may be provided on an upstream side of the insertion position of the printhead in the head insertion portion in a feed direction of the tape. The ribbon drive roller may be driven by the ribbon drive shaft to rotate in a direction to pull out the ink ribbon from the ribbon housing area. The first press receiving portion may be pressed from above by a first pressing member in the vicinity of the tape drive roller. The first pressing member may be provided to a cover of the tape printer. The cover may be adapted to cover the top surface of the tape cassette installed in the tape printer. The second press receiving portion may be pressed from above by the second pressing member in the vicinity of the ribbon drive roller. The second pressing member may be provided to the cover of the tape printer.

In this case, when the tape cassette is installed in the tape printer and the cover is closed, the first and second pressing members provided to the cover respectively press the first and the second press receiving portions from above. Because the first press receiving portion is pressed in the vicinity of the tape drive roller, a vibration of the tape drive roller, which is rotated by the tape drive shaft, may be reduced. Because the second press receiving portion is pressed in the vicinity of the ribbon drive roller, a vibration of the ribbon drive roller, which is rotated by the ribbon drive shaft, may be reduced. Further, because the tape cassette is pressed on the upstream side and the downstream side of the printhead inserted in the head insertion portion, an influence of the vibrations of the movable components on the vicinity of the head insertion may be reduced. As a result, the vibrations generated on the movable components of the tape cassette may be decreased while the tape printer performs printing, and thus a feeding failure of the tape and deterioration in the print quality may be prevented.

Further, the tape cassette may be configured such that the heating element row 10A of the thermal head 10 and the support receiving portions 391 and 392 have the following relationship. Specifically, a tape cassette may be installed in and removed from a tape printer including a printhead that has a row of heating elements arranged in a row, and the tape cassette may include a housing, a tape as a print medium, a head insertion portion, and a first support receiving portion. The housing may have a top surface, a bottom surface, a front surface and a pair of side surfaces. The tape may be wound and rotatably mounted within the housing. The head insertion portion may be a space into which a head holder that supports the printhead is inserted when the tape cassette is installed in the tape printer. The head insertion portion may extend through the housing in the vertical direction, and have an oblong rectangular shape in a plan view, the oblong rectangular shape extending parallel to the front surface. The first support receiving portion may be a portion that is adapted to be supported by a first supporting portion provided to the tape printer when the tape cassette is installed in the tape printer. The first support receiving portion may be located in a position to face the head insertion portion and in a first direction toward the most upstream side of the head insertion portion in a tape feed direction with respect to the row of heating elements.

In this case, the tape cassette can be supported by the first supporting portion of the tape printer in the vicinity of the printhead that performs printing on the tape as the print medium. Therefore, a position of the tape cassette in the vertical direction may be accurately determined when the tape cassette is installed in the tape printer. Then, a center position of printing by the printhead in the vertical direction, and a center position of the tape in a tape width direction may be accurately matched. Further, the first support receiving portion is provided on the upstream side of the insertion position of the printhead, that is, in a position immediately before printing is performed on the tape. Therefore, positioning of the tape cassette in the vertical direction may be performed in a most efficient position when matching the center position of printing by the printhead in the vertical direction and the center position of the tape in the tape width direction.

The tape cassette may further include a second support receiving portion adapted to be supported by a second supporting portion of the tape printer. Then, the first support receiving portion may be provided in a wall that forms an opening of the head insertion portion in the first direction with respect to the row of heating elements of the printhead when the tape cassette is installed in the tape printer. The first support receiving portion may be formed as an indentation extending from the bottom surface toward the top surface. The second support receiving portion may be provided in a wall that forms the opening of the head insertion portion in the second direction with respect to the row of heating elements of the printhead, the second direction being perpendicular to the first direction. The second support receiving portion may also be formed as an indentation extending from the bottom surface toward the top surface.

In this case, the first and second supporting portions of the tape printer respectively support the first and second support receiving portions. As a result, an appropriate positional relationship between the row of heating elements of the printhead and the head insertion portion may be maintained.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette comprising:

a housing having a top surface, a bottom surface, and a front surface, the front surface extending from the bottom surface toward the top surface in a first direction;

a wound tape mounted within the housing;

an arm portion defined by a section of the front surface and a first wall, the first wall extending from the bottom surface toward the top surface and being spaced from the section of the front surface in a second direction, the second direction being perpendicular to the front surface, the section of the front surface and the first wall forming an exit, an opening extending through the housing in the first direction, the opening being defined by the first wall, a second wall, and a connection portion, the first wall and the second wall facing each other, the first wall being disposed between the second wall and the front surface in the second direction, the second wall extending from the bottom surface toward the top surface, the connection portion connecting upstream ends of the first wall and the second wall in a feed direction of the tape, the feed direction being generally perpendicular to the first direction and the second direction; and a first surface provided in the connection portion, the first surface being disposed between the top surface and the bottom surface in the first direction, the housing having a first indentation extending from the bottom surface to the first surface.

2. The tape cassette according to claim 1, further comprising a second surface connected to the second wall, the second surface being disposed closer to a downstream end of the second wall than to the upstream end of the second wall in the feed direction, the second surface being disposed between the top surface and the bottom surface in the first direction, the housing having a second indentation extending from the bottom surface to the second surface.

3. The tape cassette according to claim 2, wherein a first distance in the first direction between the first surface and a center position in the first direction of the tape mounted within the housing is equal to a second distance in the first direction between the second surface and the center position of the tape.

4. The tape cassette according to claim 2, further comprising a cut-out portion provided in the second wall, the cut-out portion positioned between the first surface and the second surface in the feed direction.

5. The tape cassette according to claim 1, further comprising a first lower regulating portion provided in the arm portion, the first lower regulating portion is positioned upstream of the exit in the feed direction and spaced from the first surface in the first direction, the first lower regulating portion being configured to restrict a movement of the tape in a direction from the top surface toward the bottom surface.

6. The tape cassette according to claim 5, further comprising a discharge guide portion that is in a most downstream position on a feed path of the tape, and is configured to guide the tape after the tape has been discharged through the exit, and is configured to discharge the tape from the tape cassette, wherein a distance in the feed direction between the first surface and the first lower regulating portion is shorter than a distance in the feed direction between the exit of the arm portion and the discharge guide portion.

7. The tape cassette according to claim 5, further comprising a second surface connected to the second wall, the second surface being disposed closer to a downstream end of the second wall than to the upstream end of the second wall in the feed direction, the second surface being disposed between the top surface and the bottom surface in the first direction, the housing having a second indentation extending from the bottom surface to the second surface, wherein the first lower regulating portion is disposed between the first surface and the second surface in the feed direction, and the first surface and the second surface are spaced from a center position of the tape in the first direction by a same distance.

8. The tape cassette according to claim 7, further comprising a tape guide portion that is configured to guide the tape discharged from the exit and that is positioned downstream of the exit in the feed direction and in the vicinity of the downstream end of the opening; and a second lower regulating portion provided in the tape guide portion, the second lower regulating portion being spaced from the second surface in the first direction, the second lower regulating portion being configured to restrict the movement of the tape in a direction from the top surface toward the bottom surface.

9. The tape cassette according to claim 5 further comprising a third surface provided in the connection portion, the third surface being disposed between the top surface and the first surface in the first direction and at least partially overlapping the first surface in the first direction, the housing having a third indentation extending from the top surface to the third surface; and an upper regulating portion provided in the arm portion, the upper regulating portion being positioned upstream of the exit in the feed direction and being spaced from the third surface in the first direction, the upper regulating portion being configured to restrict the movement of the tape in a direction from the bottom surface toward the top surface.

10. The tape cassette according to claim 1, further comprising a third surface provided in the connection portion, the third surface being disposed between the top surface and the first surface in the first direction and at least partially overlapping the first surface in the first direction, the housing having a third indentation extending from the top surface to the third surface.

11. The tape cassette according to claim 1, further comprising:

an ink ribbon that is to be used for printing on the tape; and a ribbon take-up spool that is configured to wind the ink ribbon that has been used for printing on the tape, wherein the connection portion is connected to a guide portion, the guide portion being disposed between the top surface and the bottom surface in the first direction, and the ink ribbon is wound and mounted within the housing such that a feed path of the ink ribbon extends from the wound ink ribbon, contacts with the guide portion, and extends further in the arm portion toward the exit.

12. The tape cassette according to claim 11, wherein:

the connection portion includes a cylindrical portion, and the guide portion is connected to the cylindrical portion.

13. The tape cassette according to claim 1, wherein:

the housing further comprises a top case and a bottom case, the top case has the top surface and the bottom case has the bottom surface, and the first surface is provided in the top case.

14. The tape cassette according to claim 1, wherein:

the housing further comprises a top case and a bottom case, the top case has the top surface and the bottom case has the bottom surface, and the first surface is provided in the bottom case.

15. The tape cassette according to claim 2, wherein the second wall includes a slot that is positioned upstream of the second surface in the feed direction.

16. The tape cassette according to claim 1, wherein the first surface is formed at the first indentation being indented from a part of the bottom surface.

17. The tape cassette according to claim 10, wherein a first distance in the first direction between the first surface and a center position in the first direction of the tape mounted within the housing is equal to a third distance in the first direction between the third surface and the center position of the tape mounted within the housing.

18. A tape cassette comprising:

a housing having a top surface, a bottom surface, and a front surface, the front surface extending from the bottom surface toward the top surface in a first direction;

a wound tape mounted within the housing;

an arm portion defined by a section of the front surface and a first wall, the first wall extending from the bottom surface toward the top surface and being spaced from the section of the front surface in a second direction, the second direction being perpendicular to the front surface, the section of the front surface and the first wall forming an exit, an opening extending through the housing in the first direction, the opening being defined by the first wall, a second wall, and a connection portion, the first wall and the second wall facing each other, the first wall being disposed between the second wall and the front surface in the second direction, the second wall extending from the bottom surface toward the top surface, the connection portion connecting upstream ends of the first wall and the second wall in a feed direction of the tape, the feed direction being generally perpendicular to the first direction and the second direction; and a surface connected to the second wall, the surface being disposed closer to a downstream end of the second wall than to the upstream end of the second wall in the feed direction, the surface being disposed between the top surface and the bottom surface in the first direction, the housing having an indentation extending from the bottom surface to the surface.

19. The tape cassette according to claim 18, further comprising a first lower regulating portion provided in the arm portion, the first lower regulating portion being positioned upstream of the exit in the feed direction and being spaced from the surface in the first direction, the first lower regulating portion being configured to restrict a movement of the tape in a direction from the top surface toward the bottom surface.

20. The tape cassette according to claim 19, further comprising:

a tape guide portion that is configured to guide the tape discharged from the exit and that is positioned downstream of the exit in the feed direction and in the vicinity of the downstream end of the second wall; and a second lower regulating portion provided in the tape guide portion, the second lower regulating portion being spaced from the surface in the first direction, the second lower regulating portion being configured to restrict the movement of the tape in the direction from the top surface toward the bottom surface.

* * * * *